US006086180A

United States Patent [19]

Sugimoto et al.

[11] Patent Number: 6,086,180

[45] **Date of Patent: *Jul. 11, 2000**

[54] INK JET RECORDING APPARATUS CONTROLLED BY PRESUMED TEMPERATURE AND METHOD THEREFOR

[75] Inventors: Hitoshi Sugimoto; Hiromitsu Hirabayashi, both of Yokohama; Shigeyasu Nagoshi, Kawasaki; Noribumi Koitabashi, Yokohama; Miyuki Matsubara, Tokyo; Hitoshi Nishikori, Kawasaki; Fumihiro Gotoh, Kawasaki; Masaya Uetuki, Kawasaki, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/250,160

[22] Filed: May 27, 1994

[30] Foreign Application Priority Data

| | | | |
|---|---|---|---|
| May 27, 1993 | [JP] | Japan | 5-126391 |
| May 27, 1993 | [JP] | Japan | 5-126392 |
| Aug. 20, 1993 | [JP] | Japan | 5-206690 |

[51] Int. Cl.[7] ..... B41J 29/38

[52] U.S. Cl. ..... 347/14

[58] Field of Search ..... 347/14, 17, 23, 347/11, 49, 35

[56] References Cited

U.S. PATENT DOCUMENTS

| | | | |
|---|---|---|---|
| 4,313,124 | 1/1982 | Hara . | |
| 4,345,262 | 8/1982 | Shirato et al. . | |
| 4,459,600 | 7/1984 | Sato et al. . | |
| 4,463,359 | 7/1984 | Ayata et al. . | |
| 4,558,333 | 12/1985 | Sugitani et al. . | |
| 4,608,577 | 8/1986 | Hori . | |
| 4,709,247 | 11/1987 | Piatt et al. | 347/87 X |
| 4,723,129 | 2/1988 | Endo et al. . | |
| 4,740,796 | 4/1988 | Endo et al. . | |
| 4,910,528 | 3/1990 | Firi et al. | 347/17 |
| 4,970,527 | 11/1990 | Gatten | 347/23 |
| 5,124,720 | 6/1992 | Schantz | 347/40 X |
| 5,166,699 | 11/1992 | Yano et al. . | |
| 5,355,159 | 10/1994 | Kaneko | 358/502 X |
| 5,398,053 | 3/1995 | Hirosawa et al. | 347/13 |

FOREIGN PATENT DOCUMENTS

| | | |
|---|---|---|
| 0440489 | 8/1991 | European Pat. Off. . |
| 0442705 | 8/1991 | European Pat. Off. . |
| 0505154 | 9/1992 | European Pat. Off. . |
| 0526223 | 2/1993 | European Pat. Off. . |
| 54-56847 | 5/1970 | Japan . |
| 59-123670 | 7/1984 | Japan . |
| 59-138461 | 8/1984 | Japan . |
| 60-71260 | 4/1985 | Japan . |
| 2-6136 | 1/1990 | Japan . |
| 5-31906 | 2/1993 | Japan . |
| 5-31918 | 2/1993 | Japan . |
| 5-64890 | 3/1993 | Japan . |

*Primary Examiner*—N. Le
*Assistant Examiner*—Michael Nghiem
*Attorney, Agent, or Firm*—Fitzpatrick, Cella, Harper & Scinto

[57] ABSTRACT

An ink jet recording apparatus including a recording head for performing print recording by ejecting ink from an ejection orifice by thermal energy; temperature sensors provided in the recording head; a temperature calculation device for calculating a temperature change of the recording head in a unit time as a discrete value on the basis of the supply of energy input to the recording head, and for calculating the temperature change of the recording head by accumulating the discrete value in the unit time; a temperature presuming device for presuming a head temperature by both a calculated value of the temperature change and an adopted base value of the head temperature; a detection device for detecting a difference between the head presumed temperature and a detected temperature sensed by the temperature sensors; an update device for updating the adopted base value of the head temperature by the difference; and a control device for controlling ejection of the ink to be stabilized in accordance with the head presumed temperature.

59 Claims, 56 Drawing Sheets

FIG. 6

| | 0.0% ~ | 2.5% ~ | 5.0% ~ | 7.5% ~ | 10.0% ~ | 12.5% ~ | 87.5% ~ | 90.0% ~ | 92.5% ~ | 95.0% ~ | 97.5% ~ |
|---|---|---|---|---|---|---|---|---|---|---|---|
| 0.05sec~ | 0.00 | 0.89 | 1.56 | 2.22 | 2.89 | 3.66 | 14.11 | 14.21 | 14.32 | 14.42 | 14.53 |
| 0.10sec~ | 0.00 | 0.43 | 0.62 | 0.41 | 1.01 | 1.24 | 4.89 | 4.93 | 4.97 | 5.00 | 5.04 |
| 0.15sec~ | 0.00 | 0.20 | 0.25 | 0.30 | 0.35 | 0.42 | 1.70 | 1.71 | 1.72 | 1.74 | 1.75 |
| 0.20sec~ | 0.00 | 0.09 | 0.10 | 0.11 | 0.12 | 0.14 | 0.59 | 0.59 | 0.60 | 0.60 | 0.61 |
| 0.25sec~ | 0.00 | 0.04 | 0.05 | 0.07 | 0.08 | 0.09 | 0.17 | 0.17 | 0.17 | 0.17 | 0.17 |
| 0.30sec~ | 0.00 | 0.04 | 0.05 | 0.07 | 0.08 | 0.09 | 0.17 | 0.17 | 0.17 | 0.17 | 0.17 |
| 0.35sec~ | 0.00 | 0.04 | 0.05 | 0.07 | 0.08 | 0.09 | 0.17 | 0.17 | 0.17 | 0.17 | 0.17 |
| 0.40sec~ | 0.00 | 0.04 | 0.05 | 0.07 | 0.08 | 0.09 | 0.17 | 0.17 | 0.17 | 0.17 | 0.17 |
| 0.45sec~ | 0.00 | 0.04 | 0.05 | 0.07 | 0.08 | 0.09 | 0.17 | 0.17 | 0.17 | 0.17 | 0.17 |
| 0.50sec~ | 0.00 | 0.04 | 0.05 | 0.07 | 0.08 | 0.09 | 0.17 | 0.17 | 0.17 | 0.17 | 0.17 |
| 0.55sec~ | 0.00 | 0.04 | 0.05 | 0.07 | 0.08 | 0.09 | 0.17 | 0.17 | 0.17 | 0.17 | 0.17 |
| 0.60sec~ | 0.00 | 0.04 | 0.05 | 0.07 | 0.08 | 0.09 | 0.17 | 0.17 | 0.17 | 0.17 | 0.17 |
| 0.65sec~ | 0.00 | 0.04 | 0.05 | 0.07 | 0.08 | 0.09 | 0.17 | 0.17 | 0.17 | 0.17 | 0.17 |
| 0.70sec~ | 0.00 | 0.04 | 0.05 | 0.07 | 0.08 | 0.09 | 0.17 | 0.17 | 0.17 | 0.17 | 0.17 |
| 0.75sec~ | 0.00 | 0.04 | 0.05 | 0.07 | 0.08 | 0.09 | 0.17 | 0.17 | 0.17 | 0.17 | 0.17 |
| 0.80sec~ | 0.00 | 0.04 | 0.05 | 0.07 | 0.08 | 0.09 | 0.17 | 0.17 | 0.17 | 0.17 | 0.17 |
| 0.85sec~ | 0.00 | 0.00 | 0.00 | 0.00 | 0.00 | 0.00 | 0.00 | 0.00 | 0.00 | 0.00 | 0.00 |

FIG. 7

| | 0.0% ~ | 2.5% ~ | 5.0% ~ | 7.5% ~ | 10.0% ~ | 12.5% ~ | 87.5% ~ | 90.0% ~ | 92.5% ~ | 95.0% ~ | 97.5% ~ |
|---|---|---|---|---|---|---|---|---|---|---|---|
| 1sec ~ | 0.00 | 0.15 | 0.27 | 0.39 | 0.52 | 0.62 | 2.65 | 2.68 | 2.75 | 2.75 | 2.79 |
| 3sec ~ | 0.00 | 0.08 | 0.16 | 0.24 | 0.32 | 0.37 | 0.79 | 0.80 | 0.81 | 0.81 | 0.82 |
| 5sec ~ | 0.00 | 0.07 | 0.09 | 0.11 | 0.13 | 0.17 | 0.48 | 0.49 | 0.49 | 0.50 | 0.50 |
| 7sec ~ | 0.00 | 0.12 | 0.14 | 0.16 | 0.18 | 0.20 | 0.70 | 0.70 | 0.71 | 0.71 | 0.72 |
| 9sec ~ | 0.00 | 0.06 | 0.11 | 0.15 | 0.20 | 0.22 | 0.43 | 0.43 | 0.43 | 0.44 | 0.44 |
| 11sec ~ | 0.00 | 0.05 | 0.07 | 0.09 | 0.11 | 0.13 | 0.38 | 0.39 | 0.39 | 0.39 | 0.40 |
| 21sec ~ | 0.00 | 0.04 | 0.05 | 0.06 | 0.07 | 0.08 | 0.17 | 0.17 | 0.17 | 0.17 | 0.17 |
| 41sec ~ | 0.00 | 0.03 | 0.04 | 0.05 | 0.06 | 0.06 | 0.17 | 0.17 | 0.17 | 0.17 | 0.17 |
| 61sec ~ | 0.00 | 0.02 | 0.03 | 0.04 | 0.05 | 0.05 | 0.10 | 0.10 | 0.10 | 0.11 | 0.11 |
| 81sec ~ | 0.00 | 0.01 | 0.02 | 0.03 | 0.04 | 0.04 | 0.06 | 0.06 | 0.06 | 0.06 | 0.06 |
| 101sec ~ | 0.00 | 0.02 | 0.02 | 0.02 | 0.03 | 0.03 | 0.06 | 0.06 | 0.06 | 0.06 | 0.06 |
| 151sec ~ | 0.00 | 0.01 | 0.01 | 0.01 | 0.02 | 0.02 | 0.03 | 0.03 | 0.03 | 0.03 | 0.03 |
| 301sec ~ | 0.00 | 0.01 | 0.01 | 0.01 | 0.01 | 0.01 | 0.02 | 0.02 | 0.02 | 0.02 | 0.02 |
| 512sec ~ | 0.00 | 0.00 | 0.00 | 0.00 | 0.00 | 0.00 | 0.00 | 0.00 | 0.00 | 0.00 | 0.00 |

FIG. 8

| | 0.0% ~ | 20.0% ~ | 40.0% ~ | 60.0% ~ | 80.0% ~ |
|---|---|---|---|---|---|
| 0.05sec~ | 3.57 | 7.00 | 6.26 | 10.10 | 11.64 |
| 0.10sec~ | 2.25 | 4.20 | 4.10 | 6.24 | 7.16 |
| 0.15sec~ | 1.45 | 2.52 | 2.69 | 3.85 | 4.40 |
| 0.20sec~ | 0.93 | 1.51 | 1.76 | 2.38 | 2.71 |
| 0.25sec~ | 0.10 | 0.23 | 0.06 | 2.14 | 2.10 |
| 0.30sec~ | 0.15 | 0.24 | 0.24 | 0.55 | 0.68 |
| 0.35sec~ | 0.00 | 0.24 | 0.24 | 0.55 | 0.68 |
| 0.40sec~ | 0.00 | 0.24 | 0.24 | 0.55 | 0.68 |
| 0.45sec~ | 0.00 | 0.24 | 0.24 | 0.55 | 0.68 |
| 0.50sec~ | 0.00 | 0.24 | 0.24 | 0.55 | 0.68 |
| 0.55sec~ | 0.00 | 0.24 | 0.24 | 0.55 | 0.68 |
| 0.60sec~ | 0.00 | 0.24 | 0.24 | 0.55 | 0.68 |
| 0.65sec~ | 0.00 | 0.24 | 0.24 | 0.55 | 0.68 |
| 0.70sec~ | 0.00 | 0.24 | 0.24 | 0.55 | 0.68 |
| 0.75sec~ | 0.00 | 0.24 | 0.24 | 0.55 | 0.68 |
| 0.80sec~ | 0.00 | 0.24 | 0.24 | 0.55 | 0.68 |
| 0.85sec~ | 0.00 | 0.00 | 0.00 | 0.00 | 0.00 |

FIG. 9

| | 0.0% ~ | 2.5% ~ | 5.0% ~ | 7.5% ~ | 10.0% ~ | 12.5% ~ | 15.5% ~ | 87.5% ~ | 90.0% ~ | 92.5% ~ | 95.0% ~ | 97.5% ~ |
|---|---|---|---|---|---|---|---|---|---|---|---|---|
| 1sec~ | 0.00 | 0.11 | 0.14 | 0.18 | 0.21 | 0.27 | 0.33 | 1.74 | 1.83 | 1.91 | 2.00 | 2.08 |
| 3sec~ | 0.00 | 0.14 | 0.13 | 0.12 | 0.12 | 0.16 | 0.20 | 0.66 | 0.67 | 0.67 | 0.68 | 0.68 |
| 5sec~ | 0.00 | 0.02 | 0.04 | 0.06 | 0.08 | 0.09 | 0.10 | 0.40 | 0.41 | 0.41 | 0.41 | 0.42 |
| 7sec~ | 0.00 | 0.03 | 0.07 | 0.10 | 0.13 | 0.14 | 0.15 | 0.51 | 0.54 | 0.56 | 0.58 | 0.60 |
| 9sec~ | 0.00 | 0.06 | 0.07 | 0.08 | 0.08 | 0.11 | 0.13 | 0.35 | 0.36 | 0.36 | 0.36 | 0.37 |
| 11sec~ | 0.00 | 0.04 | 0.04 | 0.05 | 0.06 | 0.07 | 0.08 | 0.30 | 0.31 | 0.32 | 0.32 | 0.33 |
| 21sec~ | 0.00 | 0.02 | 0.03 | 0.04 | 0.04 | 0.05 | 0.06 | 0.14 | 0.14 | 0.14 | 0.14 | 0.14 |
| 41sec~ | 0.00 | 0.02 | 0.02 | 0.03 | 0.04 | 0.04 | 0.04 | 0.13 | 0.13 | 0.13 | 0.14 | 0.14 |
| 61sec~ | 0.00 | 0.02 | 0.02 | 0.02 | 0.03 | 0.03 | 0.04 | 0.08 | 0.08 | 0.09 | 0.09 | 0.09 |
| 81sec~ | 0.00 | 0.01 | 0.01 | 0.02 | 0.02 | 0.02 | 0.03 | 0.06 | 0.05 | 0.05 | 0.05 | 0.05 |
| 101sec~ | 0.00 | 0.01 | 0.01 | 0.02 | 0.02 | 0.02 | 0.02 | 0.04 | 0.04 | 0.05 | 0.05 | 0.05 |
| 151sec~ | 0.00 | 0.01 | 0.01 | 0.01 | 0.01 | 0.01 | 0.01 | 0.02 | 0.02 | 0.02 | 0.02 | 0.02 |
| 301sec~ | 0.00 | 0.00 | 0.00 | 0.01 | 0.01 | 0.01 | 0.01 | 0.01 | 0.01 | 0.01 | 0.01 | 0.01 |
| 512sec~ | 0.00 | 0.00 | 0.00 | 0.00 | 0.00 | 0.00 | 0.00 | 0.00 | 0.00 | 0.00 | 0.00 | 0.00 |

FIG. 22

| HEAT SOURCE / THERMAL TIME CONSTANT | EJECTION HEATER | | SUB-HEATER | |
|---|---|---|---|---|
| | SHORT | LONG | SHORT | LONG |
| REQUIRED CALCULATION INTERVAL | 0.05sec | 1.00sec | 0.05sec | 1.00sec |
| DATA HOLD TIME | 0.80sec | 512sec | 0.80sec | 512sec |

FIG. 23

| AMBIENT TEMP | TARGET TEMP | AMBIENT TEMP | TARGET TEMP | AMBIENT TEMP | TARGET TEMP | AMBIENT TEMP | TARGET TEMP |
|---|---|---|---|---|---|---|---|
| 0.0 ℃ | 35.5 ℃ | 17.5 ℃ | 26.0 ℃ | 35.0 ℃ | 15.0 ℃ | 52.5 ℃ | 15.0 ℃ |
| 0.5 ℃ | 35.5 ℃ | 18.0 ℃ | 26.0 ℃ | 35.5 ℃ | 15.0 ℃ | 53.0 ℃ | 15.0 ℃ |
| 1.0 ℃ | 35.5 ℃ | 18.5 ℃ | 25.5 ℃ | 36.0 ℃ | 15.0 ℃ | 53.5 ℃ | 15.0 ℃ |
| 1.5 ℃ | 35.5 ℃ | 19.0 ℃ | 25.5 ℃ | 36.5 ℃ | 15.0 ℃ | 54.0 ℃ | 15.0 ℃ |
| 2.0 ℃ | 35.5 ℃ | 19.5 ℃ | 25.0 ℃ | 37.0 ℃ | 15.0 ℃ | 54.5 ℃ | 15.0 ℃ |
| 2.5 ℃ | 35.5 ℃ | 20.0 ℃ | 24.5 ℃ | 37.5 ℃ | 15.0 ℃ | 55.0 ℃ | 15.0 ℃ |
| 3.0 ℃ | 35.5 ℃ | 20.5 ℃ | 24.5 ℃ | 38.0 ℃ | 15.0 ℃ | 55.5 ℃ | 15.0 ℃ |
| 3.5 ℃ | 35.5 ℃ | 21.0 ℃ | 24.0 ℃ | 38.5 ℃ | 15.0 ℃ | 56.0 ℃ | 15.0 ℃ |
| 4.0 ℃ | 35.5 ℃ | 21.5 ℃ | 24.0 ℃ | 39.0 ℃ | 15.0 ℃ | 56.5 ℃ | 15.0 ℃ |
| 4.5 ℃ | 35.5 ℃ | 22.0 ℃ | 23.5 ℃ | 39.5 ℃ | 15.0 ℃ | 57.0 ℃ | 15.0 ℃ |
| 5.0 ℃ | 35.5 ℃ | 22.5 ℃ | 23.5 ℃ | 40.0 ℃ | 15.0 ℃ | 57.5 ℃ | 15.0 ℃ |
| 5.5 ℃ | 35.0 ℃ | 23.0 ℃ | 23.0 ℃ | 40.5 ℃ | 15.0 ℃ | 58.0 ℃ | 15.0 ℃ |
| 6.0 ℃ | 34.5 ℃ | 23.5 ℃ | 22.5 ℃ | 41.0 ℃ | 15.0 ℃ | 58.5 ℃ | 15.0 ℃ |
| 6.5 ℃ | 34.0 ℃ | 24.0 ℃ | 22.5 ℃ | 41.5 ℃ | 15.0 ℃ | 59.0 ℃ | 15.0 ℃ |
| 7.0 ℃ | 34.0 ℃ | 24.5 ℃ | 22.0 ℃ | 42.0 ℃ | 15.0 ℃ | 59.5 ℃ | 15.0 ℃ |
| 7.5 ℃ | 33.5 ℃ | 25.0 ℃ | 21.5 ℃ | 42.5 ℃ | 15.0 ℃ | 60.0 ℃ | 15.0 ℃ |
| 8.0 ℃ | 33.0 ℃ | 25.5 ℃ | 21.5 ℃ | 43.0 ℃ | 15.0 ℃ | 60.5 ℃ | 15.0 ℃ |
| 8.5 ℃ | 32.5 ℃ | 26.0 ℃ | 21.0 ℃ | 43.5 ℃ | 15.0 ℃ | 61.0 ℃ | 15.0 ℃ |
| 9.0 ℃ | 32.0 ℃ | 26.5 ℃ | 20.5 ℃ | 44.0 ℃ | 15.0 ℃ | 61.5 ℃ | 15.0 ℃ |
| 9.5 ℃ | 32.0 ℃ | 27.0 ℃ | 20.5 ℃ | 44.5 ℃ | 15.0 ℃ | 62.0 ℃ | 15.0 ℃ |
| 10.0 ℃ | 31.5 ℃ | 27.5 ℃ | 20.0 ℃ | 45.0 ℃ | 15.0 ℃ | 62.5 ℃ | 15.0 ℃ |
| 10.5 ℃ | 31.0 ℃ | 28.0 ℃ | 19.5 ℃ | 45.5 ℃ | 15.0 ℃ | 63.0 ℃ | 15.0 ℃ |
| 11.0 ℃ | 30.5 ℃ | 28.5 ℃ | 19.0 ℃ | 46.0 ℃ | 15.0 ℃ | 63.5 ℃ | 15.0 ℃ |
| 11.5 ℃ | 30.5 ℃ | 29.0 ℃ | 19.0 ℃ | 46.5 ℃ | 15.0 ℃ | 64.0 ℃ | 15.0 ℃ |
| 12.0 ℃ | 30.0 ℃ | 29.5 ℃ | 18.5 ℃ | 47.0 ℃ | 15.0 ℃ | 64.5 ℃ | 15.0 ℃ |
| 12.5 ℃ | 29.5 ℃ | 30.0 ℃ | 18.0 ℃ | 47.5 ℃ | 15.0 ℃ | 65.0 ℃ | 15.0 ℃ |
| 13.0 ℃ | 29.0 ℃ | 30.5 ℃ | 18.0 ℃ | 48.0 ℃ | 15.0 ℃ | 65.5 ℃ | 15.0 ℃ |
| 13.5 ℃ | 28.5 ℃ | 31.0 ℃ | 17.5 ℃ | 48.5 ℃ | 15.0 ℃ | 66.0 ℃ | 15.0 ℃ |
| 14.0 ℃ | 28.5 ℃ | 31.5 ℃ | 17.0 ℃ | 49.0 ℃ | 15.0 ℃ | 66.5 ℃ | 15.0 ℃ |
| 14.5 ℃ | 28.0 ℃ | 32.0 ℃ | 17.0 ℃ | 49.5 ℃ | 15.0 ℃ | 67.0 ℃ | 15.0 ℃ |
| 15.0 ℃ | 27.5 ℃ | 32.5 ℃ | 16.5 ℃ | 50.0 ℃ | 15.0 ℃ | 67.5 ℃ | 15.0 ℃ |
| 15.5 ℃ | 27.0 ℃ | 33.0 ℃ | 16.0 ℃ | 50.5 ℃ | 15.0 ℃ | 68.0 ℃ | 15.0 ℃ |
| 16.0 ℃ | 27.0 ℃ | 33.5 ℃ | 16.0 ℃ | 51.0 ℃ | 15.0 ℃ | 68.5 ℃ | 15.0 ℃ |
| 16.5 ℃ | 26.5 ℃ | 34.0 ℃ | 15.5 ℃ | 51.5 ℃ | 15.0 ℃ | 69.0 ℃ | 15.0 ℃ |
| 17.0 ℃ | 26.5 ℃ | 34.5 ℃ | 15.0 ℃ | 52.0 ℃ | 15.0 ℃ | 69.5 ℃ | 15.0 ℃ |

$P_1$ : PRE-PULSE (= $T_1$) (PWM)
$P_2$ : INTERVAL (= $T_2 - T_1$)
$P_3$ : MAIN PULSE (= $T_3 - T_2$)
Vop : OPERATIONAL VOLTAGE

FIG. 28

| TEMP DIFFERENCE | SET-UP | PRE-HEAT | INTERVAL | MAIN | WEIGHT |
|---|---|---|---|---|---|
| -52.5℃~ | 0.905μsec | 0.000μsec | 0.000μsec | 4.525μsec | 60% |
| -49.5℃~ | 0.905μsec | 0.000μsec | 0.000μsec | 4.525μsec | 60% |
| -46.5℃~ | 0.905μsec | 0.000μsec | 0.000μsec | 4.525μsec | 60% |
| -43.5℃~ | 0.905μsec | 0.000μsec | 0.000μsec | 4.525μsec | 60% |
| -40.5℃~ | 0.905μsec | 0.000μsec | 0.000μsec | 4.525μsec | 60% |
| -37.5℃~ | 0.905μsec | 0.000μsec | 0.000μsec | 4.525μsec | 60% |
| -34.5℃~ | 0.905μsec | 0.000μsec | 0.000μsec | 4.525μsec | 60% |
| -31.5℃~ | 0.905μsec | 0.000μsec | 0.000μsec | 4.525μsec | 60% |
| -28.5℃~ | 0.905μsec | 0.000μsec | 0.000μsec | 4.887μsec | 64% |
| -25.5℃~ | 0.905μsec | 0.000μsec | 0.000μsec | 5.068μsec | 68% |
| -22.5℃~ | 0.905μsec | 0.000μsec | 0.000μsec | 5.249μsec | 72% |
| -19.5℃~ | 0.905μsec | 0.000μsec | 0.000μsec | 5.611μsec | 76% |
| -16.5℃~ | 0.905μsec | 0.000μsec | 0.000μsec | 5.972μsec | 80% |
| -13.5℃~ | 0.905μsec | 0.000μsec | 0.000μsec | 5.973μsec | 84% |
| -10.5℃~ | 0.905μsec | 0.000μsec | 0.000μsec | 6.335μsec | 88% |
| -7.5℃~ | 0.905μsec | 0.000μsec | 0.000μsec | 6.516μsec | 92% |
| -4.5℃~ | 0.905μsec | 0.000μsec | 0.000μsec | 6.697μsec | 96% |
| -1.5℃~ | 0.905μsec | 0.000μsec | 0.000μsec | 7.059μsec | 100% |
| 1.5℃~ | 0.905μsec | 1.991μsec | 0.543μsec | 5.068μsec | 100% |
| 4.5℃~ | 0.905μsec | 1.991μsec | 0.905μsec | 5.068μsec | 100% |
| 7.5℃~ | 0.905μsec | 1.991μsec | 1.448μsec | 5.068μsec | 100% |
| 10.5℃~ | 0.905μsec | 1.991μsec | 1.991μsec | 5.068μsec | 100% |
| 13.5℃~ | 0.905μsec | 1.991μsec | 1.991μsec | 5.068μsec | 100% |
| 16.5℃~ | 0.905μsec | 1.991μsec | 1.991μsec | 5.068μsec | 100% |
| 19.5℃~ | 0.905μsec | 1.991μsec | 1.991μsec | 5.068μsec | 100% |
| 22.5℃~ | 0.905μsec | 1.991μsec | 1.991μsec | 5.068μsec | 100% |
| 25.5℃~ | 0.905μsec | 1.991μsec | 1.991μsec | 5.068μsec | 100% |
| 28.5℃~ | 0.905μsec | 1.991μsec | 1.991μsec | 5.068μsec | 100% |
| 31.5℃~ | 0.905μsec | 1.991μsec | 1.991μsec | 5.068μsec | 100% |
| 34.5℃~ | 0.905μsec | 1.991μsec | 1.991μsec | 5.068μsec | 100% |
| 37.5℃~ | 0.905μsec | 1.991μsec | 1.991μsec | 5.068μsec | 100% |

FIG. 49A $P_1$ TABLE

UNIT (nSEC)

| RANK | RANK R (Ω) \ TEMP DIFFERENCE | ~-6 | -6~-3 | -3~0 | 0~3 | 3~6 | | 36~39 | 39~42 | 42~45 | 45~ |
|---|---|---|---|---|---|---|---|---|---|---|---|
| 1 | 229.2 | 1120 | 1120 | 1060 | 1060 | 1000 | | 400 | 400 | 400 | 400 |
| 2 | 237. | 1180 | 1180 | 1120 | 1120 | 1060 | | 460 | 400 | 400 | 400 |
| 3 | 244.8 | 1180 | 1180 | 1120 | 1120 | 1060 | | 460 | 400 | 400 | 400 |
| 4 | 252.6 | 1240 | 1240 | 1180 | 1180 | 1120 | | 520 | 460 | 460 | 460 |
| 5 | 260.4 | 1240 | 1240 | 1180 | 1180 | 1120 | | 520 | 460 | 460 | 460 |
| 6 | 268.2 | 1300 | 1300 | 1240 | 1240 | 1180 | | 580 | 520 | 520 | 520 |
| 7 | 276. | 1300 | 1300 | 1240 | 1240 | 1180 | | 580 | 520 | 520 | 520 |
| 8 | 283.8 | 1360 | 1360 | 1300 | 1300 | 1240 | | 640 | 580 | 580 | 520 |
| 9 | 291.6 | 1420 | 1420 | 1360 | 1360 | 1300 | | 700 | 640 | 640 | 580 |
| 10 | 229.4 | 1420 | 1420 | 1360 | 1360 | 1300 | | 700 | 640 | 640 | 580 |
| 11 | 307.2 | 1480 | 1480 | 1420 | 1420 | 1360 | | 700 | 700 | 640 | 640 |
| 12 | 315. | 1480 | 1480 | 1420 | 1420 | 1360 | | 700 | 700 | 640 | 640 |
| 13 | 322.8 | 1540 | 1540 | 1480 | 1480 | 1420 | | 700 | 700 | 640 | 640 |

FIG. 49B

WEIGHT TABLE

UNIT (%)

| RANK | RANK R(Ω) \ TEMP DIFFERENCE | ~-6 | -6~-3 | -3~0 | 0~3 | 3~6 | | 36~39 | 39~42 | 42~45 | 45~ |
|---|---|---|---|---|---|---|---|---|---|---|---|
| 1 | 229.2 | 95.735 | 95.735 | 94.313 | 94.313 | 92.891 | | 78.673 | 78.673 | 78.673 | 78.673 |
| 2 | 237. | 98.354 | 98.354 | 96.956 | 96.956 | 95.558 | | 81.574 | 80.175 | 80.175 | 80.175 |
| 3 | 244.8 | 97.928 | 97.928 | 96.574 | 96.574 | 95.221 | | 81.682 | 80.328 | 80.328 | 80.328 |
| 4 | 252.6 | 97.528 | 97.528 | 96.216 | 96.216 | 94.904 | | 81.784 | 80.472 | 80.472 | 80.472 |
| 5 | 260.4 | 97.153 | 97.153 | 95.88 | 95.88 | 94.607 | | 81.88 | 80.607 | 80.607 | 80.607 |
| 6 | 268.2 | 96.799 | 96.799 | 95.563 | 95.563 | 94.327 | | 81.97 | 80.734 | 80.734 | 80.734 |
| 7 | 276. | 96.264 | 95.264 | 94.063 | 94.063 | 92.862 | | 80.854 | 79.653 | 79.653 | 79.653 |
| 8 | 283.8 | 94.981 | 94.981 | 93.813 | 93.813 | 92.646 | | 80.968 | 79.8 | 79.8 | 78.632 |
| 9 | 291.6 | 94.714 | 94.714 | 93.577 | 93.577 | 92.44 | | 81.075 | 79.938 | 79.938 | 78.802 |
| 10 | 229.4 | 93.353 | 93.353 | 92.246 | 92.246 | 91.139 | | 80.07 | 78.963 | 78.963 | 77.856 |
| 11 | 307.2 | 93.14 | 93.14 | 92.062 | 92.062 | 90.983 | | 79.115 | 79.115 | 78.037 | 78.037 |
| 12 | 315. | 91.886 | 91.886 | 90.834 | 90.834 | 89.782 | | 78.209 | 78.209 | 77.156 | 77.156 |
| 13 | 322.8 | 91.719 | 91.719 | 90.693 | 90.693 | 89.666 | | 77.345 | 77.345 | 76.319 | 76.319 |

FIG. 50

| RANK | RANK RESIST | P3 (μs) | P1 (μs) |
|---|---|---|---|
| 1 | 225.3 ~ 233.1 | 2.92 (2.58) | 1.06 (0.72) |
| 2 | 233.1 ~ 240.9 | 3.04 (2.70) | 1.12 (0.78) |
| 3 | 240.9 ~ 248.7 | 3.16 (2.82) | 1.12 (0.78) |
| 4 | 248.7 ~ 256.5 | 3.22 (2.88) | 1.18 (0.84) |
| 5 | 256.5 ~ 264.3 | 3.34 (3.00) | 1.18 (0.84) |
| 6 | 264.3 ~ 272.1 | 3.40 (3.06) | 1.24 (0.90) |
| 7 | 272.1 ~ 279.9 | 3.46 (3.12) | 1.24 (0.90) |
| 8 | 279.9 ~ 287.7 | 3.52 (3.18) | 1.30 (0.96) |
| 9 | 287.7 ~ 295.5 | 3.58 (2.24) | 1.36 (1.02) |
| 10 | 295.5 ~ 303.3 | 3.64 (3.30) | 1.36 (1.02) |
| 11 | 303.3 ~ 311.1 | 3.70 (3.36) | 1.42 (1.08) |
| 12 | 311.1 ~ 318.9 | 3.76 (3.42) | 1.42 (1.08) |
| 13 | 318.9 ~ 326.7 | 3.82 (3.48) | 1.48 (1.14) |

FIG. 54

| RANK | 1 | 2 | 3 | 4 | 5 | 6 | 7 | 8 | 9 | 10 | 11 | 12 | 13 |
|---|---|---|---|---|---|---|---|---|---|---|---|---|---|
| R(Ω) | 225.3 ~ 233.1 | 233.1 ~ 240.9 | 240.9 ~ 248.7 | 248.7 ~ 256.5 | 256.5 ~ 264.3 | 264.3 ~ 272.1 | 272.1 ~ 279.9 | 279.9 ~ 287.7 | 287.7 ~ 295.5 | 295.5 ~ 303.3 | 303.3 ~ 311.1 | 311.1 ~ 318.9 | 318.9 ~ 326.7 |

INK JET RECORDING APPARATUS CONTROLLED BY PRESUMED TEMPERATURE AND METHOD THEREFOR

BACKGROUND OF THE INVENTION

1. Field of the Invention

This invention relates to an ink jet recording apparatus which performs various controls by presumed head temperature, more particularly, to ink jet recording apparatus in which stabilization of ink ejection and detection of unejection are done by means of presumed head temperature, and recording method herefor.

2. Related Background Art

Recording apparatus like printers, copying machines and facsimile terminal equipment are constructed to record images consisting of dot-patterns onto recording materials like plastic sheet.

Recording apparatus can be classified into ink-jet, wire-dot, thermal, laser-beam printers etc., according to the recording method.

The ink-jet printer (ink-jet recording apparatus) is constructed to apply ink drops coming from an opening in the recording head onto the recording material.

Recently, a large number of recording apparatus are used, and high-speed recording, high resolution, high-quality image, low noise are required for these recording apparatus. The ink-jet recording apparatus can be a recording apparatus that satisfies these requirements. As this ink-jet recording apparatus ejects ink from the recording head, stabilization of ink ejection and ejected ink quantity that is required to fulfill the above requirements are greatly influenced by the ink temperature at the ink ejection opening. If the ink temperature is too low, the viscosity of the ink will increase abnormally and the ink will not come out by normal ejecting energy; if the temperature is too high, the ejected ink quantity will increase and the ink will overflow on the recording paper, and it will lead to deterioration of printing quality.

Therefore, in the hitherto ink-jet recording apparatus a method of controlling the ink temperature at the ejection opening within a desired range using a temperature sensor mounted on the recording head, or a method of controlling the ejection recovery. As the heater for said temperature control, heating element mounted on the recording head is used, and in ink-jet recording apparatus in which the recording is done by forming flying liquid drops using heat energy, i.e. in such apparatus that eject ink drops by means of growing bubbles by ink film boiling, the ejection heater itself may be sometimes used for said purpose. By using said ejection heater it must be supplied with electric current to such an extent that no bubbling occurs. In recording apparatus in which ink drops are ejected by growing bubbles in solid or liquid ink by means of heat energy the ejection characteristics changes greatly depending on the recording head temperature, therefore temperature control of the ink and of the recording head that influences the ink temperature substantially is particularly important.

But when attempted to execute temperature control accurately by means of a temperature sensor mounted on the recording head, following problems can occur.

First, problem of the measurement error of the temperature sensor. In representative temperature sensor types such as thermistors and thermocouples, resistivity and electromotive force fluctuate according to the temperature. When detecting these fluctuating values, electric noises can occur, and it is extremely difficult to suppress these noises completely.

Secondly, there is the problem of the costs. In order to detect said temperature in addition to the thyristers and thermoelements amplifiers and antistatic components are needed; particularly the antistatic components lead to considerable increase of costs.

Particularly, in case of the recording apparatus having a exchangeable recording head, the recording head being a wear parts, the user detaches the head frequently from the recording apparatus. The power output of the temperature sensor goes from exchangeable recording head through the contact on the carriage, and through the flexible wiring unchanged to the circuit on the print circuit board in the main body. Therefore the temperature measurement circuit can easily be influenced by electrostatic noises, and when operating the ejection heater or temperature regulating heater noises occur under the influence of driving pulses or temperature regulating current, and therefore without considerable antistatic measures it is not possible to measure temperature exactly.

As for the temperature detection by temperature sensor, in order to avoid the detection error, a method is applied that the averaged value of the detected head temperatures detected several times in the past is used as the present temperature. But by averaging the several detected temperatures the dynamic temperature change at the recording head will be averaged, and time delay will occur between the real temperature and the detected value (bad response), it is not possible to conduct exact feedback control.

For these reasons, a method in which the temperature fluctuation is calculated from the energy supplied to the recording head within a time unit is suggested. However, this method has the following problems.

First, in this method the temperature fluctuation is calculated by accumulation of the hysterisis of the energy supplied to the recording head. Therefore between the real head temperature and the calculated head temperature error can occur. In recording apparatus equipped with a exchangeable recording head there is the problem of recording head difference. The recording heads mounted on the recording apparatus have various ejection quantities, heat radiation characteristics due to manufacturing errors, and different heat transfer rates because of the difference of elements (adhesive layer etc.). It is difficult to consider these differences into the calculation of the head temperature. As a result, between the real head temperature and the calculated head temperature error occurs.

The applicants suggest, in order to solve these problems, in the Japanese Patent Laid-Open Application Nos. 5-31906 (corresponding to U.S. Ser. No. 07/921,832, filed on Jul. 30, 1992), 5-31918 (corresponding to U.S. Ser. No. 07/921,932, filed on Jul. 30, 1992) and 5-64890 (corresponding to U.S. Ser. No. 07/852,671, filed on Mar. 17, 1992), to correct the temperature calculation using the detected temperature of the temperature detecting element in the recording head and a temperature presuming means.

In the Japanese Patent Laid-Open Application No. 5-31906 a high measuring precision is achieved by correcting the values (tables etc.) used for the calculation using the difference between the temperature detected by temperature detecting means on the recording head in a thermally stable state and the presumed calculated temperature. In the Japanese Patent Laid-Open Application No. 5-31918 the correction of the temperature detecting means is conducted by means of ambient temperature detecting means contained in the recording apparatus which operate at times at which recording is not done, or at times at which the temperature does not change. In the Japanese Patent Laid-Open Application No. 5-64890 the ratio of the temperature detected by the temperature detecting means to the calculated temperature is used to correct calculated temperature. These examples show methods to correct differences between individual temperature detecting means or differences of thermal time constants or thermal efficiencies at the time of ink-ejection between individual recording heads which are problems of exchangeable recording heads.

The temperature calculation method is to presume the temperature behavior (rising temperature) by presetting the degree of temperature by which the temperature of the object after rising by the supplied energy within a time unit by elapsing of each time unit falls, and by calculating the sum of the degree of the temperature at present to which temperature has fallen.

In the above methods it is desirable that throughput of the temperature presumption will be improved, and temperature calculation errors will be reduced.

In the recording head of an ink-jet recording apparatus it can occur that, if the head is left unused for a long time, particularly in the ink channel near the ejection opening, ink is not ejected normally because of increased ink viscosity. And, when ink ejection occurs continuously in such cases as recording with relatively high printing duty is performed, during the ejection fine bubbles can grow in the ink in the ink channels, and the bubbles remaining in the channels can influence the ejection, and as a result normal ejection will not be possible. Besides the above mentioned bubbles that grow in accordance with the ejection, at the joints in the ink supply lines can bubbles come into the ink.

The above mentioned unejection can not only reduce the reliability of recording apparatus but also damage the recording head itself and lead to a reduction of durability, because, when printing with high duty is performed by the recording head that cannot eject ink normally, the temperature at the recording head will rise considerably higher than in the case that the recording head is in the normal state.

As one of measures against these ejection failure resulting from varies causes, in ink-jet recording apparatus, the surface of the ejection opening on the recording head may be covered with a cap during no ink ejection to prevent the increase of ink viscosity. As an other means, in this capping state, from ejection opening, ink is sucked and ink with increased viscosity is discharged. As still another means, there is ejection recovery such as idle ejection in which ink is ejected into a certain ink sucking body consisting of ink absorber etc. to discharge high viscosity ink.

The ejection recovery of the above-mentioned means against the ejection failure is conducted automatically when the power was switched on, or during the recording at certain intervals, or by depressing the recovery button by the user whenever necessary.

But in ink-jet recording apparatus which performs the ejection recovery at the power-on, if the user switches power on and off frequently, the frequency of the ejection recovery can unnecessarily increase and ink consumption and the quantity of ink sucked from the ejection opening can increase. On the other side, in such recording apparatus types in which the user operates the recovery button according to his own decision, the user cannot know if the recording head is in the normal state or not, unless the printing is performed actually. Therefore these types are not sufficiently reliable at this point.

In the Japanese Patent Laid-Open Application No. 4-255361 filed by the present applicants a technic to decide if the recording head in a nonejecting state or not, according to the temperature rise at the recording head caused by idle ejection and the temperature fall occurring at the recording head after the idle ejection (these measures will be hereinafter referred to as "ink failure detection").

When power is switched on or after elapsing of a certain period of time after the switching on, failure detection is executed, and if the state of the recording head is decided as "ink failure detection", the ejection recovery is performed. By these measures unnecessary ejection recovery can be avoided, and ink consumption and waste ink can be reduced.

However, in this method, it takes a certain time to detect the unejection, and it was necessary to consume a considerable amount of ink. In case the detection of the unejection is performed after the power is switched on, if the head comes to the state of unejection for some reason, and if the user does not notice it, the recording apparatus would continue the printing operation, and the apparatus would be damaged by excessive rise of the recording head temperature.

Particularly, for example, if an ink-jet recording apparatus in which the recording head is supplied from an ink cartridge with ink, and when the ink cartridge has become empty the user replace it by a new one, does not have function of detecting the emptiness of the ink cartridge, the recording head will not be supplied with ink, and it would become the state of unejection. Every time this situation occurs, the recording head will be in danger by excessive temperature rise.

SUMMARY OF THE INVENTION

An object of the present invention is to provide an ink-jet recording apparatus in which the temperature on the recording head can be presumed with high precision, and to provide a recording method hereto.

Another object of the invention is to provide an ink-jet recording apparatus in which stabilization control of ink ejection and detection of unejection can be performed very accurately and to provide a recording method hereto.

Still another object of the invention is to provide an ink-jet recording apparatus in which the durability and reliability of the recording head can be improved, and to provide a recording method hereto.

Still another object is to provide an ink-jet recording apparatus in which information such as the characteristics of various recording heads can be measured exactly, and very accurate control will be achieved, and the startup time after the switching on power will be shortened, and to provide a recording method hereto.

It is also an object of this invention to avoid wasting ink by optimizing the recovery operation at the time when power is switched on, and to maintain reliability.

A further object is to avoid ejection without ink by detecting the normal ejection very accurately.

To accomplish the objects described above, one aspect of the present invention provides an ink jet recording apparatus including: a recording head for performing print recording by ejecting ink from an ejection orifice by thermal energy; temperature sensors provided in the recording head; a temperature calculation means for calculating a temperature change of the recording head in a unit time as a discrete value on the basis of the supply of energy input to the recording head, and for calculating the temperature change of the recording head by accumulating the discrete value in the unit time; a temperature presuming means for presuming a head temperature by both a calculated value of the temperature change and an adopted base value of the head temperature; a detection means for detecting a difference between the head presumed temperature and a detected temperature sensed by the temperature sensors; an update means for updating the adopted base value of the head temperature by the difference; and a control means for controlling ejection of the ink to be stabilized in accordance with the head presumed temperature.

In another aspect of the present invention, an ink jet recording apparatus includes a recording head for performing print recording by ejecting ink from an ejection orifice by thermal energy; temperature sensors provided in the recording head; a temperature calculation means for calculating a temperature change of the recording head in a unit time as a discrete value on the basis of the supply of energy input to the recording head, and for calculating the temperature change of the recording head by accumulating the discrete value in the unit time; a temperature presuming means for presuming a head temperature by both a calculated value of the temperature change and an initial value of the head temperature; a detection means for detecting a difference between the head presumed temperature and a detected temperature sensed by the temperature sensors; an operation means for operating the temperature calculation means by the difference; and a control means for controlling ejection of the ink to be stabilized in accordance with the head presumed temperature.

According to yet another aspect of the present invention, an ink jet recording apparatus which performs a print recording by ejecting ink from a recording head to a recorded medium, the apparatus including a head temperature monitoring means for monitoring a temperature of the recording head; a head temperature presuming means for presuming the head temperature by energy input to the head; an unejection deciding means for deciding as to whether the recording head is in an unejection state by using temperature data obtained from the monitoring means and the presuming means.

Still another aspect of the present invention is to provide a method of recording print for an ink jet recording apparatus, which performs a print recording by ejecting ink from a plurality of recording heads to a recorded medium, the method including the step of: deciding as to whether each recording head is in an unejection state; preventing the recording heads decided to be in an unejection state from driving; and performing the print by only using the recording heads other than those in an unejection state.

In other aspect of the present invention, a method of recording print for an ink jet recording apparatus, which performs a print recording by ejecting ink from a plurality of recording heads to a recorded medium, includes the step of: deciding as to whether each recording heads is in an unejection state; preventing the recording heads decided to be in an unejection state from temperature control; and performing the temperature control by only using the recording heads other than those in an unejection state.

According to other aspect of the present invention, a method of recording print for an ink jet recording apparatus, which performs a print recording by ejecting ink from a plurality of recording heads to a recorded medium, includes the step of: deciding as to whether each recording head is in an unejection state; eliminating print data with respect to the recording heads decided to be in an unejection state; and enabling to perform the print by only using the print data with respect to the recording heads other than those in an unejection state.

According to other aspect of the present invention, a method of recording print for an ink jet recording apparatus, which performs a print recording by ejecting ink from a recording head to a recorded medium, further includes the step of: performing a direct unejection decision for leading to a final decision of unejection of the recording head; and performing an unejection dicision different from the direct unejection decision.

In the present invention, two different switch-on mechanisms are provided: receptacle switch-on (hardware switch-on) and software switch-on. When hardware switch-on is done, the head characteristics are measured, and after the software is switched on after the hardware switch-on, the unejection detection is performed.

Further, recording head temperature measurement means, recording head temperature presuming means, correction means which proximates calculated value to measured value, and unejection deciding means to decide unejection of the recording head from the measured temperature and calculated temperature.

BRIEF DESCRIPTION OF THE DRAWINGS

FIG. 6 is a calculation table of short-range elements of the ejection heater in the calculation of the recording head temperature according to the embodiment 1.

FIG. 7 is a calculation table of long-range elements of the ejection heater in the calculation of the recording head temperature according to the embodiment 1.

FIG. 8 is a calculation table of short-range elements of the sub-heater in the calculation of the recording head temperature according to the embodiment 1.

FIG. 9 is a calculation table of long-range elements of the sub-heater in the calculation of the recording head temperature according to the embodiment 1.

FIG. 22 is a table showing necessary calculation time interval and data hold time.

FIG. 23 is a table of target temperatures applied for the embodiment 9.

FIG. 28 is a PWM table showing pulse width corresponding temperature differences between the target temperature and the head temperature.

FIGS. 29A and 20B are diagrams in which recording head temperature presumed by head temperature calculation means and measured head temperature are compared.

FIGS. 49A and 49B are tables to be used for determining a width of PWM driving pulse.

FIG. 50 is a block diagram showing the basic wave forms corresponding to the head ranks.

FIG. 54 is a drawing showing the correspondence between the resistance of dummy resistors and the head ranks.

DETAILED DESCRIPTION OF THE PREFERRED EMBODIMENTS

Figure 1:
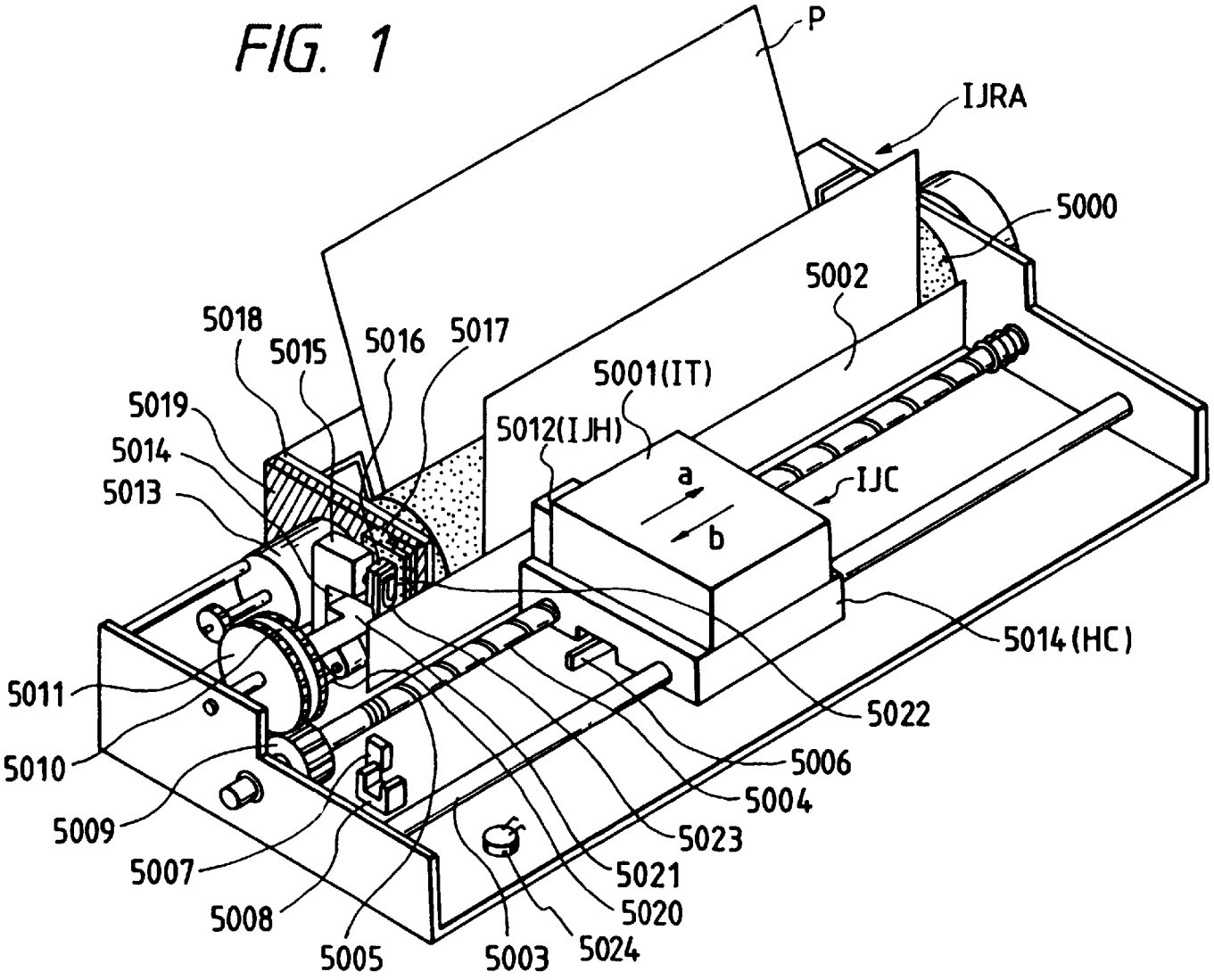
FIG. 1 is a perspective view of the ink-jet recording apparatus according to the embodiment 1 of the present invention.
Figure 2:
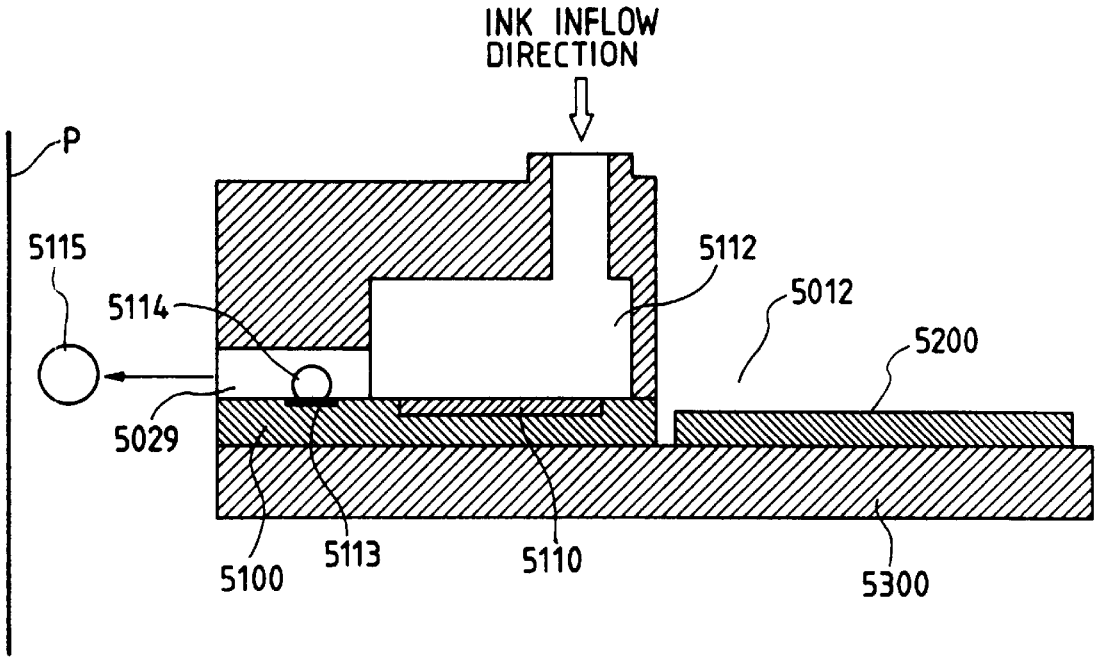
FIG. 2 is a cross section of the cartridge shown in FIG. 1.

[1] An arrangement of a recording head in a preferable ink jet recording apparatus (IJRA) which can adopt this embodiment will be described below together with an operation of the recording head. Referring to a perspective view of FIG. 1, the operation of the recording apparatus will be briefly described. In FIG. 1, a recording head (IJH) 5012 is coupled to an ink tank (IT) 5001. As shown in FIG. 2, the ink tank 5001 and the recording head 5012 form an exchangeable integrated cartridge (IJC). A carriage (HC) 5014 is used for mounting the cartridge (IJC) to a printer main body. A guide 5003 scans the carriage in the sub-scan direction.

A platen roller 5000 scans a print medium P in the main scan direction. A temperature sensor 5024 measures the surrounding temperature in the apparatus. The carriage 5014 is connected to a printed board (not shown) comprising an electrical circuit (the temperature sensor 5024, and the like) for controlling the printer through a flexible cable (not shown) for supplying a signal pulse current and a head temperature control current which drive the recording head 5012 and a detected signal current given from a temperature detecting member.

The details of the ink jet recording apparatus IJRA with the above arrangement will be described below. In the recording apparatus IJRA, the carriage HC has a pin (not shown) to be engaged with a spiral groove 5004 of a lead screw 5005, which is rotated through driving power transmission gears 5011 and 5009 in cooperation with the normal/reverse rotation of a driving motor 5013. The carriage HC can be reciprocally moved in directions of arrows a and b. A paper pressing plate 5002 presses a paper sheet against the platen roller 5000 across the carriage moving direction. Photocouplers 5007 and 5008 serve as home position detection means for detecting the presence of a lever 5006 of the carriage HC in a corresponding region, and switching the rotating direction of the motor 5013. A member 5016 supports a cap member 5022 for capping the front surface of the recording head. A suction means 5015 draws the interior of the cap member by vacuum suction, and performs a suction recovery process of the recording head 5012 through an opening 5023 in the cap member.

A cleaning blade 5017 is supported by a member 5019 to be movable in the back-and-forth direction. The cleaning blade 5017 and the member 5019 are supported on a main body support plate 5018. The blade is not limited to this shape, and a known cleaning blade can be applied to this embodiment, as a matter of course. A lever 5012 is used for starting the suction operation in the suction recovery process, and is moved upon movement of a cam 5020 to be engaged with the carriage HC. The movement control of the lever 5021 is made by a known transmission means such as a clutch switching means for transmitting the driving force from the driving motor.

The capping, cleaning, and suction recovery processes can be performed at corresponding positions upon operation of the lead screw 5005 when the carriage HC reaches a home position region. This embodiment is not limited to this as long as desired operations are performed at known timings.

FIG. 2 shows the details of the recording head 5012. A heater board 5100 formed by a semiconductor manufacturing process is arranged on the upper surface of a support member 5300. A temperature control heater (temperature rise heater) 5110, formed by the same semiconductor manufacturing process, for keeping and controlling the temperature of the recording head 5012, is arranged on the heater board 5100. A wiring board 5200 is arranged on the support member 5300, and is connected to the temperature control heater 5110 and ejection (main) heaters 5113 through, e.g., bonding wires (not shown). The temperature control heater 5110 may be realized by adhering a heater member formed in a process different from that of the heater board 5100 to, e.g., the support member 5300.

A bubble 5114 is produced by heating an ink by the corresponding ejection heater 5113. An ink droplet 5115 is ejected from the corresponding nozzle portion 5029. The ink to be ejected flows from a common ink chamber 5112 into the recording head.

Figure 3:
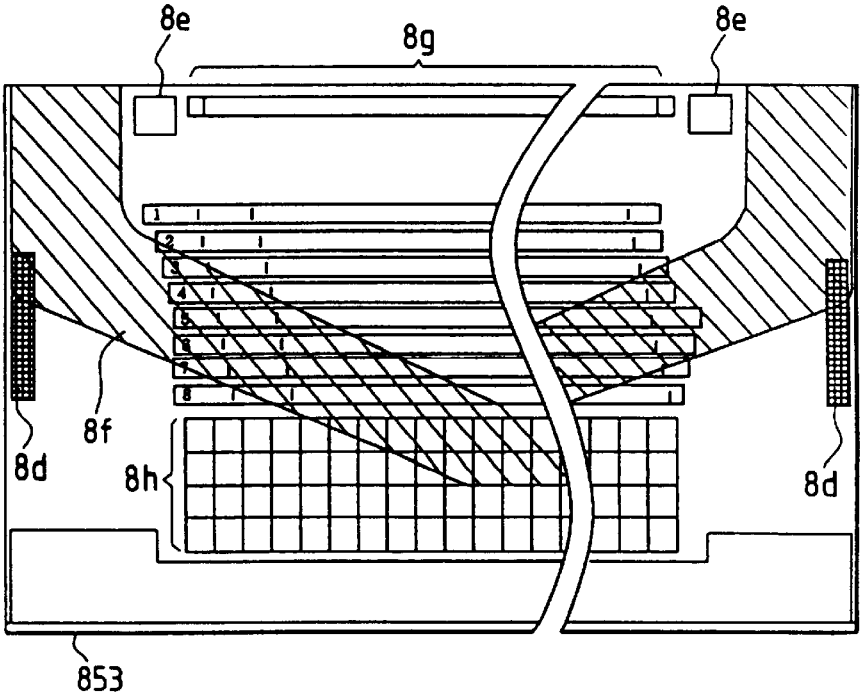
FIG. 3 is a partial enlarged view of the head cartridge shown in FIG. 1.

FIG. 3 shows a preferred heater board of the recording head which can adopt this embodiment. Temperature sensors, temperature control heaters and ejection heaters are arranged on the heater board. FIG. 3 is a schematic top plan view of the heater board. Temperature control (sub) heaters 8*d*, an ejection portion line 8*g* on which ejection (main) heaters 8*c* is arranged, driving elements 8*h* and temperature sensors 8*e* are formed on the same board with the arrangement as shown in FIG. 3. A pair of temperature sensors 8*e* are arranged on the Si board 853, respectively on the right and left sides of the line where a plurality of the ejection heaters 8*c* are arranged. A mean value of temperatures detected by the two temperature sensors 8*e* is adopted as a detected temperature. By arranging each element on the same board, detection or control of a head temperature can be performed, and further, a compact head and a simplified manufacturing process of the recording head can be obtained. The sectional position of an outer surface wall of a top plate, which is separated into two areas, i.e., an area in which the heater board is filled with ink and another one in which the heater board is not filled with ink, is also shown in FIG. 3.

[2] Next, a head temperature presuming means which can adopt this embodiment will be described below. The head temperature presuming means according to this embodiment presumes the temperature of the recording head by connecting the temperature sensors, which senses the surrounding temperature in the apparatus, to the main body, detecting a change of the recording head in response to the surrounding temperature using calculation processing described below.

In the present invention, the head temperature is presumed basically by using the following heat conduction formulas:

In heating:

$$\Delta temp = a\{1 - exp[-m*T]\} \quad (1)$$

In cooling started during heating:

$$\Delta temp = a\{exp[-m(T-T1)] - exp[-m*T]\} \quad (2)$$

where temp; increased temperature of object
a; equilibrium temperature of object by heat source
T; elapse time
m; thermal time constant of object
T1; time for which heat source is removed When the recording head is processed as a lumped constant system, the chip temperature of the recording head can be theoretically presumed by calculating the formulas (1) and (2) according to the print duty in correspondence with a plurality of thermal time constants.

However, in general, it is difficult to perform the above-mentioned calculations without modifications in terms of a problem of the processing speed.

Strictly speaking, all the constituting members have different time constant, and another time constant is formed between adjacent members, resulting in a huge number of times of calculations.

In general, since an MPU cannot directly perform exponential calculations, approximate calculations must be performed, or calculations using a conversion table must be performed, thus disturbing a decrease in calculation time.

This embodiment solves the above-mentioned problems by the following modeling and calculation algorithm.

Modeling

Figure 4:
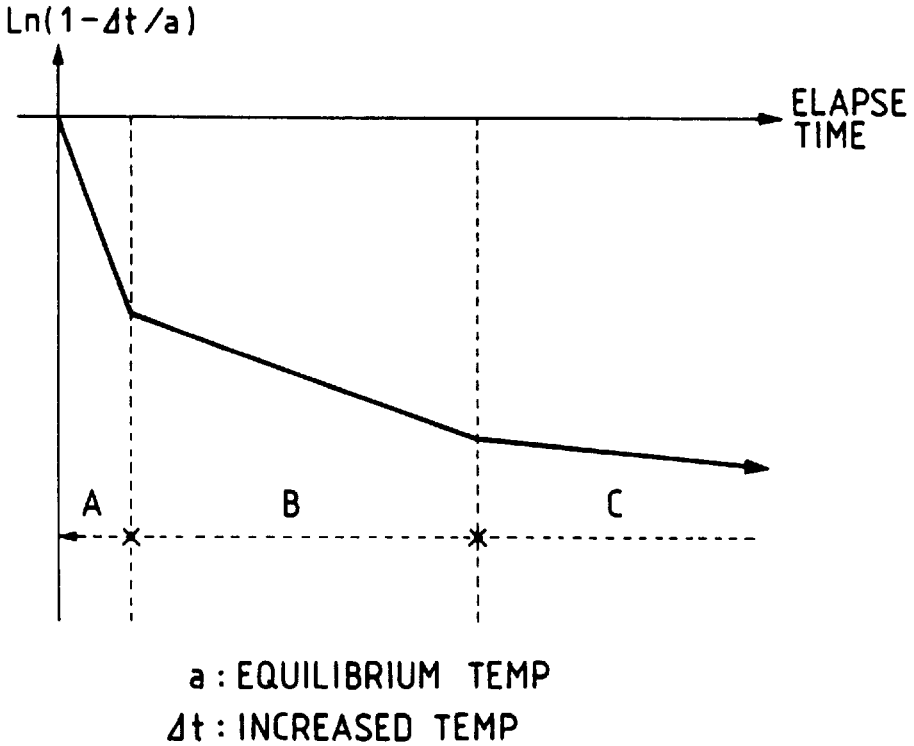
FIG. 4 is a diagram showing temperature rise characteristics of the recording head in the calculation of the recording head temperature according to the embodiment 1.

The present inventors sampled data in the temperature rise process of the recording head by applying energy to the recording head with the above arrangement, and obtained the result shown in FIG. 4. Strictly speaking, the recording head with the above arrangement is constituted by combining many members having different heat conduction times. However, FIG. 4 reveals that such many heat conduction times can be processed as a heat conduction time of a single member in practice in ranges where the differential value of the function of the log-converted increased temperature data and the elapse time is constant (i.e., ranges A, B, and C having constant inclinations).

From the above-mentioned result, in a model associated with heat conduction, this embodiment processes the recording head using two thermal time constants. Note that the above-mentioned result indicates that feedback control can be more precisely performed upon modeling having three thermal time constants. However, in this embodiment, it is determined that the inclinations in areas B and C in FIG. 4 are almost equal to each other, and the recording head is modeled using two thermal time constants in consideration of calculation efficiency. More specifically, one heat conduction is a model having a time constant at which the temperature is increased to the equilibrium temperature in 0.8 sec. (corresponding to the area A in FIG. 4), and the other heat conduction is given by a model having a time constant at which the temperature is increased to the equilibrium temperature in 512 sec. (i.e., a model of the areas B and C in FIG. 4).

Furthermore, this embodiment processes the recording head as follows to obtain a model.

The temperature distribution in heat conduction is assumed to be ignored, and entire recording head is processed as a lumped constant system.

A heat source assumed to include two heat sources, i.e., a heat source for the print operation, and a heat source as sub-heaters.

Figure 5:
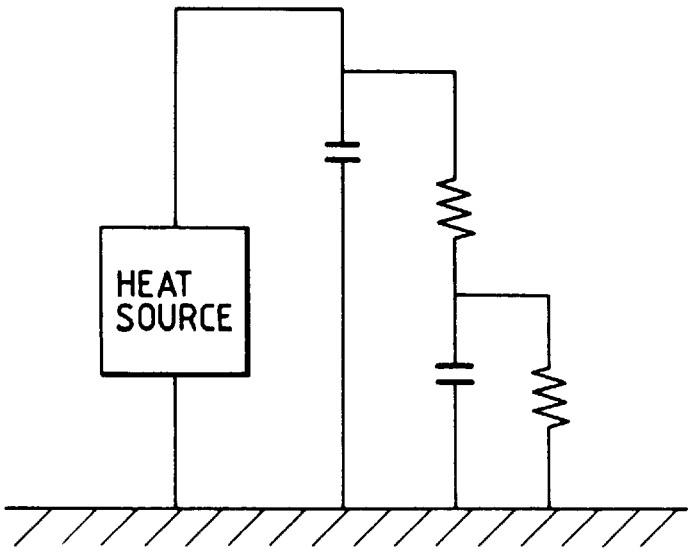
FIG. 5 is an equivalent circuit of the heat transfer of the modelled recording head in the calculation of the recording head temperature according to the embodiment 1.

FIG. 5 shows a heat conduction equivalent circuit modeled in this embodiment. FIG. 5 illustrates only one heat source. However, when two heat sources are used, they may be connected in series with each other.

Calculation Algorithm

In the head temperature calculations of this embodiment, the above-mentioned heat conduction formulas are developed as follows.

<Change in temperature after elapse of nt time after heat source is ON>

$$a\{1-\exp[-m*n*t]\}a \quad \text{<1>}$$

$$\{\exp[-m*t]-\exp[-m*t]+\exp[-2*m*t]-\exp[-2*m*t]+\ldots+\exp[-(n-1)*m*t]-\exp[-(n-1)*m*t]+1-\exp[-n*m*t]\}=$$

$$a\{1-\exp[m*t]\}+a\{\exp[-m*t]-\exp[-2*m*t]\}+a\{\exp[-2*m*t]-\exp[-3*m*t]\}\ldots+a\{\exp[-(n-1)*m*t]-\exp[-n*m*t]\}$$

$$=a\{1-\exp[-mt]\}+ \quad \text{<2-1>}$$

$$a\{\exp[-m*(2t-t)]-\exp[-m*2t]\}+ \quad \text{<2-2>}$$

$$a\{\exp[-m*(3t-t)]-\exp[-m*3t]\}+ \quad \text{<2-3>}$$

$$\ldots+$$

$$a\{\exp[-m*(nt-t)]-\exp[-m*nt]\} \quad \text{<2-n>}$$

Since the above-mentioned formulas are developed as described above, the formula <1> coincides with <2-1> + <2-2> + <2-3> + … + <2-n>.

Formula <2-n>: equal to the temperature of the object at time nt when heating is performed from time 0 to time nt, and the heat source is kept OFF from time t to time nt.

Formula <2-3>: equal to the temperature of the object at time nt when heating is performed from time (n−3)t to time (n−2)t, and the heat source is kept OFF from time (n−2)t to time nt.

Formula <2-2>: equal to the temperature of the object at time nt when heating is performed from time (n−2)t to time (n−1)t, and the heat source is kept OFF from time (n−1)t to time nt.

Formula <2-1>: equal to the temperature of the object at time nt when heating is performed from time (n−1)t to time nt.

The fact that the total of the above formulas are equal to the formula <1> has the following meaning. That is, a change in temperature (increase in temperature) of the object 1 is calculated by obtaining a decreased temperature after an elapse of unit time from a temperature increased by energy supplied in unit time (corresponding to each of the formulas <2-1>, <2-2>, . . . , <2-n>), and a total sum of decreased temperatures at the present time from temperatures increased in respective past unit times is calculated to presume the current temperature of the object 1 (<2-1>+<2-2>+ . . . <2-n>).

In this embodiment, the chip temperature of the recording head is calculated (heat source*thermal time constant 2) four times based on the above-mentioned modeling. The required calculation times and data hold times for the four calculations are as shown in FIG. 22. FIGS. 6 to 9 show calculation tables used for calculating the head temperature, and each comprising a two-dimensional matrix of input energy and elapse time. FIG. 6 shows a calculation table when ejection heaters are used as the heat source, and a member group having a short-range time constant is used; FIG. 7 shows a calculation table when ejection heaters are used as the heat source, and a member group having a long-range time constant is used; FIG. 8 shows a calculation table when sub-heaters are used as the heat source, and a member group having a short-range time constant is used; and FIG. 9 shows a calculation table when sub-heaters are used as the heat source, and a member group having a long-range time constant is used.

As shown in FIGS. 6 to 9, calculations are performed at 0.05-sec intervals to obtain:

(1) an increase (in degrees) in temperature of a member having a time constant represented by the short range upon driving of the ejection heaters (ΔTmh);

(2) an increase (in degrees) in temperature of a member having a time constant represented by the short range upon driving of the sub-heaters (ΔTsh);

calculations are performed at 1.0-sec intervals to obtain:

(3) an increase (in degrees) in temperature of a member having a time constant represented by the long range upon driving of the ejection heaters (ΔTmb); and (4) an increase (in degrees) in temperature of a member having a time constant represented by the long range upon driving of the sub-heaters (ΔTsb).

The above-mentioned calculations are sequentially performed, and ΔTmh, ΔTsh, ΔTmb, and ΔTsb are added to each other (=ΔTmh+ΔTsh+ΔTmb+ΔTsb), thus calculating the head temperature at that time.

As described above, since the recording head constituted by combining a plurality of members having different heat conduction times is modeled to be substituted with a smaller number of thermal time constants than that in practice, the following effects can be obtained.

As compared to a case wherein calculation processing is faithfully performed in units of all the members having different heat conduction times, and in units of thermal time constants between adjacent members, the calculation processing volume can be greatly decreased without impairing calculation precision so much.

Since the head is modeled with reference to time constants, calculation processing can be performed in a small number of processing operations without impairing calculation precision. For example, in the above-mentioned case, when the head is not modeled in units of time constants, the calculation interval requires 50 msec since it is determined by the area A having a small time constant. On the other hand, the data hold time of discrete data requires 512 sec since it is decided by the areas B and C having a large time constant. More specifically, accumulation calculation processing of 10,240 data for last 512 sec must be performed at 50-msec intervals, resulting in the number of calculation processing operations several hundreds of times that of this embodiment.

As described above, the temperature calculation algorithm processes temperature shift of the recording head as an accumulation of discrete values in an unit time, calculates the temperature shift in advance based on the corresponding discrete values within a range of energy which can be input, and tables the calculation result using the table constituted by a two-dimensional matrix of input energy and elapse time. The recording head constituted by combining a plurality of members having different heat conduction times is modeled to be substituted with a smaller number of thermal time constants than that in practice, and calculations are performed while grouping required calculation intervals and required data hold times in units of model units (thermal time constants). Furthermore, a plurality of heat source are set, temperature rise widths are calculated in units of model units for each heat source, and the calculated widths are added later to calculate the head temperature (plural heat source calculation algorithm), thus calculating entire temperature shift of the recording head upon calculation processing in an economical recording apparatus without providing a temperature sensor in the recording head.

[3] Head Temperature Monitoring Means

As an example for a head temperature monitoring means, this embodiment monitors the head temperature by the head temperature sensors 8*e* on the HB board shown in FIG. 3. When a noise level is high, processing operations for reducing the noise can be performed by, e.g., collecting outputs of the temperature sensors plural times and calculating the mean value of the recording head.

[4] Unejection Deciding Means

This embodiment decides whether or not the recording head is in an unejection state according to the recording head temperature and the presumed temperature of the recording head obtained by using a presuming calculation. The condition of decision is as follows:

$$(\textit{recording head temperature})-(\textit{presumed temperature})>\Delta Tth$$

where, ΔTth is set as large as an error decision can not be produced by noise signals, but as small as the decision can be immediately obtained when unejection has produced.

Figure 10A:
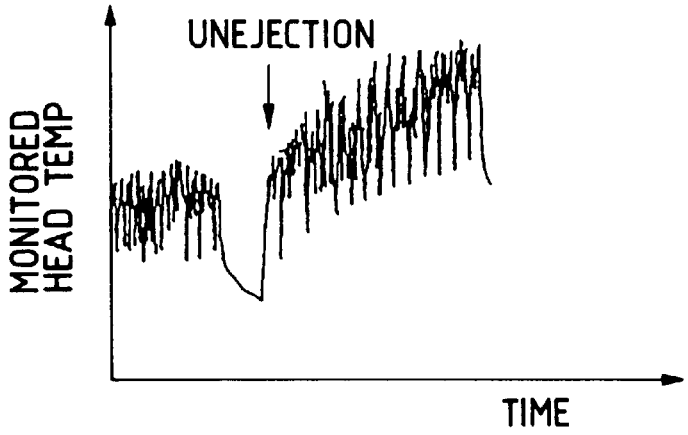
FIGS. 10A to 10C are the first diagrams to explain the unejection deciding means in the embodiment 1.
Figure 10B:
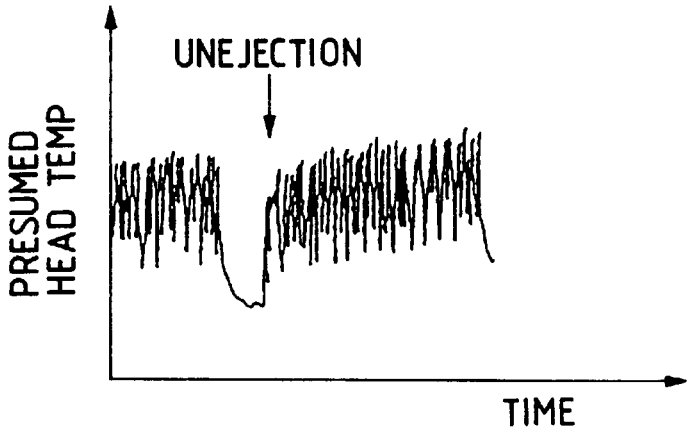
Figure 10C:
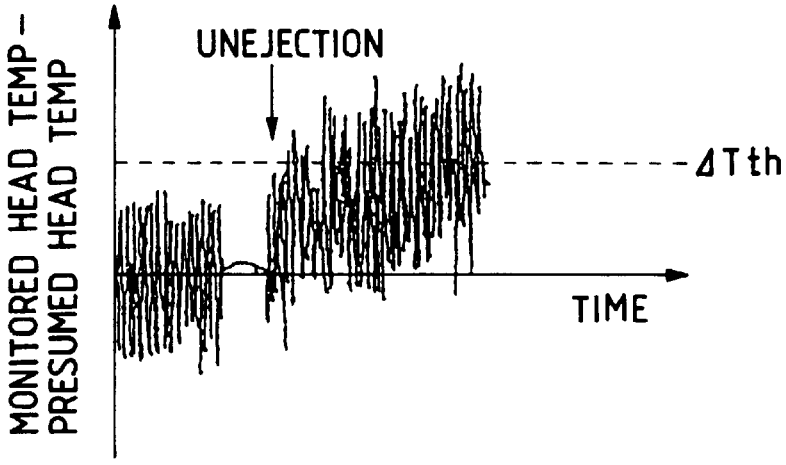

FIGS. 10A to 10C are graphs each showing a monitored recording head temperature (the mean value of four times), a presumed calculation value of the recording head and a value obtained by subtracting the presumed calculation value from the recording head temperature (hereinbelow, the value subtracting the presumed calculation value from the recording head temperature is called as ΔT). ΔT is over ΔTth as soon as unejection occurs, at this point, abnormal ejection is decided. The decision of whether the recording head is in an unejection state is performed in a constant time interval.

When the abnormal ejection is decided, for example, ejection recovery processes may be performed immediately. In this embodiment, taking into consideration that the abnormal ejection is decided by unexpected noises which uncommonly enter from the exterior of the recording apparatus, the following decision can be also performed. That is, the decision of whether or not the recording head is in an unejection state is certainly performed by measuring temperature change quantities in both temperature rise and temperature reduction according to idle ejection as described in the background of the invention in the specification.

Figure 11A:
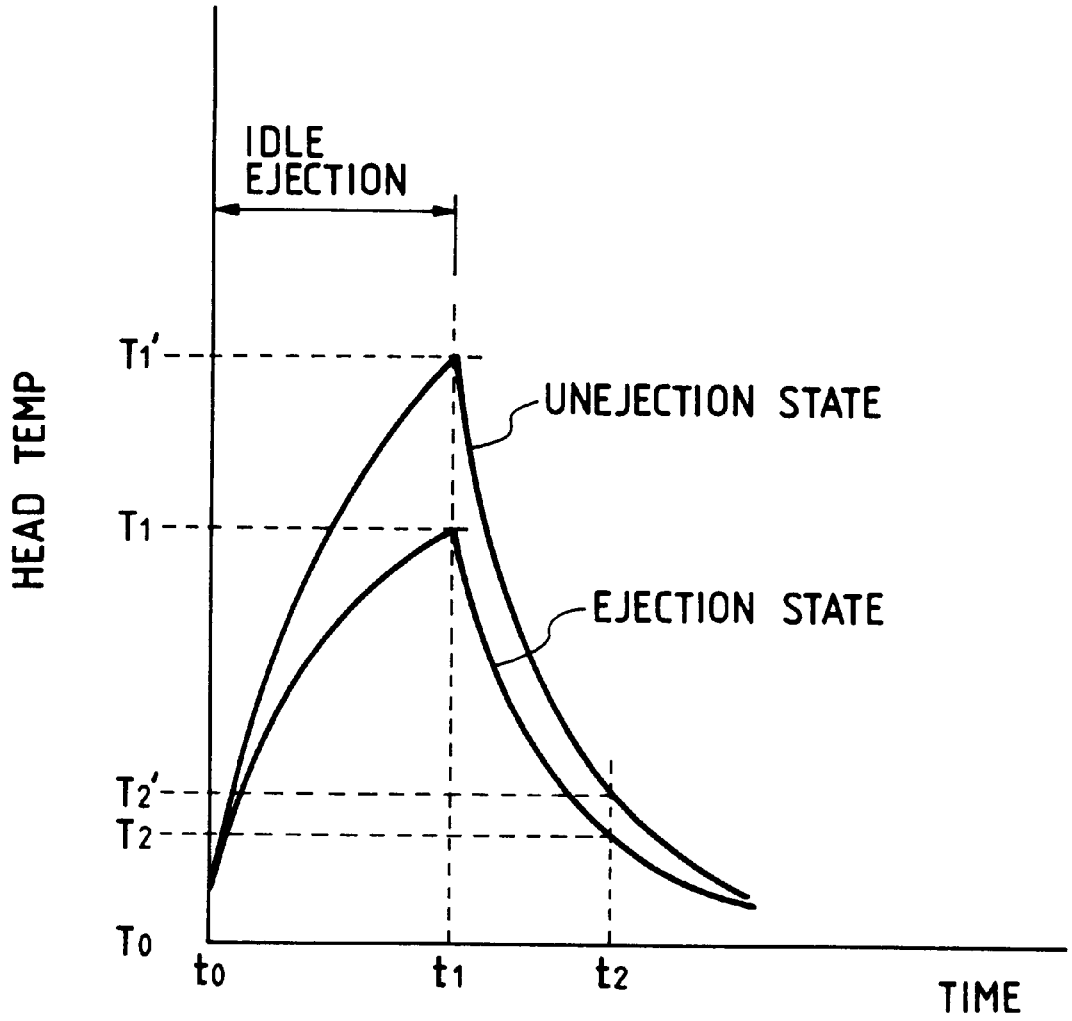
FIGS. 11A and 11B are the second diagrams to explain the unejection deciding means in the embodiment 1.
Figure 11B:
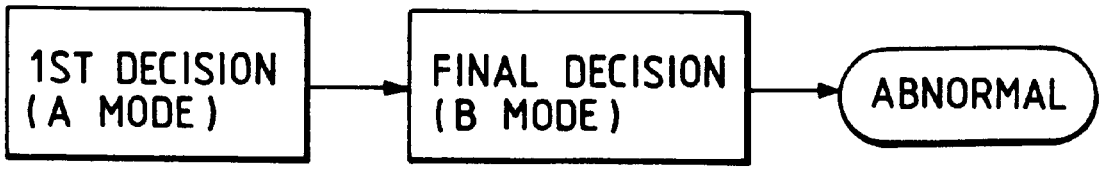

Referring to FIGS. 11A and 11B, the further details of this embodiment will be described. As shown in FIG. 11A, temperature rise (T1−T0) of the recording head during ejection in a predetermined time (t1−t0) and temperature reduction (T1−T2) of the recording head during unejection in a predetermined time (t2−t1) after the elapse of the time (t1−t0) are detected, if a total sum of these temperatures (T1−T0)+(T1−T2)=(2T131 T0−T2) is over a predetermined value Tth, the recording head is decided to be in an unejection state.

Figure 12:
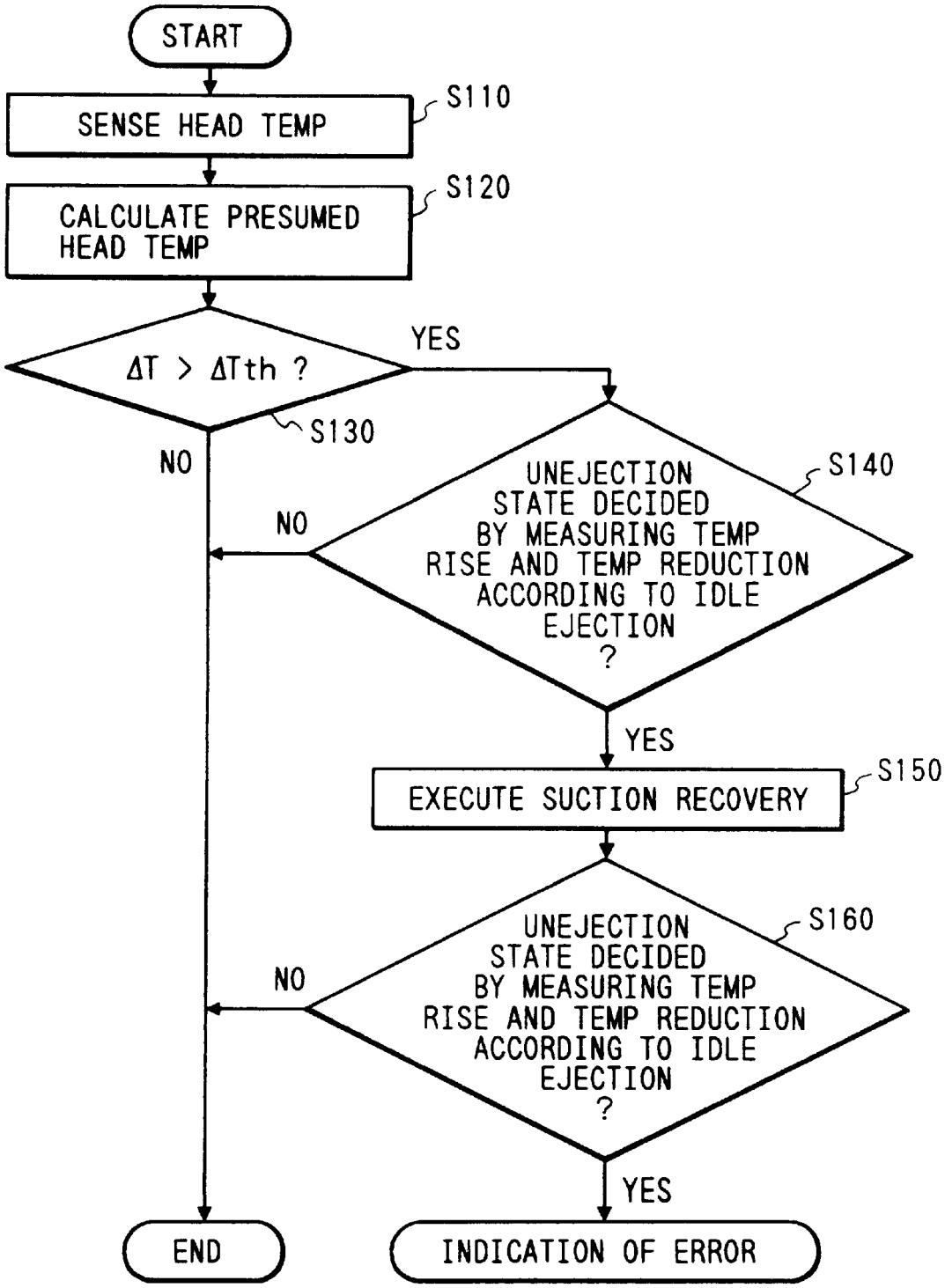
FIG. 12 is a flowchart to explain the unejection deciding means in the embodiment 1.

FIG. 12 is a flow chart of the decision of unejection. A head temperature is sensed by sensors at step S110, a presumed value of the head temperature is calculated at step S120 and ΔT and ΔTth are compared with each other at step S130 (first decision A mode shown in FIG. 11B). Even if an unejection state is decided, for performing further certain decision, the unejection state is decided again by measuring temperature rise and temperature reduction at step S140 (final decision B mode shown in FIG. 11B).

In this embodiment, the unejection state is decided by using differences in temperature of both temperature rise and temperature reduction as shown above, thus certainly detecting unejection even if the recording head is slightly in a temperature reduction state. If the unejection state of the recording head is decided only when the recording head has few temperature changes, it can be decided by using only one difference in temperature of either temperature rise or temperature reduction.

When the recording head is decided to be in the unejection state at step S140, suction recovery processes are performed at step S150. After that, the recording head is decided again to be in the unejection state by measuring temperature change quantities in both temperature rise and temperature reduction according to idle ejection, checking whether or not the recording head has returned in a normal state. If it is in a normal state, ejection recovery processes are completed. However, if it is in the unejection state in spite of suction recovery processes being done, error indication is performed to alarm to a user.

In the method for detecting unejection according to this embodiment, when the print duty is low, temperature rise of the recording head naturally becomes small. However, even when the unejection state is not detected in spite of the recording head being in the unejection state, the recording head is protected from excessive temperature rise produced by unejection, so that one object of the present invention can be achieved. In addition, examples considering the case that the print duty is low will be described from the third embodiment below.

(Second Embodiment)

In the embodiment 2 ΔTth used for deciding the unejection can be changed according to the state of the recording apparatus. The head temperature presumption means and the head temperature monitoring means are the same as in the embodiment 1.

[1] Explanation of the Recording Apparatus Used in the Embodiment 2

Figure 13:
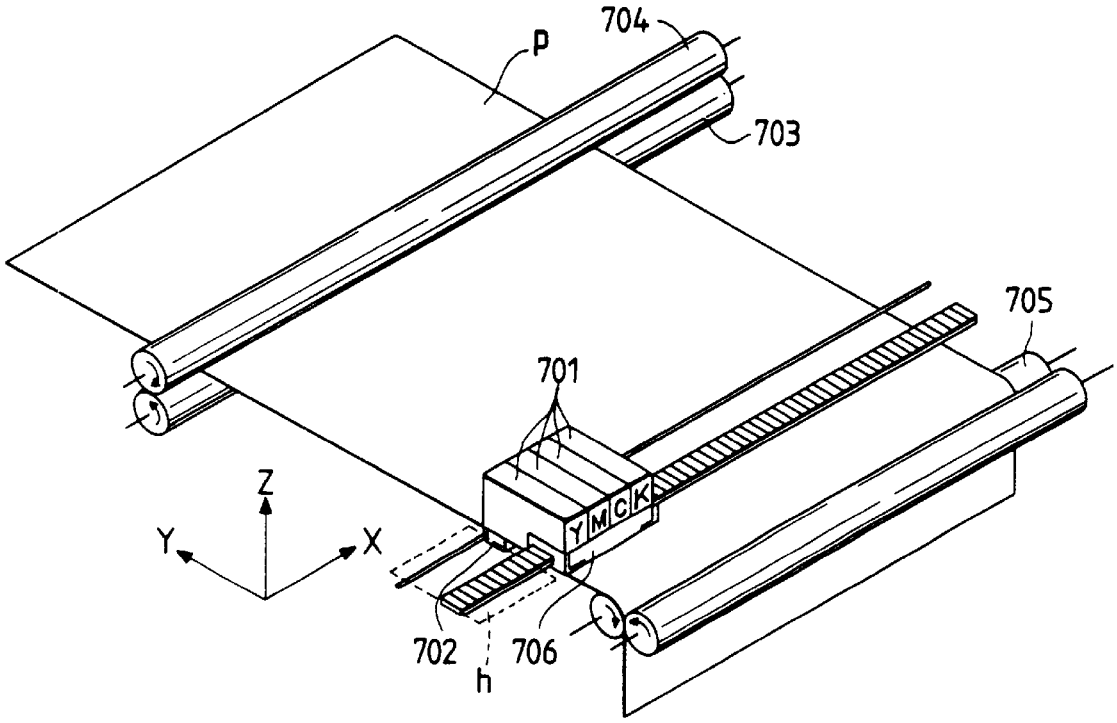
FIG. 13 is a schematic explanatory drawing of the ink-jet recording apparatus according to the embodiment 2.
Figure 14:
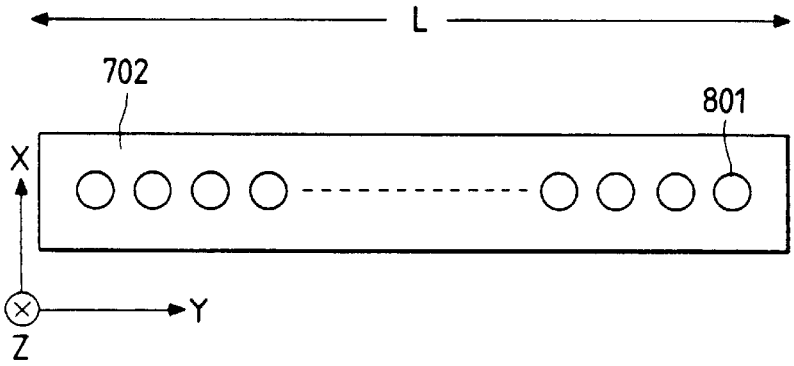
FIG. 14 is a partial explanatory drawing of the recording head used in the embodiment 2.

FIG. 13 shows the construction of the recording part of the ink-jet recording apparatus used in the embodiment 2. In this Figure, 701 indicates the ink cartridges. These consist of ink tanks filled with color inks—black, cyan, magenta and yellow—and a multi-head 702. In FIG. 14 multi-nozzles arranged on the multi-head are shown from the z-direction. 801 indicates the multi-nozzles arranged on the multi-head 702. We shall go back to FIG. 13. 703 indicates a paper transport roller which rotates in the arrow direction depressing the printing paper together with the axially roller 704, and transports the printing paper in the y-direction. 705 indicates a paper feed roller which feeds the printing paper and depresses the printing paper like 703 and 704. 706 is a carriage that supports and moves the 4 ink cartridges. This stays at the home position (h) indicated by dotted lines while the printing is not performed, or while the recovery procedure for the multi-head is being performed.

Before the printing is started, the carriage (706) which is standing at the position indicated in the drawing (home position) moves in the x direction, and performs the printing for the width L on the paper by n multi-nozzles of the multi-head (702). When the printing of the data to the end of the paper has been completed, the carriage returns to the home portion, and performs the printing in the x-direction again. By repeating the printing for the width L of the multi-head at each scanning of the carriage and the paper transport, the data printing on a sheet of paper is completed.

But when the recording apparatus is not used as a monochrome printer for printing only characters, but is to be used to print images, various factors such as color development, tone, uniformity must be taken into consideration. Particularly as for the uniformity, slight differences of the nozzles caused in fabrication thereof can influence ink ejection quantity and ejection direction and deteriorate printing quality with uniformity in density.

Figure 15C:
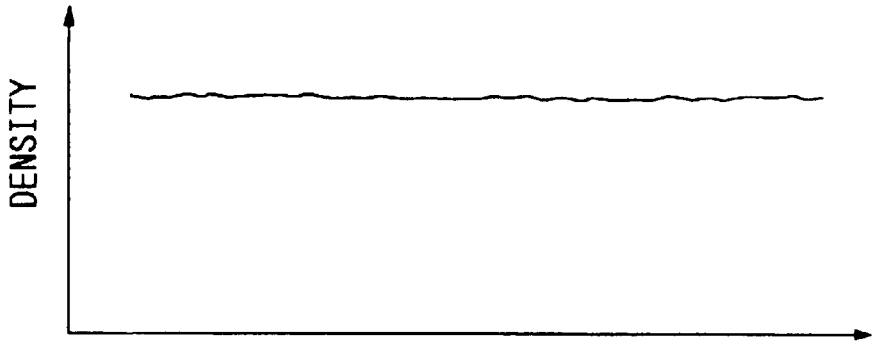
FIGS. 15A to 15C are ideal printouts printed by an ink-jet recording apparatus.
Figure 15B:
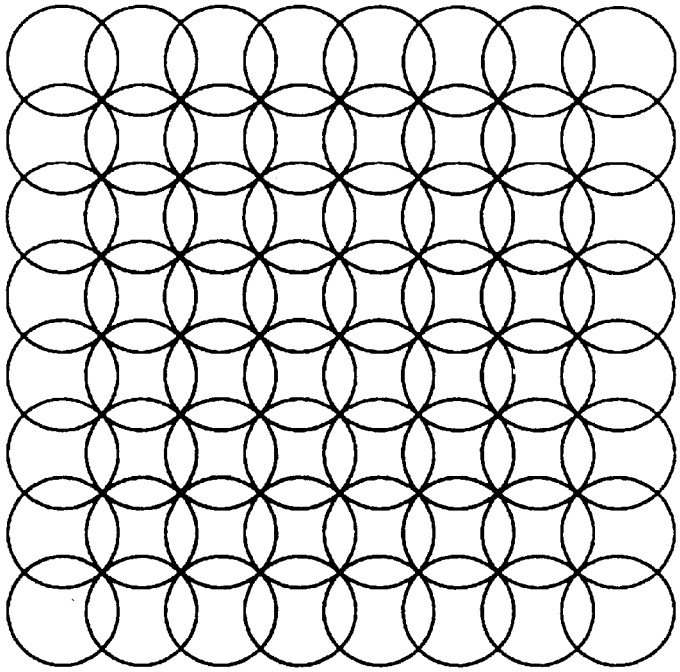
Figure 15A:
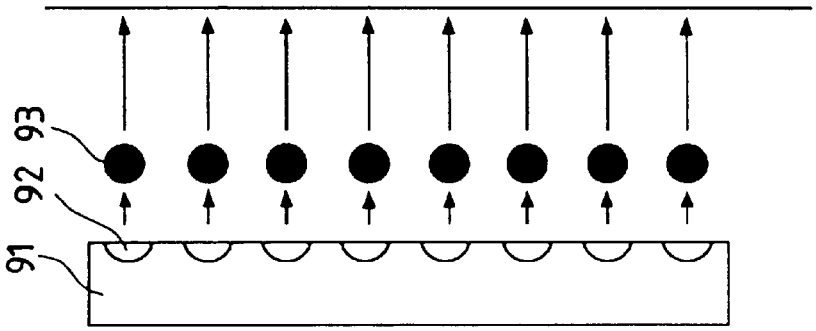

Concrete examples of ununiformity in density shall be shown by FIGS. 15A to 15C and 16A to 16C. These were printed by a monochrome recording head in order to simplify the explanation. In FIG. 15A, 91 indicates the multi-head; the multi-head is similar to that in the FIG. 14, but it shall be assumed that it consists of 8 multi-nozzles (92) to simplify the explanation. 93 indicates ink droplets ejected by the multi-nozzle 92. It is ideal that the ejection take place in uniform quantity and in the uniform direction, as shown in this drawing. When the ejection is performed in this manner, uniform size of dots will drop on the paper (FIG. 15B), and a uniform image will be obtained (FIG. 15C).

Figure 16C:
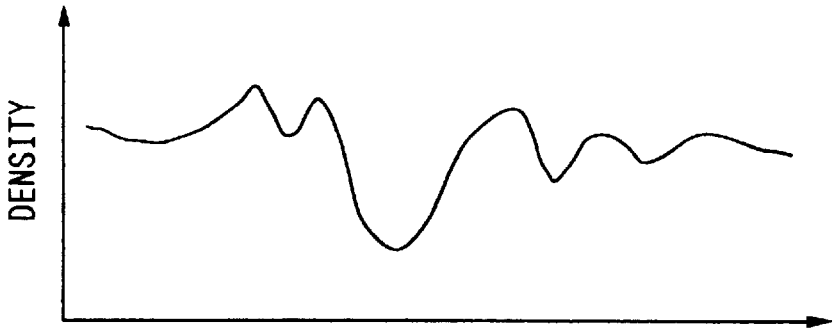
FIGS. 16A to 16C are printouts printed by an ink-jet recording apparatus showing nonuniformity in the density.
Figure 16B:
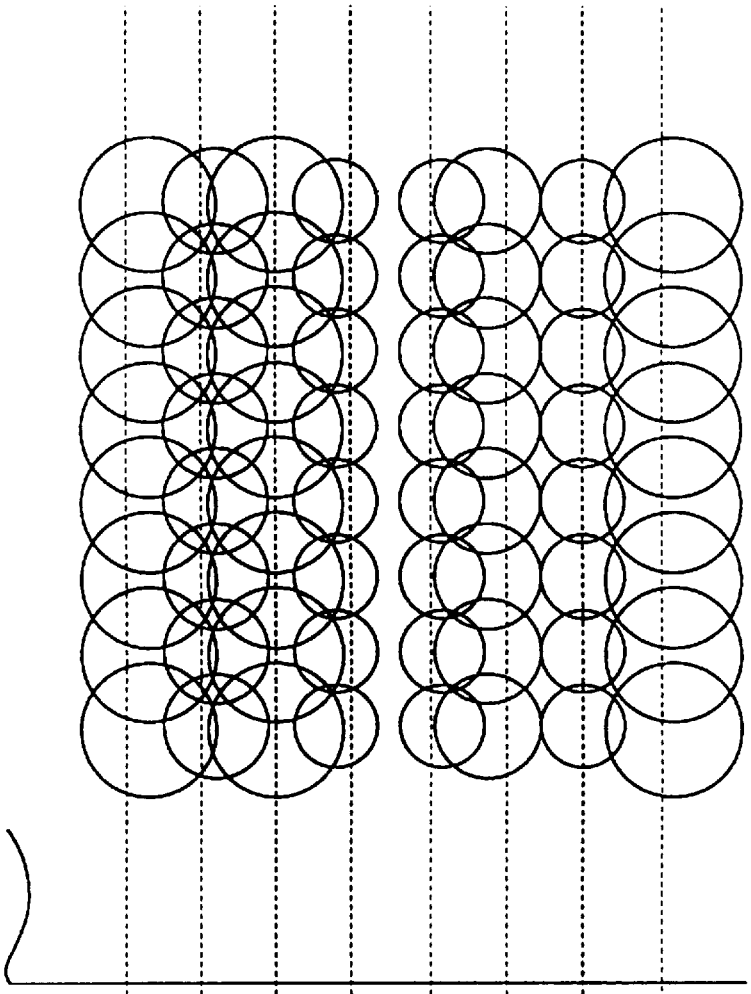
Figure 16A:
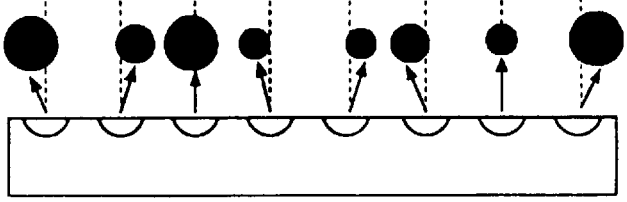

However, in reality, each nozzle is slightly different and if the printing would be performed as described above, ink drops ejected through each nozzle will be not uniform in size and direction, as shown in the FIG. 16A, and the ink drops fall on the paper as shown in FIG. 16B. In this drawing head main scanning direction periodically blank spots that cannot fulfill the area factor of 100%, or conversely, dots are overlapping unnecessarily, or, as it can be seen in the middle of the drawing, white stripes. The clusters of dots fallen onto the paper form density distribution shown in FIG. 16C in the nozzle alignment direction. This is perceived by human eyes as ununiform density.

In the ink-jet recording apparatus used in this embodiment the method which will be decribed below is adopted. This method shall be explained briefly using FIGS. 17A to 17C and 18A to 18C. In this method, multi-head 91 must scan 3 times to complete printing the printing area shown in the FIGS. 15A to 15C and 16A to 16C, whereas the area of 4 picture elements which corresponds to the half of the printing area can be completed by 2 passes. The 8 nozzles of the multi-head are divided into upper and lower group, each consisting of 4 nozzles; each nozzle prints at each scanning the dots that has been reduced to the half of the number of the dots in the original image data to a designated image data array (checker pattern shown in FIG. 18A). And at the second scanning the remaining half of the image data is filled with dots (reverse checker shown in FIG. 18B), and thus the printing in 4 picture elements is completed. This recording method is called divided recording.

Figures 17A, 17B, 17C:
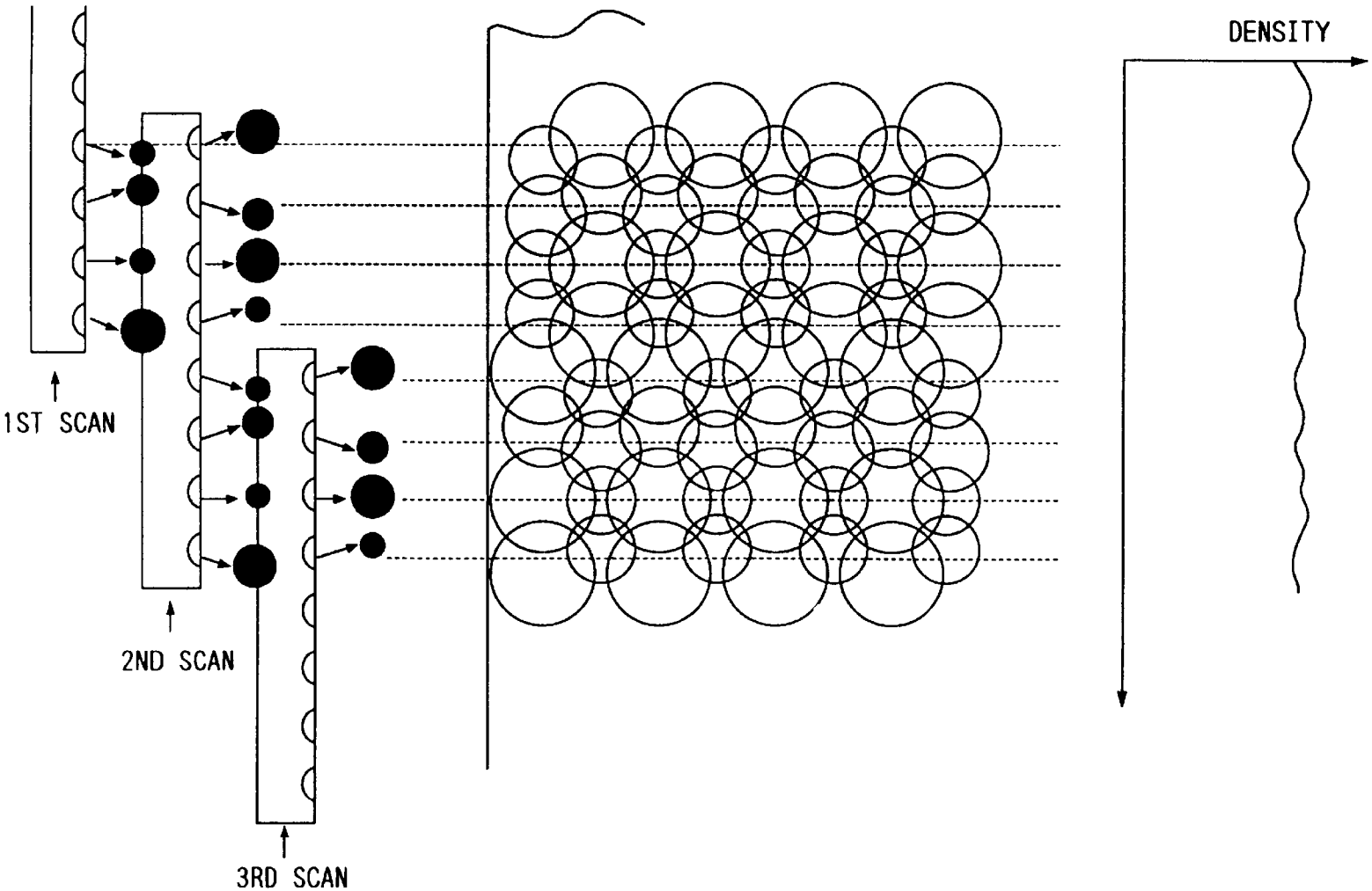
FIGS. 17A to 17C are the first explanatory drawings showing nonuniformity reduction by means of divided recording method.
Figure 18A:
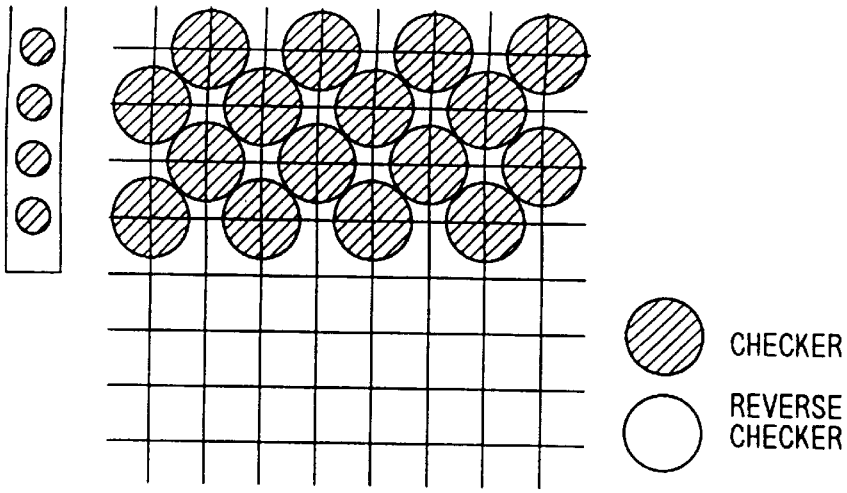
FIGS. 18A to 18C are the second explanatory drawings showing nonuniformity reduction by means of divided recording method.
Figure 18B:
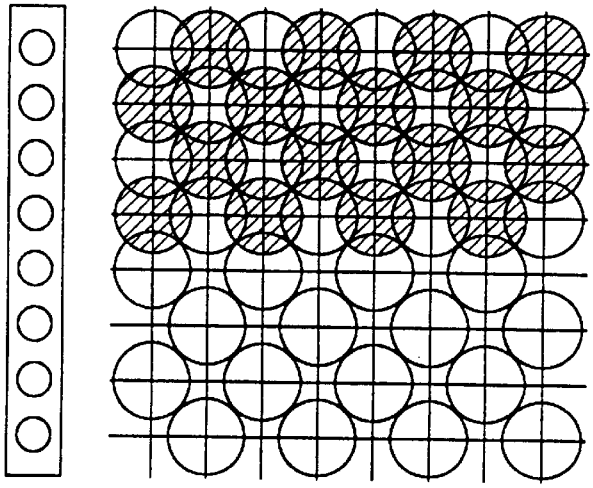
Figure 18C:
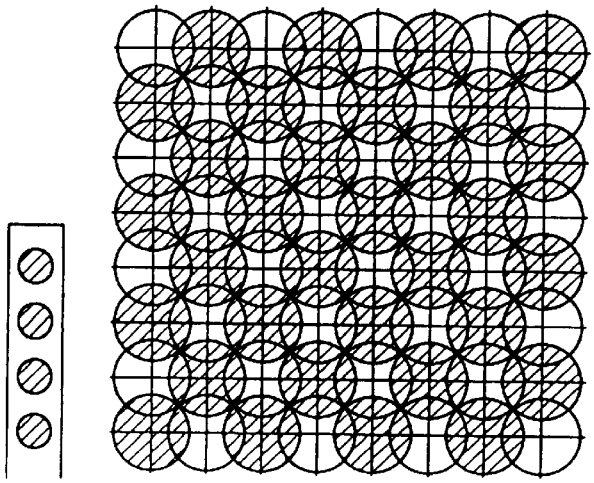

By using this recording method, specific influence of each nozzle on the printed image will be reduced by half, when the same multi-head as shown in FIGS. 16A to 16C will be used; the printed images as shown in FIG. 17B will be obtained; black and white stripes as in FIG. 16B will be less apparent. Thus the ununiformity in the density will be, as shown in FIG. 17C, reduced considerably compared to FIG. 16C.

In the recording apparatus used in the embodiment 2, when printing diagrams, the divided recording method in which the printing is performed in two scannings is adopted, and when printing texts in which ununiformity in the density is not very apparent, the printing can be performed in single scanning; in this printing mode higher printing speed can be achieved.

[2] Unejection Deciding Means

In the embodiment 2, when printing in two scannings, a smaller ΔTth is chosen. And, by using the method of deciding unejection of the recording head by means of the temperature changes caused by temperature rise by idle ejection and temperature fall after the idle ejection simultaneously the reliability of the recording apparatus concerning the unejection shall be improved.

In the recording apparatus used in this embodiment comprising a plurality of heads arranged side by side, signals of head temperature sensor of other heads are disturbed by noises. If the printing duty is high, the noise that occur in the signals of the head temperature sensor of other heads will increase. Since in the printing mode in which the printing is conducted in two scannings the printing duty is low, the noise is also low, so the ΔTth can be set relatively narrow. As the printing duty is low, the temperature rise due to the printing will be little, and therefore it will be necessary to set the ΔTth narrow.

It is also possible to find out the printing duty from the printing data beforehand, and to change ΔTth accordingly. For example, for each line the ΔTth can be set narrow when the printing duty is low, and it can be set wide when the printing duty is high.

In this embodiment the ΔTth is changed according to the different printing duties in various printing modes, but noise level and the temperature rise due to the printing are not only influenced by printing duty. ΔTth may also be changed according to other factors, for example driving frequency of the recording head.

The method that we showed as a hitherto technic, i.e. method to decide unejection of recording head by means of temperature change according to the temperature rise due to idle ejection and the temperature fall after the ejection can decide unejection of the recording head with certainty. But this method can be applied only when not printed, and it takes much time to execute the procedure, it can lead to reduction of throughput of the recording head if this method is frequently used. The method to decide unejection of the recording head using the monitored value and the presumed value of the head temperature described above is not confided to the times when not printed, and it has the advantage that throughput will be hardly reduced. But this method has the disadvantage that the recording head can malfunction by noises suddenly coming from outside, and, when the printing duty is low, it is difficult to decide unejection because ΔT is then narrow.

For these reasons, in this embodiment both of the unejection deciding method described above are adopted to improve the reliability of the recording apparatus concerning the unejection. Concretely, similar to the embodiment 1, considering the possibility that sudden noises from outside may lead to incorrect decision of unejection, the method to decide unejection of recording head by means of temperature change according to the temperature rise due to idle ejection and the temperature fall after the ejection is adopted to decide unejection of the recording head with certainty.

When the power supplied for the recording head is switched on, decision of unejection of the recording head is conducted by means of the temperature change of the recording head due to idle ejection. If unejection of the recording head is detected, the ejection recovery measures may be performed. After elapsing of 60 hours after the switch on, the same sequence can be executed.

Figure 19:
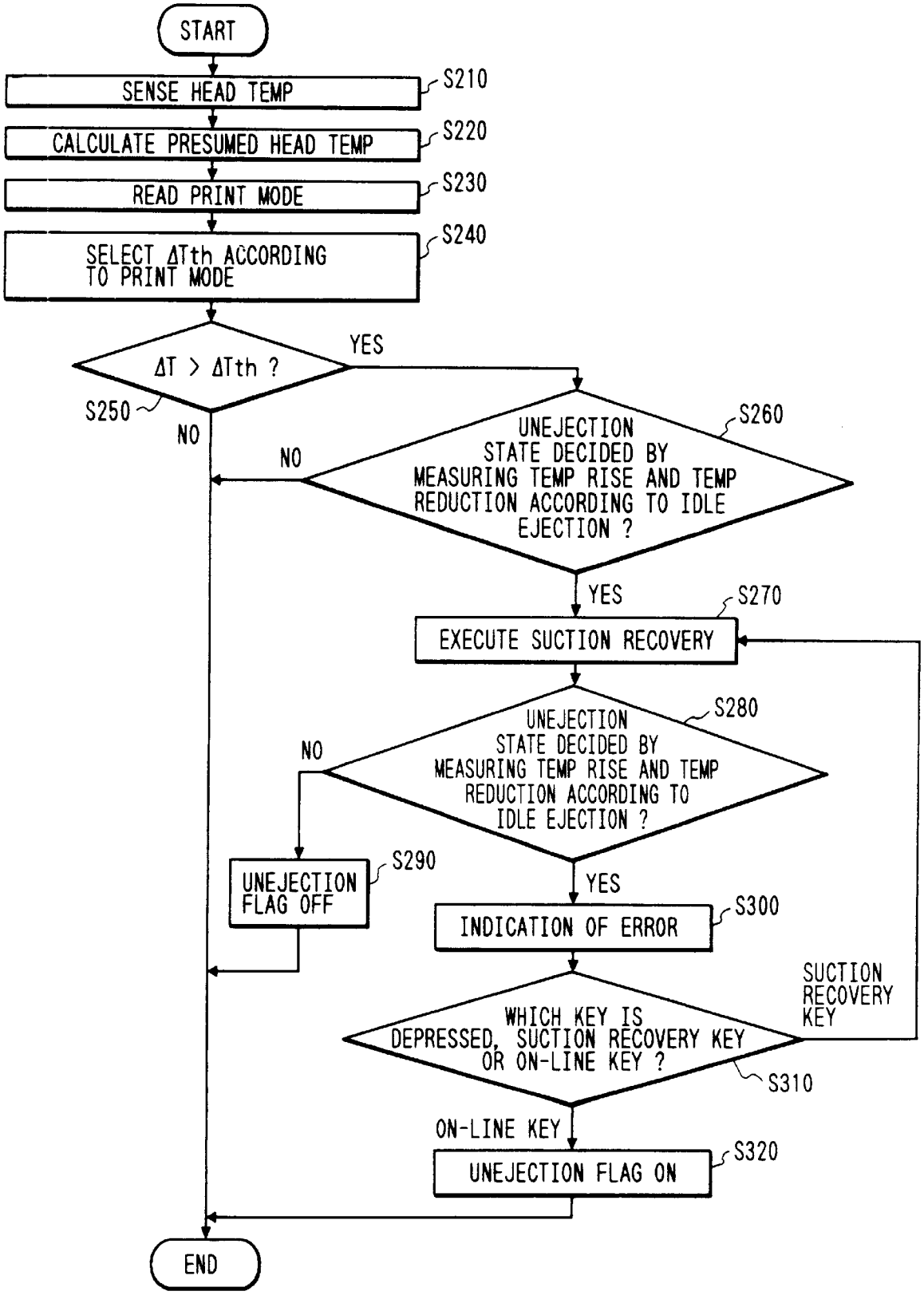
FIG. 19 is a flowchart to explain the unejection deciding means and the unejection recovery means in the embodiment 2.

The flowchart in the FIG. 19 illustrates the process of unejection detecting measures. Explanation of the part which is the same as in FIG. 12 shall be omitted. At Step S230 the printing mode of the recording head is obtained, and at step S240 the ΔTth corresponding to the printing mode is selected. In this embodiment the printing mode of the recording apparatus is obtained before the decision of unejection, but this is not a necessary requirement. When the printing mode is changed by the user or by an application software, the ΔTth can also be changed according to the mode.

In this embodiment the ΔTth is changed according to the printing mode of the ink-jet recording apparatus, but the ΔTth can also be changed according to other states of the recording apparatus.

For example, it is also advantageous to change the ΔTth according to the temperature difference between the recording head and the ambient temperature. The heat distribution in the recording head is different before starting the printing and after having performed high duty printing. In the former case, after starting the printing the heat generated by it is transferred quickly to other parts of the head having relatively low temperature compared to the part near the ejection heater. In the latter case, the temperature in other parts of the recording head has already become higher so that heat cannot be transferred easily. Therefore, it is adequate to set the ΔTth relatively high in the latter case.

The ΔTth can also be changed according to the length of the time during which the recording apparatus has been left unused. If the recording head is left unused for a long time, volatile components of the ink in the vicinity of the ejection opening evaporate, and the viscosity of the ink increases so that the recording head cannot eject ink easily. If ink ejection (including pre-ejection) will be effected after leaving the apparatus unused for a long time, the ejection quantity is little, or no ejection can be performed at all. Since the ΔT will increase in this state, it is preferable to set ΔTth large.

The ΔTth can also be changed according to the temperature difference between the monitored value and the presumed value of the head temperature. When the recording apparatus has stopped printing for a few seconds, the noise level decreases so that the monitored and presumed value of the recording apparatus should coincide. But if the monitored temperature differs from the presumed temperature due to the accuracy of the head temperature calculation, this difference will disturb the detection of unejection of the recording head. Therefore, it is effective for improving the accuracy of the decision of unejection to correct ΔTth according to the difference. Conversely, the same effect can be achieved by adjusting the presumed head temperature to the monitored head temperature when the recording apparatus is in a defined state.

When the recording head is decided to be in the unejecting state at step S260, the suction recovery is executed at step S270. After that, the decision of unejection of the recording head by means of the temperature change due to idle ejection at step S280 in order to check if the normal state of the recording head has been recovered. If the state is normal, all the flags are reset (off) at step S290, and the suction recovery is completed. If the recording head is still in the unejection state in spite of the suction recovery, it is assumed that the ink tank does not contain ink, and at step S300 error is displayed, and the apparatus waits for the operation by the user.

When the user at step S310 replaces the head tank by a new tank containing ink, and depresses the suction recovery key, the suction recovery, and subsequently the decision of unejection is executed; when it is certified that the recording head is not in the unejection state, the normal state is recovered (The unejection flags will be explained later).

If the user has depressed not the suction recovery key, but the on-line key, the normal state will be recovered by setting (on) the unejection flags at step S320, but the head decided to be in the unejected state will not be driven. In the present embodiment, of the 4 unejection flags corresponding to 4 color-heads only the one which corresponds to the head decided to be in the unejection state shall be switched on. Then the normal state will be recovered. After recovering the normal state, printing will be executed according to printing data, but the head corresponding to the unejection flag that is switched on will not be driven. Also the controls for printing by this head, such as temperature regulation, pre-ejection etc. will not be executed. The data corresponding the color of the head will be regarded as not existing, i.e., scanning of the carriage will not be executed if only the printing data for the color exist.

These measures shall enable printing with remaining heads if the user desires, when one of the 4 color inks becomes empty. For example, when color inks of black, cyan, magenta and yellow are used, and in case a head tank containing one of these colors will be used up, it will be possible to perform monochrome printing using only the head for black ink. If the head not containing ink would also be driven, temperature would rise excessively, and the head would be damaged. (When the ink is emptied, the ink tank can be replaced in such apparatus in which ink tanks are replaceable, otherwise inks are to be refilled). If the temperature will rise further the head tank will melt, and it will influence also the main body of the recording apparatus negatively.

The ink-jet recording apparatus in this embodiment is so controlled that scanning of areas not containing printing data will be avoided as far as possible. As the head decided to be in the state of unejection does not execute printing, throughput can be improved by ignoring the corresponding printing data.

After power supply of the recording apparatus is switched on, when printing is to be started, the unejection flags are set (on), and the user will be warned by an error message. When the user has replaced the head tank by a new one filled with ink, (or has refilled the tank with ink), the suction recovery has been executed, and after the suction recovery the head is decided to be in the ejectable state, the unejection flag is reset (off).

This sequence that enables printing without driving the head which is in the unejection state is effective, not only in the present embodiment, but also generally in ink-jet recording apparatus which execute printing by ejecting inks of various colors, when one of the inks in the ink ejecting apparatus (in this embodiment one of 4 colors) are used up. This sequence is also effective, when a recording head is divided into several sections, and each section is driven separately (for example, if ink colors are different) and a part of the recording head has changed into the unejection state.

(Third Embodiment)

In the third embodiment, a value obtained by subtracting a presumed temperature of the head from the monitor temperature of the head is accumulated for a period while unejection deciding means satisfies specified requirements. In this embodiment, the recording apparatus used in the second embodiment is used, and head temperature monitor means, head temperature presuming means and ejection recovery means are the same as in the first embodiment.

The monitor temperature of the head does not coincide with the presumed temperature of the head under a condition that unejection has not occurred. Probable causes in this case are, for example, presuming operation of the head temperature, deviation in software timing due to average processing of signals from the temperature sensor of the head, accuracy of presumption of the head temperature and various types of noises. Decision of unejection of the recording head according to a value obtained by subtracting a presumed temperature value of the head from the monitor temperature of the head results in a factor which will lower the accuracy of unejection decision.

Therefore, in this embodiment, a value obtained by subtracting the presumed temperature of the head from the monitor temperature of the head is accumulated at a specified interval of time. If a value obtained from accumulation for a specified period of time is larger than a specified threshold value ΔTth, it is decided that the recording head is in a state of unejection. Through accumulation for a specified period of time, the accuracy of decision of unejection can be raised and simultaneously an ejection failure can be detected even in low-duty printing.

As described above, in this embodiment, a value obtained by subtracting the presumed temperature of the head from the monitor temperature of the head is accumulated. However, even though the ejection of the recording head is normal, an accumulated value obtained by subtracting the presumed temperature of the head from the monitor temperature of the head may not be 0 (zero), depending on the accuracy of presuming operation. Therefore a difference of temperature values obtained after specified compensation for one of the monitor temperature of the head and the presumed temperature value of the head can be accumulated. With lapse of a certain specified time after accumulation of the monitor temperature value of the head and the presumed temperature value of the head, it can be decided from the result of accumulation as to whether the recording head is in the condition of unejection.

In this embodiment, a value obtained by subtracting the presumed temperature of the head from the monitor temperature of the head is accumulated for a specified period of time. The interval for accumulation is not limited to that specified time and can be, for example, a period of time for one scan.

Ejection in this embodiment includes ejection during printing but also pre-ejection during printing and pre-ejection before and after printing.

(Fourth Embodiment)

Figure 20:
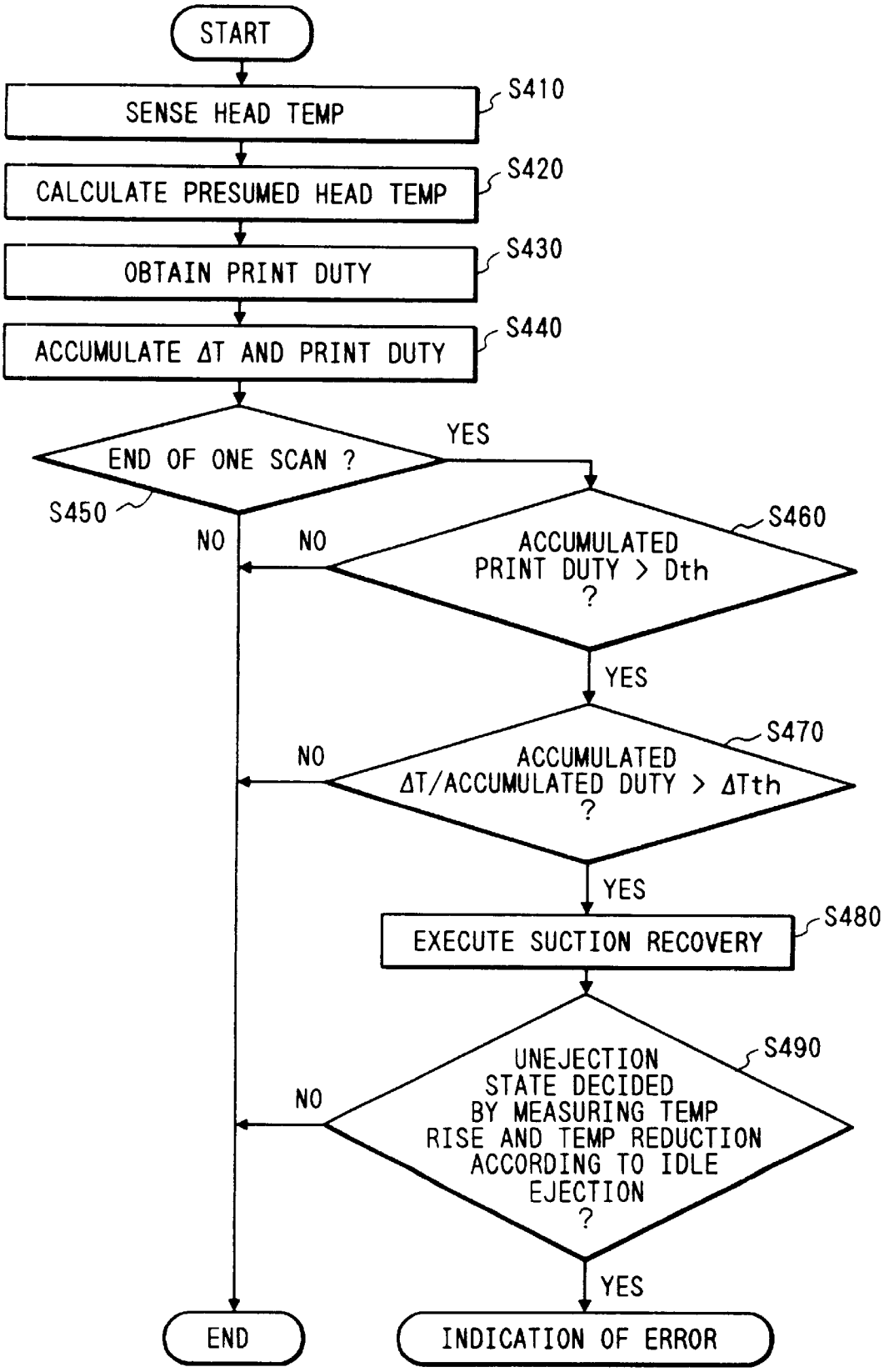
FIG. 20 is a flowchart to explain the unejection deciding means in the embodiment 4.

In the fourth embodiment, the recording apparatus used in the second embodiment is used, and head temperature monitor means, head temperature presuming means and ejection recovery means are the same as in the first embodiment. Operation of this embodiment is shown in the flow chart in FIG. 20. The description of the same components as shown in FIG. 19 is omitted.

In the fourth embodiment, a value (hereafter referred to as "ΔT") obtained by subtracting the presumed value of temperature of the head from the monitor temperature of the head is accumulated for a period of one scan. In step S430, a printing duty for one scan is obtained from printing data and the accumulated value is compensated by the value of the printing duty. In this embodiment, the number of characters per scan and a difference of the printing duty are compensated by dividing the accumulated value by the printing duty of one scan. If the printing duty of one scan is larger than the predetermined value (referred to as "Dth") and the compensated value is larger than the specified threshold value ΔTth, it is decided that the recording head is in the unejection state.

A print area and a duty where printing is carried out in one scan differ with each scan. In comparison with the value ΔTth without compensation of the accumulated value of ΔT according to the printing duty, differing from the third embodiment, the value ΔTth should be set to meet a case that the print area for one scan is large and the printing duty is also large, that is, the accumulated value of the printing duty for one scan is large. This is because, if the value ΔTth is set to meet a case that the accumulated value of the printing duty is small, ΔTth is relatively small and, if the accumulated value of the printing duty for one scan is large in actual printing, it may be decided that the recording head is in a state of unejection despite that the recording head is normal.

Therefore, this embodiment is adapted to enable to detect unejection by compensation with the accumulated value for one scan of the printing duty even when the print area and the printing duty in one scan are smaller. In this embodiment, the number of characters for each scan and the difference of the printing duty are compensated by dividing a value accumulated in step S470 by the printing duty of one scan.

However, if the print area and the printing duty in one scan are small, ΔT is naturally small and the accumulated value of ΔT is also small. In this case, a value obtained by dividing the accumulated value of ΔT by the accumulated value of the printing duty substantially varies, depending on a noise included in the monitor temperature value of the head (noise level is high). This brings about a high possibility of faulty decision as to unejection. In step S460, if the accumulated value of the printing duty for one scan is smaller than the predetermined value Dth, it is decided that the noise level is high and therefore unejection is not decided.

The above adaptive arrangement enhances the accuracy in detection of unejection of the recording head equivalent to or better than the third embodiment and enables to detect unejection even in low duty printing.

In this embodiment, a value obtained by subtracting the presumed temperature of the head from the monitor temperature of the head is compensated by the printing duty for one scan. In addition, the threshold value ΔTth for deciding the ink dropping can be compensated by the printing duty for one scan. The period of accumulation is not always limited to a period of one scan. For example, the accumulation can be carried out for two scans.

In this embodiment, a value obtained by subtracting the presumed temperature of the head from the monitor temperature of the head is accumulated. However, an accumulated value obtained by subtracting the presumed temperature of the head from the monitor temperature of the head may not be 0 due to the accuracy of presuming operation even if the ejection of the recording head is normal. In this case, a difference of values obtained from specified compensation of one of the monitor temperature of the head and the presumed temperature of the head can be accumulated. Unejection of the recording head can be decided from an accumulated value when printing of one scan is finished after respective accumulations of the monitor temperature of the head and the presumed temperature of the head.

(Fifth Embodiment)

In the fifth embodiment, the recording apparatus used in the second embodiment is used, and head temperature monitor means, head temperature presuming means and ejection recovery means are the same as in the first embodiment.

In the fifth embodiment, the number of print dots is obtained from printing data prior to actual printing. A value (hereafter referred to as "ΔT") obtained by subtracting the presumed temperature of the head from the monitor temperature of the head is accumulated and, at the same time, the number of print dots is counted. When the number of counted dots reaches a specified value, the accumulated value of ΔT is compared with the specified threshold value ΔTth for decision of unejection and, if the accumulated value of ΔT is larger than the value ΔTth, the recording head is decided as in the state of unejection.

When the printing duty is high, ΔT when the recording head is in the state of unejection is sufficiently large and the duration of accumulation of ΔT for carrying out decision of unejection with high accuracy can be relatively less. When the printing duty is low, the duration of accumulation of ΔT, which is a small value, should be long to ensure accurate decision of unejection. In this embodiment, the number of print dots is counted and accumulation of ΔT is carried out until the number of counted dots reaches the predetermined value. In the case of the printing duty of, for example, 100% and 50%, accumulation of ΔT in the printing duty of 50% is carried out for the number of print dots two times that in the printing duty of 100%.

As in the third and fourth embodiments, the above-described arrangement enhances the accuracy in detection of unejection of the recording head and enables detection of unejection even in low duty printing.

In this embodiment, a value obtained by subtracting the presumed temperature of the head from the monitor temperature of the head is accumulated. However, an accumulated value obtained by subtracting the presumed temperature of the head from the monitor temperature of the head may not be 0 due to the accuracy of presuming operation even if the ejection of the recording head is normal. In this case, a difference of values obtained from specified compensation of one of the monitor temperature of the head and the presumed temperature of the head can be accumulated.

The accumulation time in a relatively low printing duty is longer than that in a high printing duty, a quantity of heat which flows from the heater of the recording head and its ambiance to other parts of the recording head and the outside will increase while accumulation of ΔT is carried out. In some cases, it is considered that compensation in response to such thermal propagation should be implemented. For example, taking into account that, when the printing duty is relatively low, the accumulation time increases and accordingly the quantity of heat which flows from the heater and its ambiance of the recording head also relatively increases, and when the accumulation time of ΔT is short, the ΔTth value can be set to be small.

Ejection in this embodiment may include ejection during printing but also pre-ejection during printing and pre-ejection before and after printing.

(Sixth Embodiment)

In the sixth embodiment, the recording apparatus used in the second embodiment is used, and head temperature monitor means, head temperature presuming means and ejection recovery means are the same as in the second embodiment.

Figure 21:
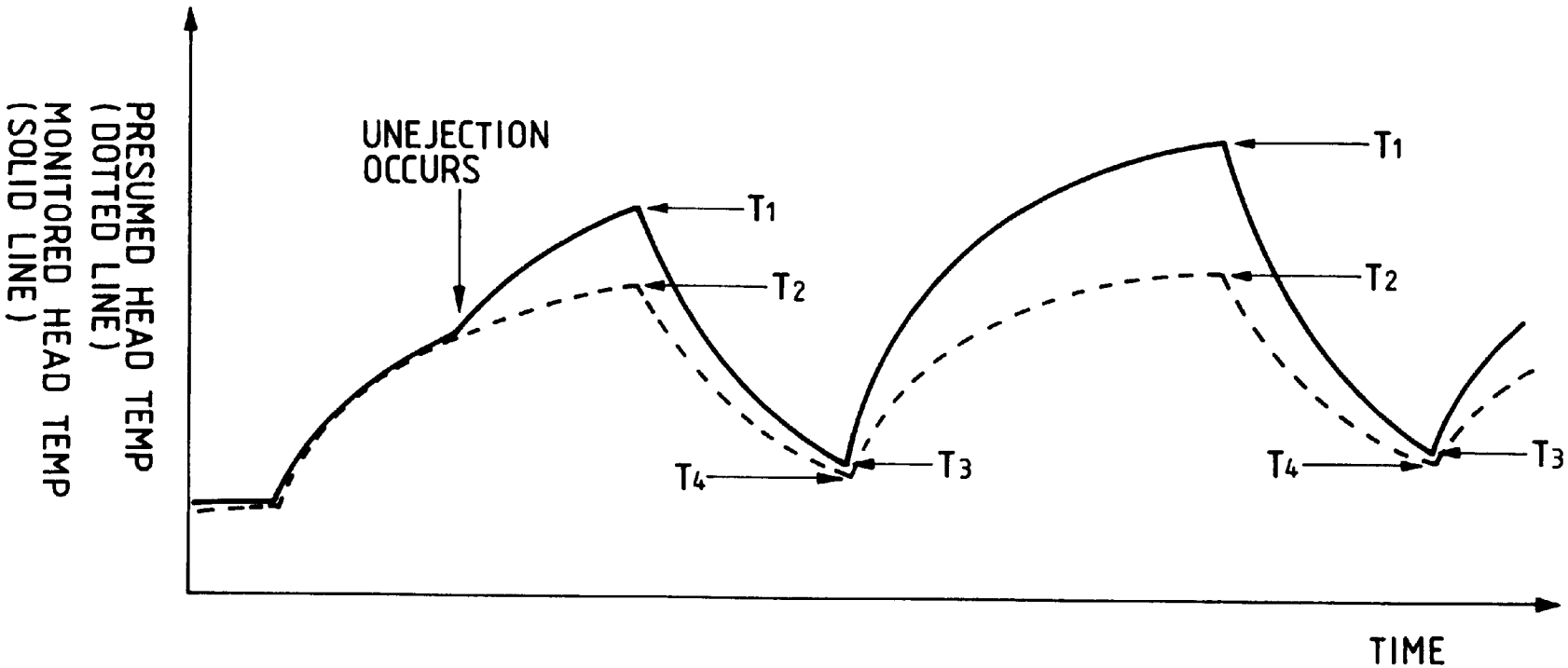
FIG. 21 is a diagram to explain the unejection deciding means in the embodiment 6.

FIG. 21 is a graph for describing the sixth embodiment. In this embodiment, unejection is decided using the monitor temperature of the head and the presumed temperature of the head immediately after printing of one scan and shortly before starting next printing. In FIG. 21, T1 is a monitor temperature of the head immediately after printing of one scan has been finished, T2 is a presumed temperature of the head immediately after printing of one scan has been finished, T3 is a monitor temperature shortly before printing of next scan is started, and T4 is a presumed temperature shortly before printing of next scan is started. A result obtained by subtracting a value, which is obtained by subtracting the presumed temperature of the head from the monitor temperature of the head shortly before printing of next scan is started, from a value, which is obtained by subtracting the presumed temperature of the head from the monitor temperature of the head immediately after printing of one scan has been finished is referred to as ΔT. If ΔT is larger than the threshold value ΔTth after unejection has been detected in comparison, it is decided that the head is in the state of unejection.

If printing is carried out during unejection, the monitor temperature of the head becomes far higher than the presumed temperature of the head and similarly becomes far lower than the presumed temperature after printing, and therefore ΔT becomes large. If ejection of the recording head is normal, a difference between the monitor temperature of the recording head and the presumed value of the recording head temperature is small and therefore ΔT is small. The threshold value ΔTth for decision is set to be as large as a faulty operation due to noise can be eliminated and t be as small as unejection can be certainly decided.

A merit of this embodiment is found in a point that a monitor temperature of the head when printing is not carried out is used. Though not shown in FIG. 21, signals generated during printing include a noise due to printing. The signals include noises due to printing by other heads in parallel connection. In this embodiment, unejection of the recording head can be decided in higher accuracy.

In this embodiment, unejection is detected in each scan. However, unejection of the recording head can be decided by accumulating ΔT of, for example, several scans.

(Seventh Embodiment)

In the seventh embodiment, as unejection deciding means, a value obtained by subtracting the presumed value of the head temperature from the monitor temperature of the head is accumulated during idle ejection under a non-printing condition. In the seventh embodiment, the recording apparatus used in the second embodiment is used, and head temperature monitor means, head temperature presuming means and ejection recovery means are the same as in the first embodiment.

In an ink jet recording apparatus according to this embodiment, a specified number of times of idle ejection is carried out before printing of one page is started. Unejection of the recording head is decided by utilizing this operation.

Since idle ejection before starting the printing does not depend on the printing duty, there is a merit that unejection of the recording head can be decided even when the printing duty is low. In the case of high duty printing, unejection is detected during printing and, in the case of continuous low duty printing, it can be adapted to detect unejection of the recording head due to idle ejection by increasing the number of times of idle ejection before page printing.

(Eighth Embodiment)

In this embodiment as in the first embodiment, whether or not the recording head is in the state of unejection is decided from the monitor temperature of the recording head and the presumed temperature of the recording head obtained from the presuming operation. The ink jet recording apparatus, head temperature monitor means, head temperature presuming means and ejection recovery means which are used in this embodiment are the same as in the first embodiment.

The conditions for decision of unejection are as follows.

$$(\textit{Recording head temperature})-(\textit{Presumed temperature})>\Delta Tth$$

In the first embodiment, unejection of the recording head is decided in accordance with variations of the temperature of the recording head along with idle ejection, taking into account a possibility of deciding the ejection as a faulty ejection due to a rarely sudden noise from outside the recording apparatus, and the unejection is finally decided. In this eighth embodiment, the unejection is finally decided by a method in which the recording apparatus optically detects unejection of the recording head during idle printing.

Specifically, a light of, for example, an light emission diode is passed through a part where droplets of ink ejected from the recording head during idle ejection are received and this light is received by a light receiving element. The unejection is decided by detecting the light which will be interrupted by a droplet of ink during idle ejection.

Though this method requires higher costs than the first embodiment, partial unejection of the recording head can be accurately detected and even a deviation of ink ejecting direction from the recording head can also be detected.

The first to eighth embodiments enable to monitor always or frequently unejection of the recording head and excessive rise of temperature. In addition, the durability of the recording head can be improved and the reliability of the ink jet recording apparatus can be enhanced by various effective measures such as ejection recovery treatment of the recording head from abnormalities, protective treatment for the recording head and warning and recommendation for users.

(Ninth Embodiment)

An apparatus of this embodiment can adopt the same structure as that of the first embodiment.

In the ink jet recording apparatus, the operation of ejection and the amount of ejection can be stabilized and the impartation of high quality to images to be recorded can be attained by controlling the temperatures of the recording heads within a fixed range. The means for computation and detection of the temperatures of the recording heads and the method for controlling the optimum drives for such temperatures which are adopted in the present example for the purpose of realizing stable recording of images of high quality will be outlined below.

(1) Setting of Target Temperature

The control of head drive aimed at stabilizing the amount of ejection which will be described below uses the tip temperature of a head as the criterion of control. To be more specific, the tip temperature of a head is handled as a substitute characteristic to be used for the detection of the amount of ejection per dot of the relevant ink being ejected at the time of detection. Even when the tip temperature is fixed, the amount of ejection differs because the temperature of the ink in the tank depends on the environmental temperature. The tip temperature of the head which is set to equalize the amount of ejection at a varying temperature (namely at a varying ink temperature) for the purpose of eliminating the difference mentioned above constitutes itself a target temperature. The target temperatures are set in advance in the form of a table of target temperatures. The table of target temperatures to be used in the present example are shown in FIG. 23.

(2) PWM Control

The stabilization of the amount of ejection can be attained when the head under a varying environment is driven at the tip temperature indicated in the table of target temperatures mentioned above. Actually, however, the tip temperature is not constant because it sometimes varies with the printing duty. The means to drive the head by the multi-pulse PWM drive and control the amount of ejection without relying on temperature for the purpose of stabilizing the amount of ejection constitutes itself the PWM control. In the present example, a PWM table defining the pulses of optimum waveforms/widths at existent times based on the differences between the head temperature and the target temperatures under existent environments are set in advance. The drive conditions for ejection are fixed based on the data of this table.

(3) Control of Sub-Heater Drive

The control which is attained by driving a sub-heater and approximating the head temperature to the target temperature when the PWM drive fails to obtain a desired amount of ejection forms the control of a sub-heater. The sub-heater control enables the head temperature to be controlled in a prescribed temperature range. This embodiment drives the sub-heater when the calculated temperature is not more than 25° C. on the way to printing, and stops the sub-heater when the calculated temperature is not less than 25° C.

(4) Calculation Means of Recording Head Temperature

This embodiment can calculate by using the same calculation method as that described in the first embodiment.

Next, a PWM control, a calculation method of the recording head temperature and a correction method of the recording head temperature, each which is main object of this embodiment will be described in detail below.

(PWM Control)

Figure 24:
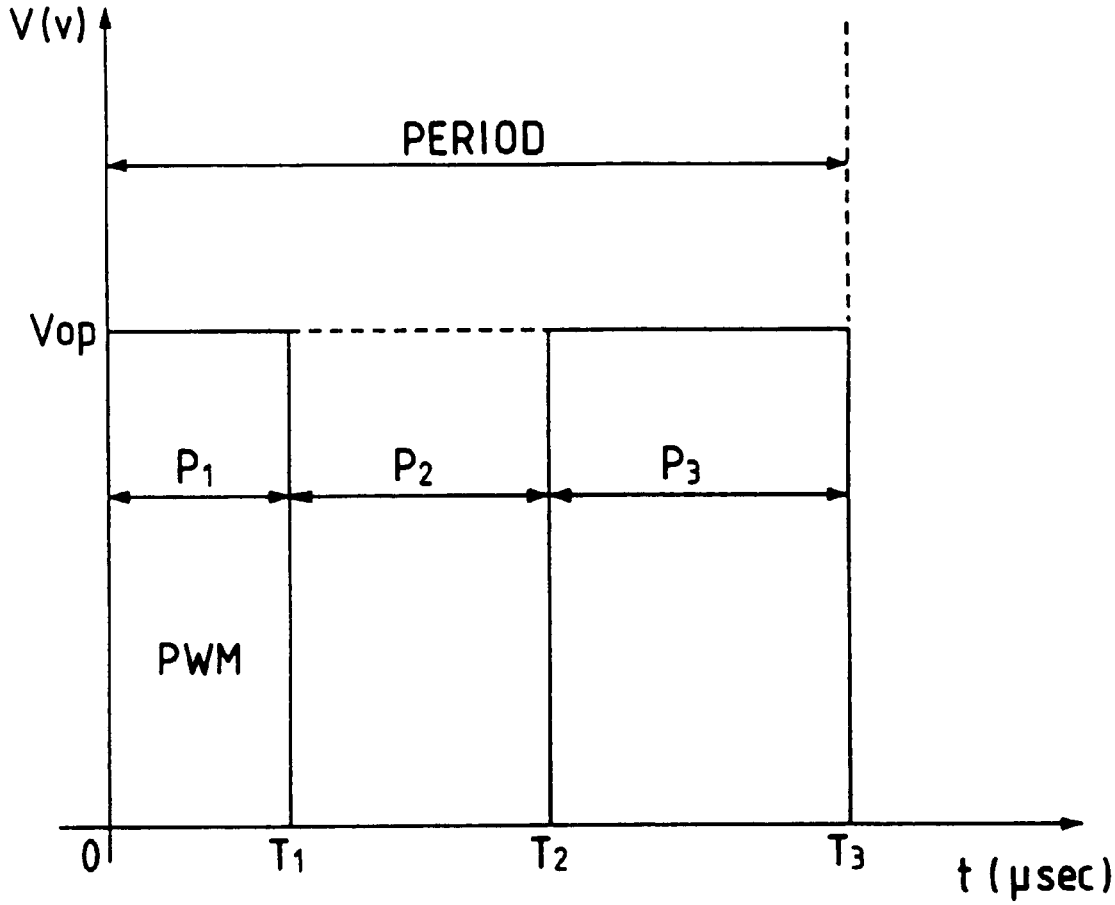
FIG. 24 is an explanatory drawing of the driving method for dividing pulse-width modulation.

FIG. 24 is a view for explaining divided pulses according to this embodiment of the present invention. In FIG. 24, $V_{OP}$ represents an operational voltage, $P_1$ represents the pulse width of the first pulse (to be referred to as a pre-heat pulse hereinafter) of a plurality of divided heat pulses, $P_2$ represents an interval time, and $P_3$ represents the pulse width of the second pulse (to be referred to as a main-heat pulse hereinafter). T1, T2 and T3 represent times for determining the pulse widths $P_1$, $P_2$, and $P_3$. The operational voltage $V_{OP}$ represents electrical energy necessary for causing an electrothermal converting element applied with this voltage to generate heat energy in the ink in an ink channel constituted by the heater board and the top plate. The value of this voltage is determined by the area, resistance, and film structure of the electrothermal converting element, and the channel structure of the recording head.

The PWM control of this embodiment can also be referred to as a divided pulse width modulation driving method. In this control, the pulses respectively having the widths $P_1$, $P_2$, and $P_3$ are sequentially applied. The pre-heat pulse is a pulse for mainly controlling the ink temperature in the channel, and plays an important role of the ejection quantity control of this embodiment. The pre-heat pulse width is preferably set to be a value, which does not cause a bubble production phenomenon in the ink by heat energy generated by the electrothermal converting element applied with this pulse.

The interval time assures a time for protecting the pre-heat pulse and the main-heat pulse from interference, and for uniforming temperature distribution of the ink in the ink channel. The main-heat pulse produces a bubble in the ink in the ink channel, and ejects the ink from an ejection orifice. The width $P_3$ of the main-heat pulse is preferably determined by the area, resistance, and film structure of the electrothermal converting element, and the channel structure of the recording head.

Figure 25A:
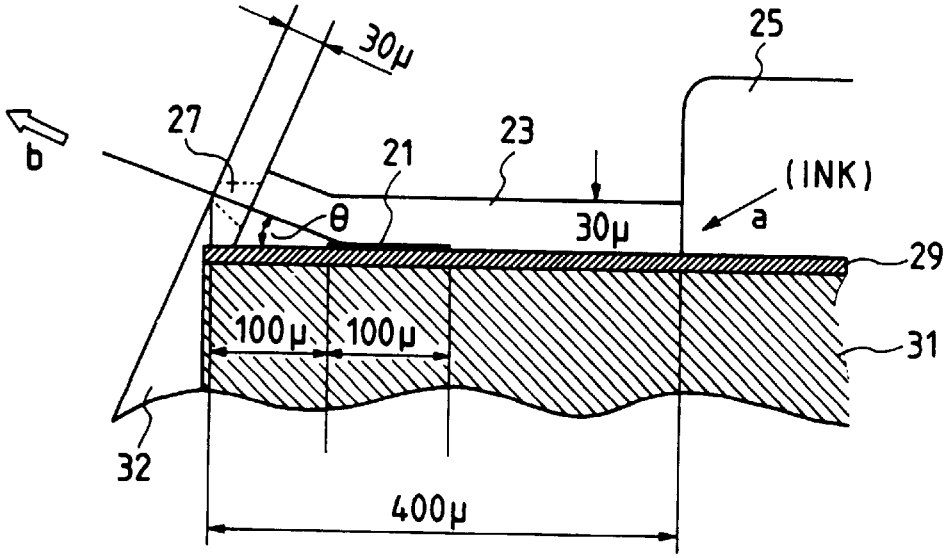
FIGS. 25A and 25B are diagrams illustrating the constraction of a printing head.
Figure 25B:
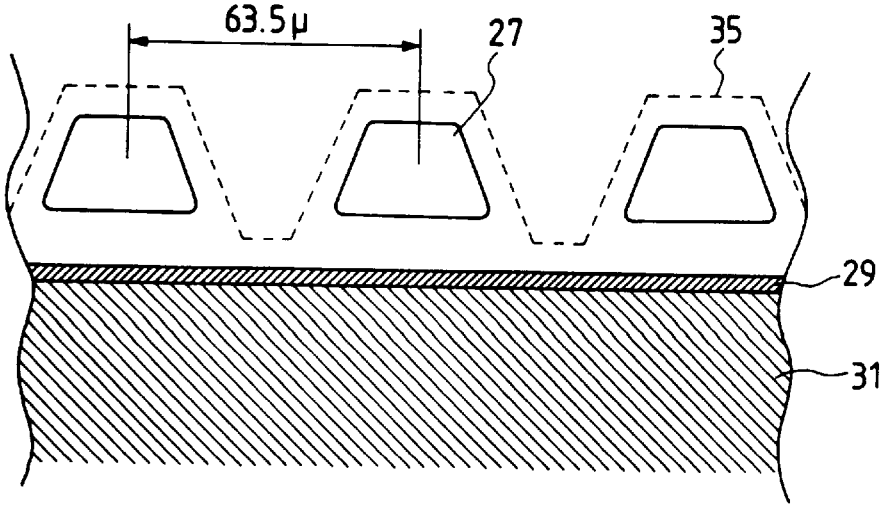

The operation of the pre-heat pulse in a recording head having a structure shown in, e.g., FIGS. 25A and 25B will be described below. FIGS. 25A and 25B are respectively a schematic longitudinal sectional view along an ink channel and a schematic front view showing an arrangement of a recording head which can adopt the present invention. In FIGS. 25A and 25B, an electrothermal converting element (ejection heater) 21 generates heat upon application of the divided pulses. The electrothermal converting element 21 is arranged on a heater board together with an electrode wire for applying the divided pulses to the element 21. The heater board is formed of a silicon layer 29, and is supported by an aluminum plate 31 constituting the substrate of the recording head. A top plate 32 is formed with grooves 35 for constituting ink channels 23, and the like. When the top plate 32 and the heater board (aluminum plate 31) are joined, the ink channels 23, and a common ink chamber 25 for supplying the ink to the channels are constituted. Ejection orifices 27 (the hole area corresponding to a diameter of 20$\mu$) are formed in the top plate 32, and communicate with the ink channels 23.

Figure 26:
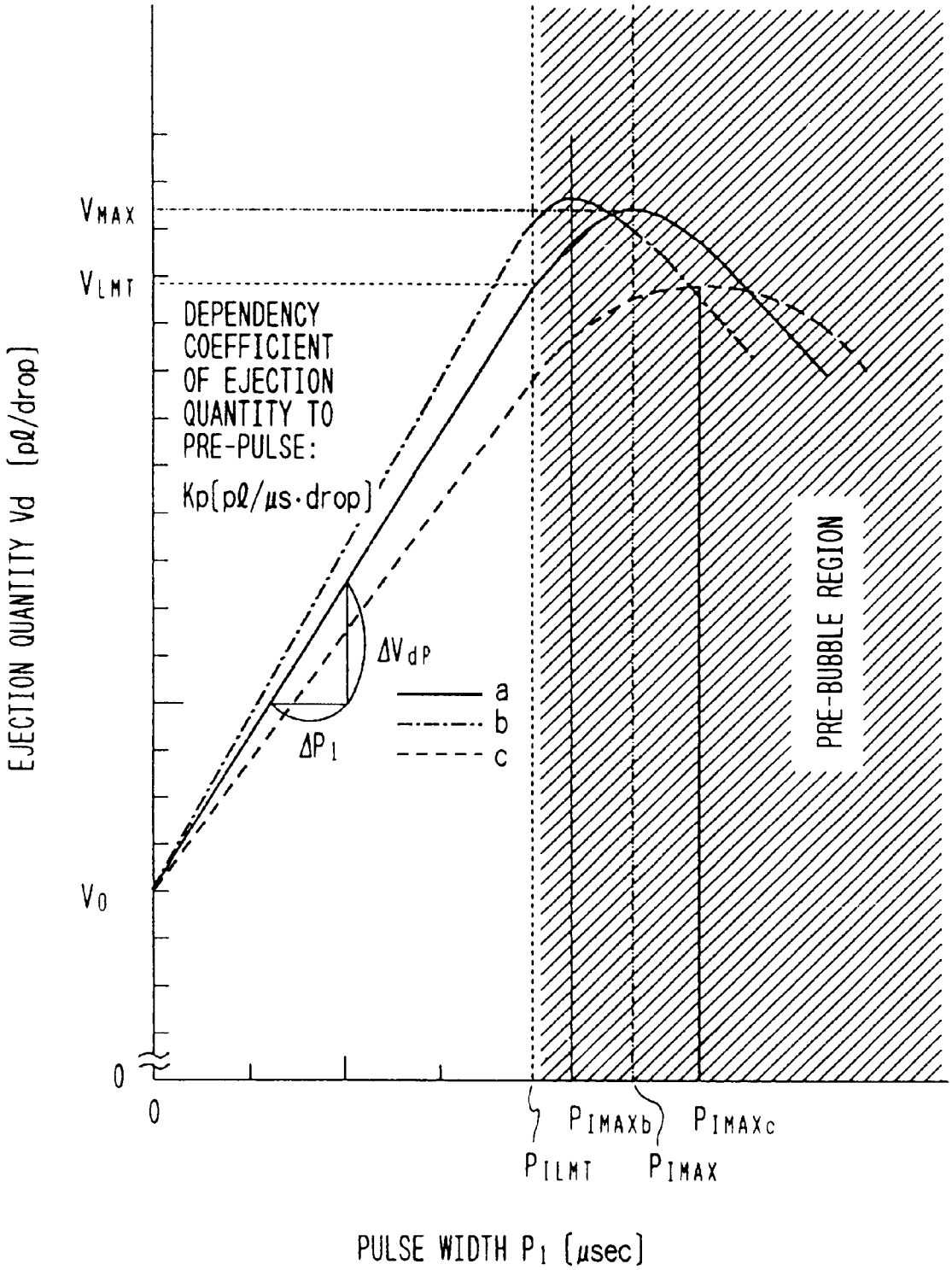
FIG. 26 is a diagram to explain the dependence of ejection on pre-heat pulse.

In the recording heat shown in FIGS. 25A and 25B, when the operational voltage $V_{OP}$=18.0 (V) and the main-heat pulse width $P_3$=4.114 [$\mu$sec] are set, and the pre-heat pulse width $P_1$ is changed within a range between 0 to 3.000 [$\mu$sec], the relationship between an ejection quantity Vd [pl/drop] and the pre-heat pulse width $P_1$ [$\mu$sec] shown in FIG. 26 is obtained.

FIG. 26 is a graph showing the pre-heat pulse dependency of the ejection quantity. In FIG. 26, $V_0$ represents the ejection quantity when $P_1$=0 [$\mu$sec], and this value is determined by the head structure shown in FIGS. 25A and 25B. For example, $V_0$=18.0 [pl/drop] in this embodiment when a surrounding temperature $T_R$=25 ° C. As indicated by a curve a in FIG. 26, the ejection quantity Vd is linearly increased according to an increase in pre-heat pulse width $P_1$, when the pulse width $P_1$ changes from 0 to $P_{1LMT}$. The change in quantity loses linearity when the pulse width $P_1$ falls within a range larger than $P_{1LMT}$. The ejection quantity Vd is saturated, i.e., becomes maximum at the pulse width $P_{1MAX}$.

The range up to the pulse width $P_{1LMT}$ where the change in ejection quantity Vd shows linearity with respect to the change in the pulse width $P_1$ is effective as a range where the ejection quantity can be easily controlled by changing the pulse width $P_1$. For example, in this embodiment indicated by the curve a, $P_{1LMT}$=1.87 ($\mu$s), and the ejection quantity at that time was $V_{LMT}$=24.0 [pl/drop]. The pulse width $P_{1MAX}$ when the ejection quantity Vd was saturated was $P_{1MAX}$=2.1 ($\mu$s), and the ejection quantity at that time was $V_{MAX}$=25.5 [pl/drop].

When the pulse width is larger than $P_{1MAX}$, the ejection quantity Vd becomes smaller than $V_{MAX}$. This phenomenon produces a small bubble (in a state immediately before film boiling) on the electrothermal converting element upon application of the pre-heat pulse having the pulse width within the above-mentioned range, the next main-heat pulse is applied before this bubble disappears, and the small bubble disturbs bubble production by the main-heat pulse, thus decreasing the ejection quantity. This region is called a pre-bubble production region. In this region, it is difficult to perform ejection quantity control using the pre-heat pulse as a medium.

When the inclination of a line representing the relationship between the ejection quantity and the pulse width within a range of $P_1$=0 to $P_{1LMT}$ [$\mu$s] is defined as a pre-heat pulse dependency coefficient, the pre-heat pulse dependency coefficient is given by:

$$KP=\Delta Vdp/\Delta P_1[pl/\mu sec\cdot drop]$$

This coefficient KP is determined by the head structure, the driving condition, the ink physical property, and the like independently of the temperature. More specifically, curves b and c in FIG. 26 represent the cases of other recording heads. As can be understood from FIG. 26, the ejection characteristics vary depending on recording heads. In this manner, since the upper limit value $P_{1LMT}$ of the pre-heat pulse $P_1$ varies depending on different types of recording heads, the upper limit value $P_{1LMT}$ for each recording head is determined, as will be described later, and ejection quantity control is made. In parentheses, in the recording head and the ink indicated by the curve a of this embodiment, KP=3.209 [pl/$\mu$sec·drop].

As another factor for determining the ejection quantity of the ink jet recording head, the ink temperature of the ejection unit (which may often be substituted with the temperature of the recording head) is known.

Figure 27:
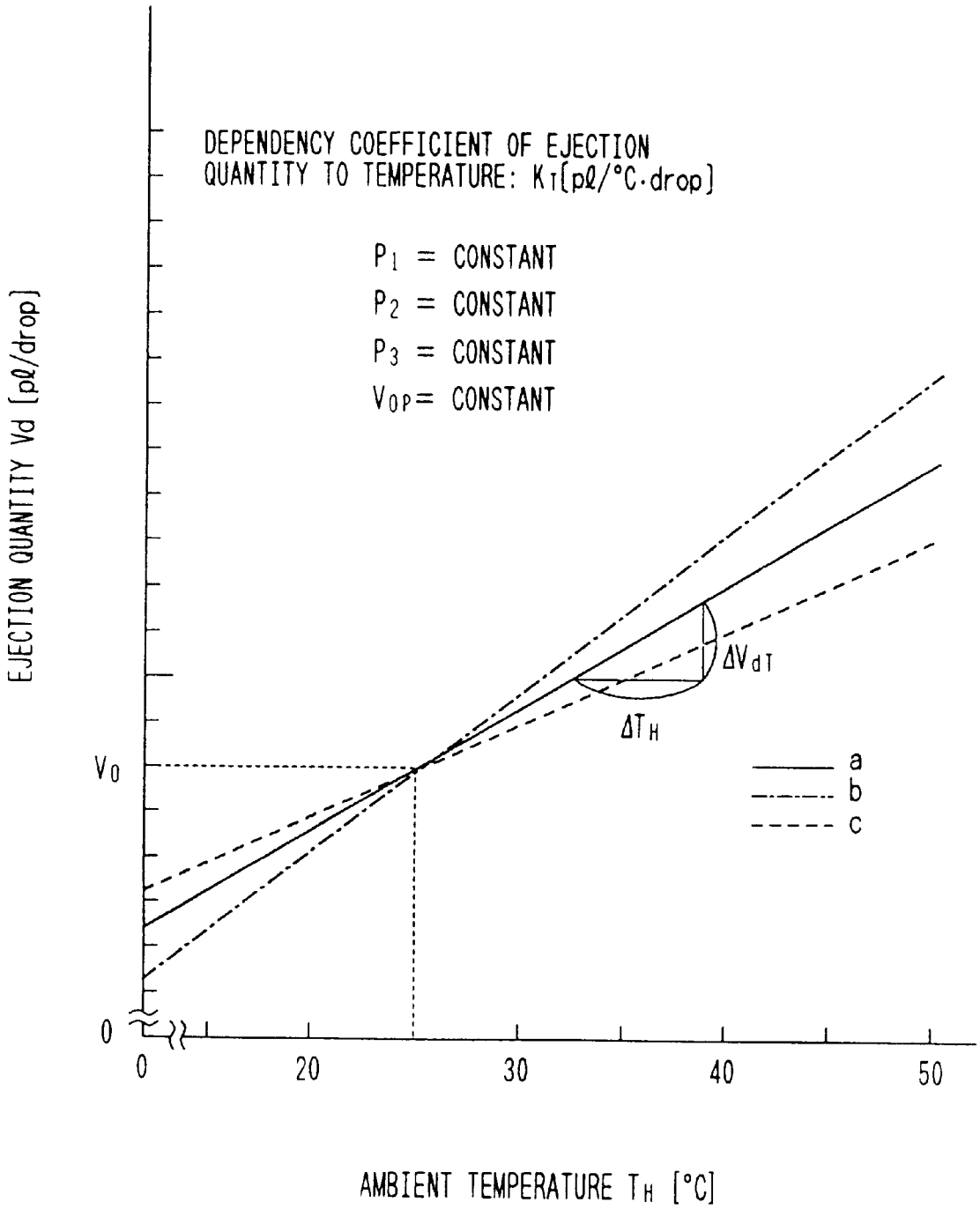
FIG. 27 is a diagram showing temperature dependence of ejection quantity.

FIG. 27 is a graph showing the temperature dependency of the ejection quantity. As indicated by a curve a in FIG. 27, the ejection quantity Vd linearly increases as an increase in the surrounding temperature $T_R$ of the recording head (equal to the head temperature $T_H$). When the inclination of this line is defined as a temperature dependency coefficient, the temperature dependency coefficient is given by:

$$KT=\Delta VdT/\Delta T_H[pl/°C.\cdot drop]$$

This coefficient KT is determined by the head structure, the ink physical property, and the like independently of the driving condition. In FIG. 27, curves b and c also represent the cases of other recording heads. For example, in the recording head of this embodiment, KT=0.3 [pl/°C.·drop].

As described above, the ejection amount control according to this embodiment can be performed by using the relationship as shown in FIGS. 26 and 27.

In the above example, PWM drive control with double pulses is described. However, the pulse can be multi-pulses such as, for example, triple pulses and the control can be a main pulse PWM drive system for which the width of the main pulse is modulated with a single pulse.

In this embodiment, the drive is controlled so that the PWM value is primarily set from a difference ($\Delta$T) between the above-described target temperature and the head temperature. The relationship between $\Delta$T and the PWM value is shown in FIG. 28.

In the drawing, "temperature difference" denotes the above $\Delta$T, "preheat" denotes the above P1, "interval" denotes the above P2, and "main" denotes the above P3. "setup time" denotes a time until the above P1 actually rises after a recording instruction is entered. (This time is mainly an allowance time until the rise of the driver and is not a value which shares an principal factor of the present invention). "weight" is a weight coefficient to be multiplied with the number of print dots to be detected to calculate the head temperature. In printing the same number of print dots, there will be a difference in the rise of head temperature between printing in the pulse width of 7 $\mu$s and printing in the pulse width of 4.5 $\mu$s. The above "weight" is used as means for compensating the difference of temperature rises along with modulation of the pulse width according to which PWM table is selected.

(Temperature Prediction Control)

This embodiment adopts the same temperature prediction control as that of the first embodiment, and the description thereof will be omitted.

Figure 29A:
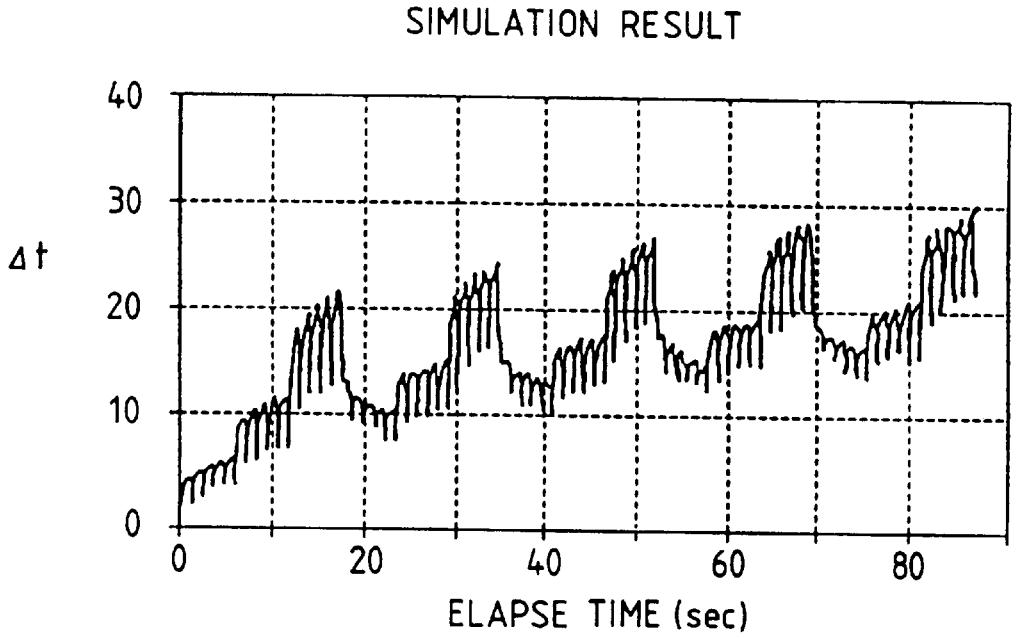
Figure 29B:
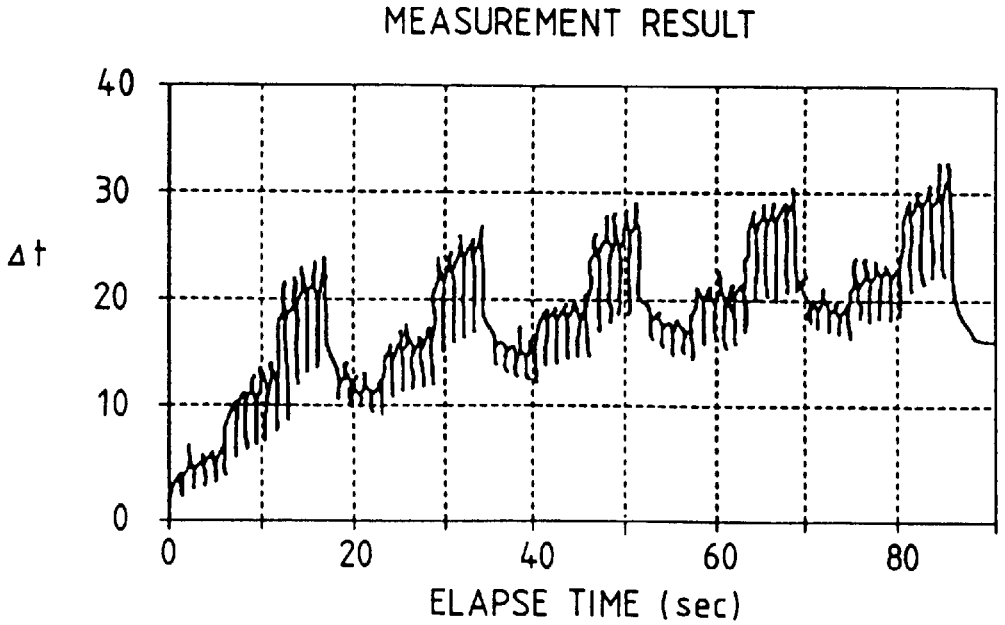

FIGS. 29A and 29B show the comparison of an actually sensed recording head temperature and a recording head temperature presumed by a head temperature calculation means by using the recording head structure described in the first embodiment. In FIGS. 29A and 29B:

where, the horizontal axis; elapse time (sec), the vertical axis; temperature rise (Δtemp), print pattern; (25%Duty*5Line+50%Duty*5Line+100%Duty*5Line)*5 times (print totals 75 lines)

FIG. 29A; a shifting of a recording head temperature presumed by the head calculation means FIG. 29B; a shifting of a actually sensed recording head temperature In FIGS. 29A and 29B, a fact that the head temperature can be accurately presumed by the calculation means is assured. However, the measurement shown in FIG. 29B, for convenience sake, was performed by using temperature sensors in the recording head after noticeable electrostatic steps are given.

However, as described above, there arises a problem that the scatter in the heat characteristic of the recording head causes various types of heads may be manufactured, which are different from each other, e.g., different in the ejection quantity by the scattering in manufacturing of the recording head, different in the released heat characteristic or in the heat conduction by the scattering of members (adhesive layer, and the like). Furthermore, in order to accelerate the processing of the calculation, the recording head is modeled by a smaller number of thermal time constants than that in practice, thus leading to errors. Since it is difficult for the calculated head temperature to correspond to entire heads, the case of using a certain head, as a result, may lead to an error between the sensed head temperature and the calculated head temperature. Furthermore, the error is increased in increase of the number of recording paper sheets, thus leading to a noticeable error.

For reducing the error, the calculated head temperature is corrected at a predetermined timing.

Assuming that the calculated head temperature is En, En is given by:

$$En=E\ BASE+\Delta temp,$$

where

E BASE; adopted base temperature,

Δtemp; calculated temperature rise.

when the sensed temperature by the temperature sensors of the recording head also assumes Sn, Sn−En represents the gap (error) of the calculated temperature and the sensed temperature.

However, as described above, if the electrostatic steps are not given, the temperature sensors can not sense the temperature of the recording head by noise generated by driving the ejection heater, the temperature control heater and the like. Therefore, the temperature of the recording head is sensed in the temperature sensors by using the ejection heater in which noise is relatively small, or when the temperature control heater is not driven, and then the error of the calculated temperature is corrected.

The correction of the error in the calculated temperature, as shown in the following formula, is performed to update the adopted base temperature by adding the error quantity (Sn−En) to the adopted base temperature E BASE (new)=E BASE (old)+(Sn−En)

Figure 30:
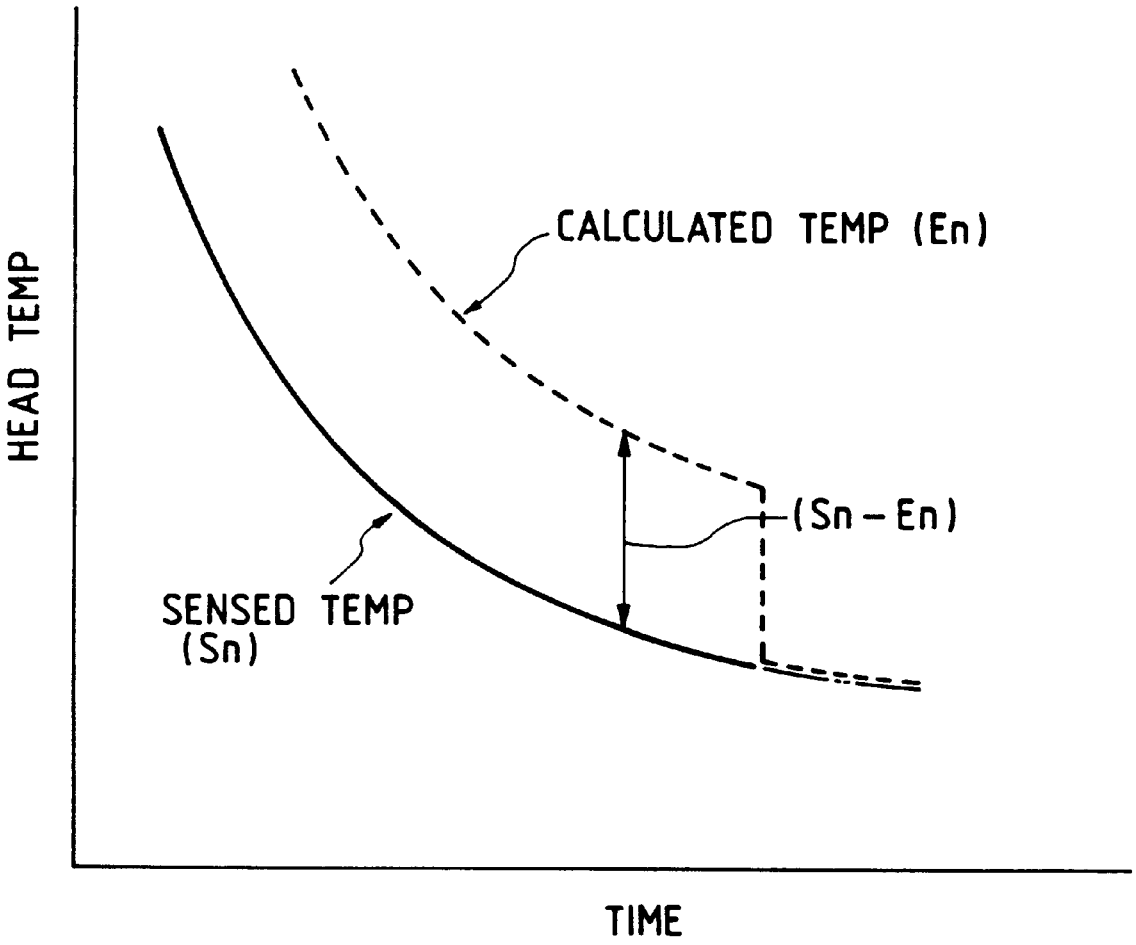
FIG. 30 is a diagram to explain error correction for calculated temperature by head initial temperature in the embodiment 9.

FIG. 30 shows the relationship between the sensed temperature and the calculated temperature when the correction was performed. In FIG. 30, the calculated temperature is corrected by shifting the error quantity (Sn−En).

In this embodiment, a value sensed in the temperature sensors obtained when a power source turns ON, is stored in a memory as a value of an adopted base temperature of the first recording head, and is used by updating the value before starting print.

(Overall Flow Control)

Figure 31:
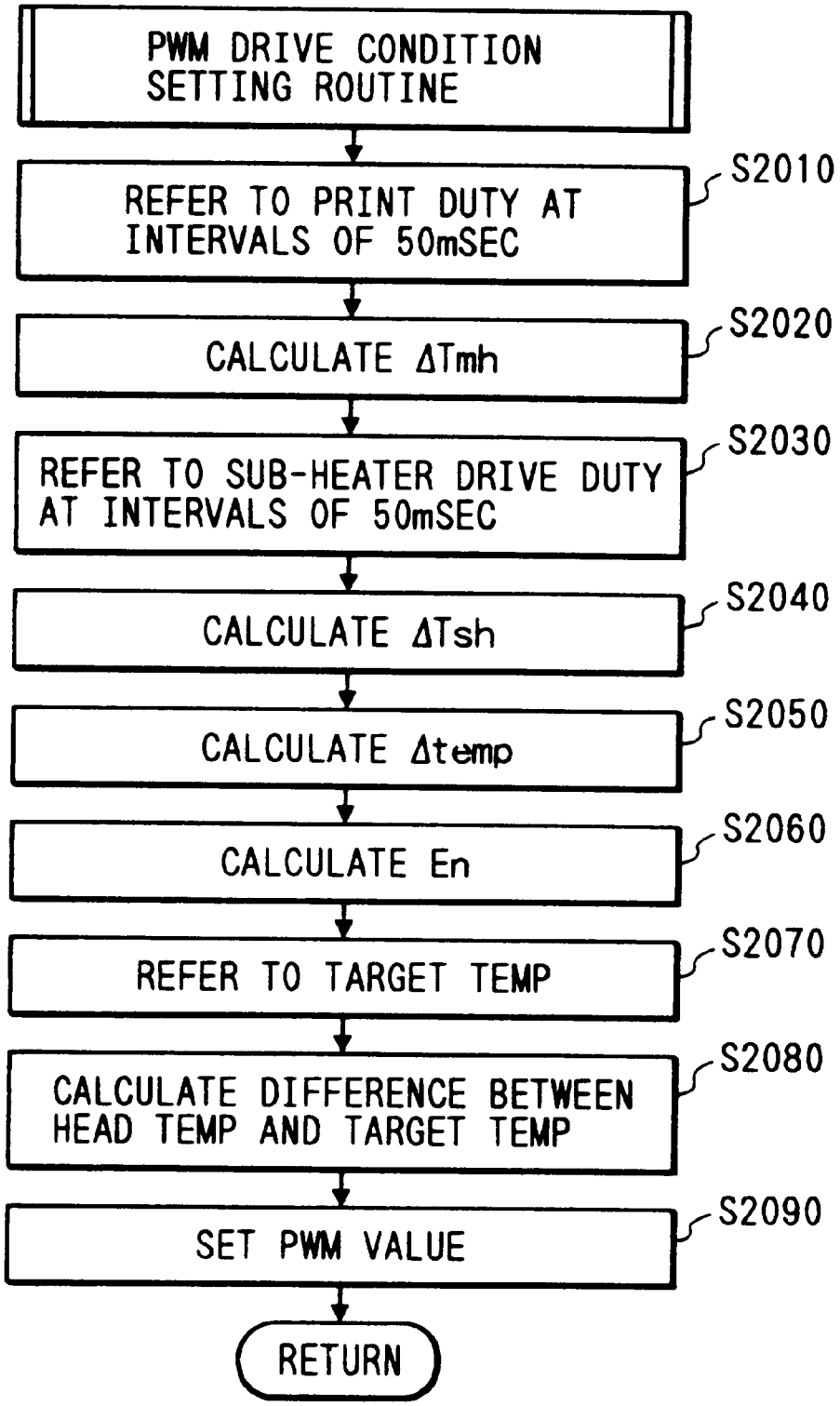
FIG. 31 is a flowchart showing the interrupt routine for setting a PWM driving value.
Figure 33:
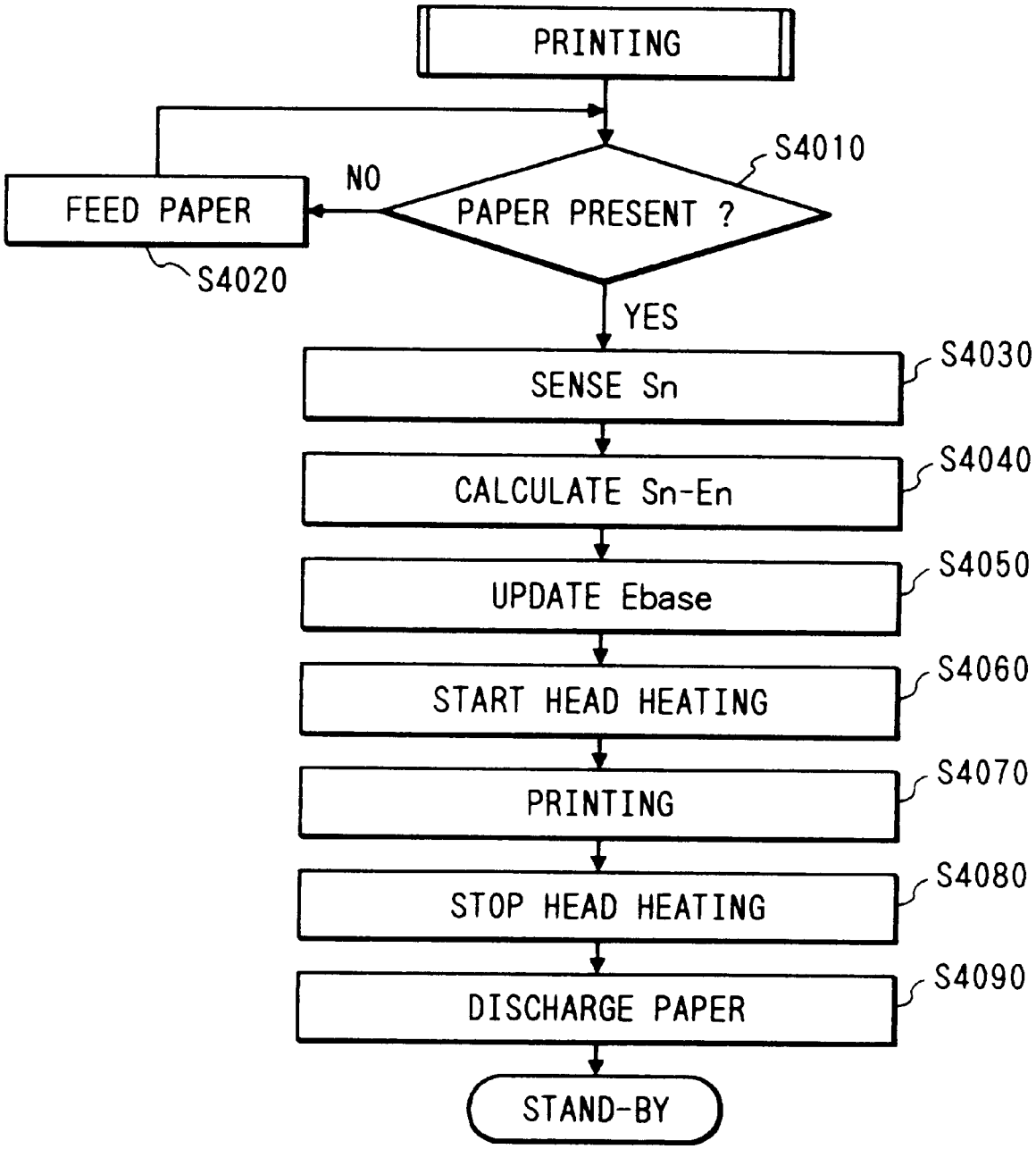
FIG. 33 is a flowchart showing error correction for presumed temperature in the embodiment 9.

The flow of the control system as a whole is described, referring to FIGS. 31 and 33.

FIG. 31 shows an interrupt routine for setting the PWM drive value and a sub-heater drive time for ejection. This interrupt routine occurs every 50 msec. The PWM value is always updated every 50 msec, regardless that the printing head is printing or idling and the drive of the sub-heater is necessary or unnecessary. If the interrupt of 50 msec is ON, the printing duty for 50 msec shortly before the interrupt is referred (S2010). However, the printing duty to be referred to in this case is represented by a value obtained by multiplying the number of dots for which ink has been actually ejected by a weight coefficient for each PWM value as described in (PWM control). From the duty for this 50 msec and the printing history for the past 0.8 seconds, the temperature rise (ΔTmh) of a group of components for which the heat source is the ejection heater and the time constants are of a short range is calculated (S2020). Similarly, the drive duty of the sub-heater for 50 msec is referred to (S2030), and the temperature rise (ΔTsh) of a group of components for which the heat source is the ejection heater and the time constants are of a short range is calculated from the drive duty of the sub-motor for 50 msec and the drive history of the sub-heater for 0.8 seconds (S2040). Then after referring to a temperature rise (ΔTmb) of a group of components for which the heat source is the ejection heater and the time constants are of a long range and a temperature rise (ΔTsb) of a group of components for which the heat source is the sub-heater and the time constants are of a long range, which temperature rises are calculated in the long-range temperature rise calculation routine, these values of temperature rises are summed to obtain the head temperature (Δtemp) (=ΔTmh+ΔTsh+ΔTmb+ΔTsb) (S2050).

Next, the calculated temperature is obtained by adding temperature rise Δtemp and an adopted base temperature E BASE of the head (S2060). On this moment, the adopted base temperature E BASE of the head is used as the updated one by a main routine described later.

After that, a target temperature is set by a target temperature table (S2070), calculating the temperature difference (ΔT) between the head temperature and the target temperature (S2080). Then, a PWM value for an optimum head drive condition according to the head temperature is set by the temperature difference ΔT, and the PWM table, and the sub-heater table (S2090). Finally, the sub-heater is driven to keep the head temperature in the temperature control state.

Figure 32:
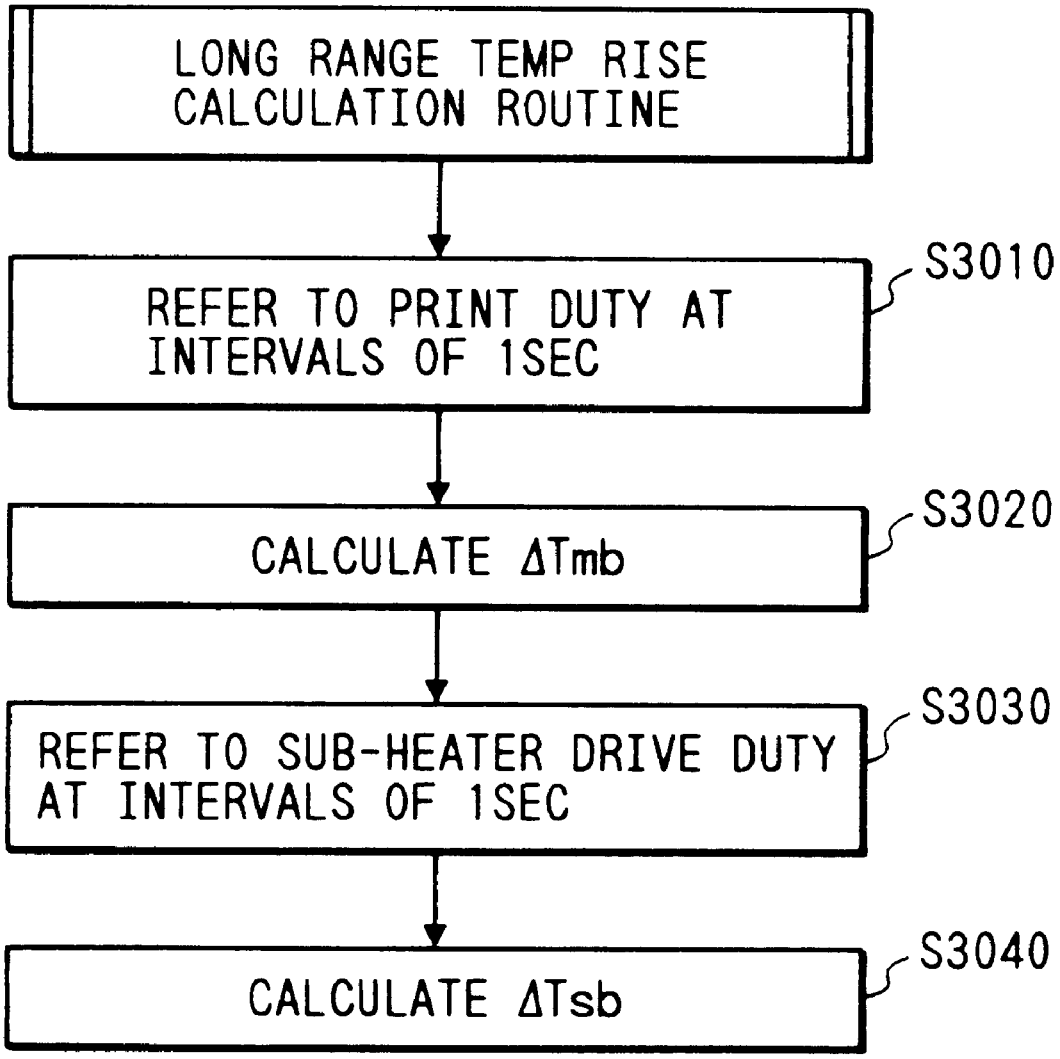
FIG. 32 is a flowchart showing the interrupt routine for long-range temperature rise calculation.

FIG. 32 shows a long range temperature rise calculation routine. This is a interrupt routine performed at the intervals of 1 sec, and the printing duty for the past one second is referred to (S3010). The printing duty is a value obtained by multiplying the number of dots for actual ejection by the weight coefficient for each PWM value as described in (PWM Control). A temperature rise (ΔTmb) of a group of components for which the heat source is the ejection heater and the time constants are of a long range is calculated from the printing history in the duty of one second and the past 512 seconds and stored as updated at a specified location of the memory (S3020) so that it can be easily referred to for the interrupt of every 50 msec. Similarly, the drive duty of the sub-heater for one second is referred to (S3030), and a temperature rise (ΔTsb) of a group of components for which the heat source is the sub-heater and the time constants are of a long range is calculated from the printing history in the duty of one second and the past 512 seconds. As in the case of the temperature rise ΔTmb, the temperature rise ΔTsb calculated as above is stored as updated at a specified location of the memory so that it can be easily referred to for the interrupt of every 50 msec (S3040).

FIG. 33 shows a operational flow for correcting the error between the calculated temperature and the sensed temperature of the recording head in this embodiment. When a print signal is input, a print sequence is performed. Firstly, the presence of a paper is checked (S4010), if no paper, a paper is fed (S4020). Next, the head temperature Sn is sensed by the temperature sensors provided in the recording head (S4030). On this time, since both the ejection heater and the sub-heater are not driven, the head temperature can be steadily sensed. The sensed temperature is compared with the calculated temperature to calculate the error (Sn−En) (S4040). In order to correct the gap (error), the adopted base temperature is updated by adding the gap to the former adopted base temperature of the head (old E BASE+(Sn−En)), thus corresponding the sensed temperature to the calculated temperature (S4050). After that, the calculated temperature is calculated by using the updated adopted base temperature. That is, if the head calculated temperature is lower than that in the temperature control state, head heating is performed (S4060), and the print is performed together with the ejection quantity control according to the PWM drive condition setting routine shown in FIG. 31 (S4070). After completing the print, the head heating is stopped (S4080), a recording medium (paper) is ejected (S4090), and the recording head returns in a waiting state.

As described above, the correction of the gap between the calculated temperature and the sensed temperature can be performed by using the ejection heater in which the temperature sensors can steadily work, or when the sub (heating) heater is not driven. When the correction is performed immediately after the ejection heater or sub-heater was stopped, for the large temperature change, the gap is not converged to a certain condition even if the correction is performed by measuring the gap between the sensed temperature providing a slow response obtained by shifting average of plural times and the calculated temperature providing a sharp response. Furthermore, there may be the case that the gap is further enlarged. Therefore, it is preferable to correct the gap by performing the gap comparison of the sensed temperature and the calculated temperature after an interval (0.8 sec in this embodiment) until a short-range thermal past record in a small time constant at least disappears after stopping the ejection heater or sub-heater, more preferably, after the elapse of a few seconds.

In this embodiment, correction timing is set before starting the print, thus obtaining effects as follows:

(1) since a few seconds is required for feeding and ejecting a recording paper sheet, the processing time can not be affected;

(2) since the head temperature before starting recording print s relatively in a small state of change, even sensed temperature providing a slow response obtained by shifting average of plural times can not be affected;

(3) since the correction is performed after the elapse of a few seconds or more after stopping the input of heat energy, a temperature change having a small thermal time constant can be ignored, i.e., the temperature change is relatively in a small state, thus easily correcting the gap between the sensed temperature and the calculated temperature; and (4) since the accuracy of head calculated temperature data is important especially during drive of the ejection heater and the sub-heater, it would be better to perform the correction immediately before drive of the ejection heater and the sub-heater.

But, the correction may be effected in a predetermined time period after stop of supply of thermal energy, or repeated plural times for enhancement of precision.

Figure 34:
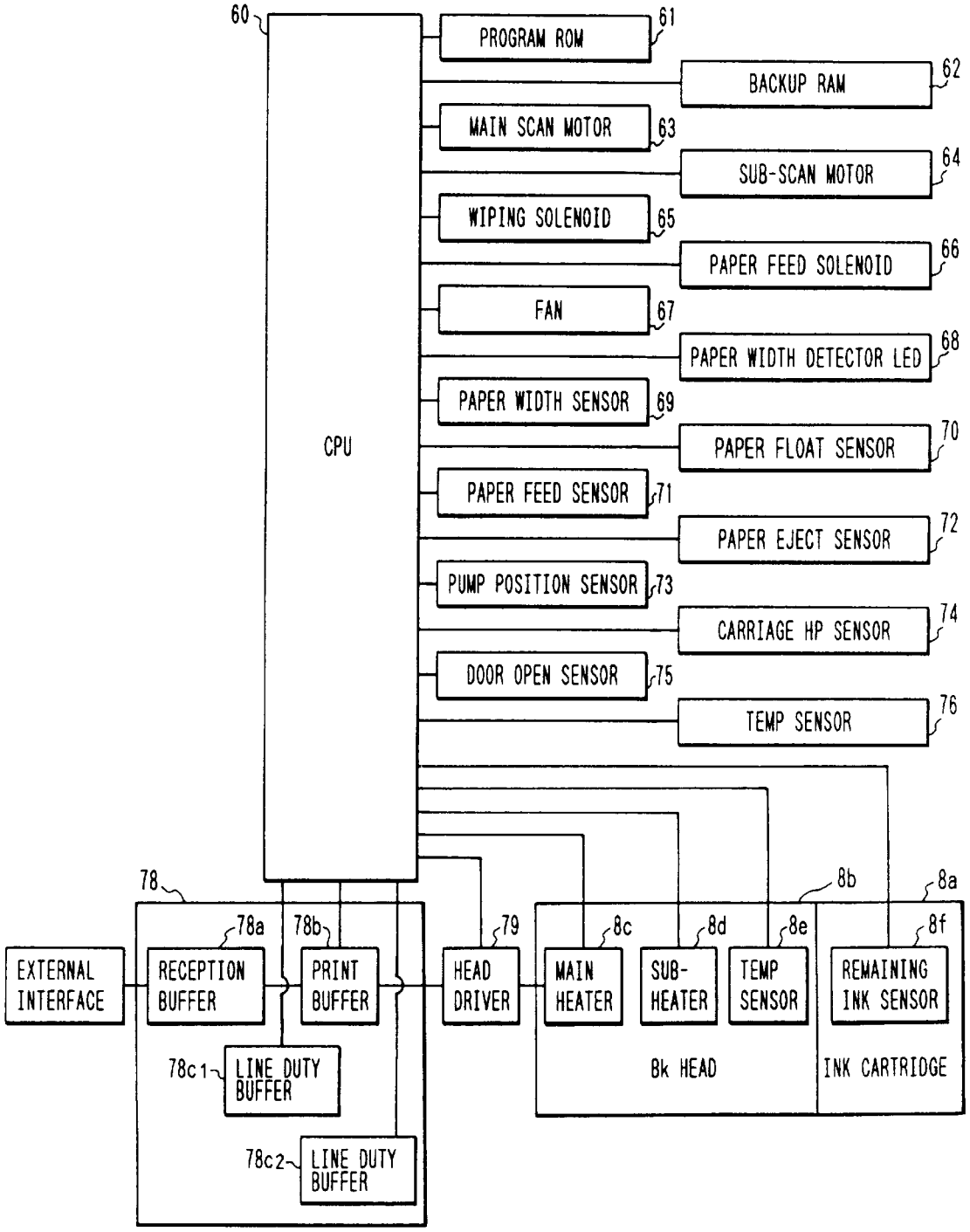
FIG. 34 is a block diagram showing the control arrangement for executing the recording control flow.

FIG. 34 shows a control structure for performing a recording control flow according to this embodiment.

In FIG. 34, a CPU 60 is connected to a program ROM 61 for storing a control program executed by the CPU 60, and a backup RAM 62 for storing various data. The CPU 60 is also connected to a main scan motor 63 for scanning the recording head, and a sub-scan motor 64 for feeding a recording sheet. The sub-scan motor 64 is also used in the suction operation by the pump. The CPU 60 is also connected to a wiping solenoid 65, a paper feed solenoid 66 used in paper feed control, a cooling fan 67, and a paper width detector LED 68 which is turned on in a paper width detection operation. The CPU 60 is also connected to a paper width sensor 69, a paper flit sensor 70, a paper feed sensor 71, an paper eject sensor 72, and a suction pump position sensor 73 for detecting the position of the suction pump. The CPU 60 is also connected to a carriage HP sensor 74 for detecting the home position of the carriage, a door open sensor 75 for detecting an open/closed state of a door, and a temperature sensor 76 for detecting the surrounding temperature.

The CPU 60 is also connected to a gate array 78 for performing supply control of recording data to the four color heads, a head driver 79 for driving the heads, the ink cartridges 8*a* for four colors, and the recording heads 8*b*. FIG. 34 representatively illustrates the Bk (black) ink cartridge 8*a* and the Bk recording head 8*b*. The ink cartridge 8*a* has a remaking ink sensor 81 for detecting a residual quantity of the ink. The head 8*b* has main heaters 8*c* for ejecting the ink, sub-heaters 8*d* for performing temperature control of the head, and temperature sensors 8*e* for detecting the head temperature.

In FIG. 34, recording signals, and the like sent through an external interface are stored in a reception buffer 78*a* in the gate array 78. The data stored in the reception buffer 78*a* is developed to a binary signal (0,1) indicating "to eject/not to eject", and the binary signal is transferred to a print buffer 78*b*. The CPU 60 can refer to the recording signals from the print buffer 78*b* as needed.

Two line duty buffers 78*c* are prepared in the gate array 78. Each line duty buffer stores print duties (rations) of areas obtained by dividing one line at equal intervals (into, e.g., 35 areas). The "line duty buffer 78*c*1" stores print duty data of the areas of a currently printed line. The "line duty buffer 78*c*2" stores print duty data of the areas of a line next to the currently printed line. The CPU 60 can refer to the print duties of the currently printed line and the next line any time, as needed. The CPU 60 refers to the line duty buffers 78*c* during the above-mentioned temperature prediction control to obtain the print duties of the areas. Therefore, the calculation load on the CPU 60 can be reduced.

In this embodiment, although the PWM of a double-pulse, or a single-pulse is used for controlling the ejection quantity and the head temperature, a PWM of a triple-pulse may be used. Furthermore, when a head chip temperature is higher than the print target temperature and can not be fallen in spite of being driven by a PWM providing small energy, a scan speed, or a scan starting timing of the carriage may be controlled.

This embodiment is not required to provide complete electrostatic steps, and can properly correct the error between the sensed temperature and the calculated temperature by using the temperature sensors without accumulating the gap of the calculated temperature even if any recording heads having various types of heat characteristics are used. Therefore, since an accurate temperature detection having a good response quality is obtained, various types of head controls can be performed before actual print, thus performing more suitable recording. Furthermore, the model is simplified, and the calculation algorithm is an accumulation of easy calculations, thus also simplifying the prediction control. Each constant used in this embodiment, e.g., a cycle of temperature prediction (50 msec intervals, and 1 sec intervals) and the like, is an example, and the present invention is not limited to those constants.

In this embodiment, although the adopted base temperature of the recording head was updated by adding the error quantity (Sn−En) to the adopted base temperature of the recording head (E BASE), the adopted base temperature can be updated by multiplying the error quantity (Sn−En) by an experiential coefficient $\alpha$ (<1) to prevent an excessive correction as shown the following formula.

$$E\ BASE(new)=E\ BASE(old)+\alpha(Sn-En)$$

Furthermore, although this embodiment explained the case that only one recording head was used, it is understood that the present invention is not limited to this embodiment. For example, the present invention can be further effective in a color ink jet recording apparatus providing with a plurality of recording heads, because, in the ink jet recording apparatus having a plurality of recording heads, the sensed temperature becomes higher than the calculated temperature by conducted heat from other recording heads. As the number of recording heads increases, it is difficult to calculate conducted heat of various types, and the accumulation of errors also becomes large. Therefore, if the adopted base temperature of the recording head is updated by the above-mentioned method before print recording, the errors can be reduced and the accurate head control can be obtained.

(Tenth Embodiment)

The error of the head calculated temperature is also led during the suction recovery operation using a suction pump. Since the ink pumped up through a nozzle of the recording head takes heat away, the recording head is subject to the temperature change. The change quantity is changeable by differences of the ink temperature or the pumped ink quantity, and it is difficult to predict.

Figure 35:
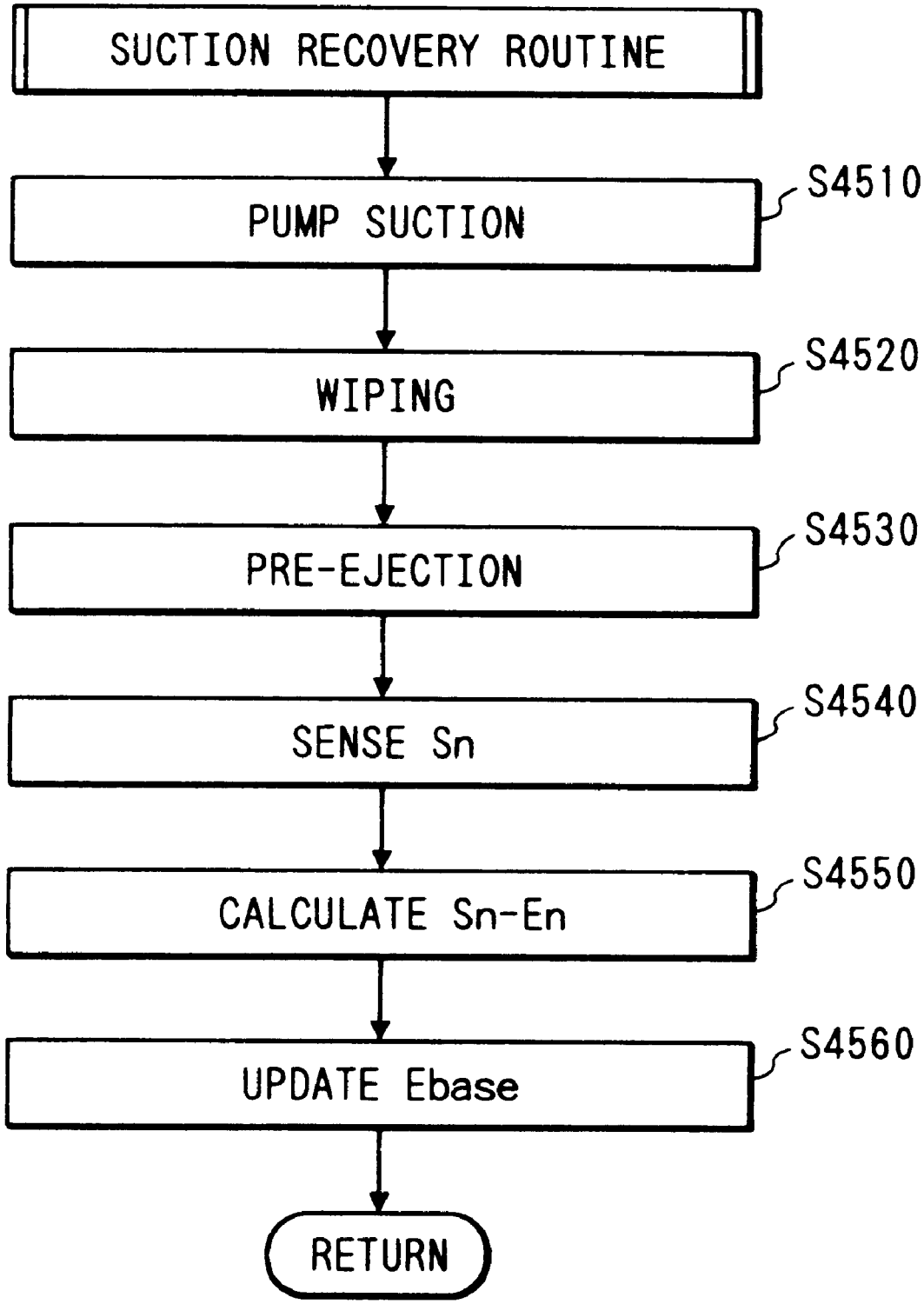
FIG. 35 is a flowchart showing error correction for presumed temperature in the embodiment 10.

FIG. 35 shows a correction flow of a calculated temperature according to this embodiment. According to a suction recovery instruction, a carriage is transferred to the home position for capping the recording head, and the suction of the recording head is performed by a suction means communicated with a cap (S4510). Then, an ejection orifice surface of the recording head is wiped by a cleaning blade (S4520), pre-ejection is performed (S4530). Next, the head temperature Sn is sensed by a temperature sensor provided in the recording head (S4540). Since the suction recovery operation requires more than a few seconds, and both an ejection heater and a sub-heater are not in a driving state on this moment, the temperature sensor can be steadily sensed. The temperature sensed by the sensor is compared with the calculated temperature, and the error is calculated (S4550). In order to correct the gap (error), the adopted base temperature is updated by adding the gap to the adopted base temperature, and the sensed temperature and the calculated temperature are corresponded to each other (S4560). After that, the calculated temperature is calculated by using the updated adopted base temperature. Therefore, even if the suction recovery operation is performed during the print recording, the print recording can be performed again after the temperature change generated by the ink suction, so that the head driving control can be obtained by further accurate calculated temperature.

In addition to the sequence of this embodiment, an ink slip check operation of whether the ink is filled in a ink chamber of the head heating or recording head, and the like may be inserted. The ink slip detection performs a predetermined number of ink ejection (pre-ejection) and then, senses temperature rise. If the ink is filled in the ink chamber, temperature rise appearers within a threshold. On the other hand, if the ink is not filled in the ink chamber, temperature rise appears over the threshold. In this manner, the ink slip is detected by sensing temperature rise. That is, lack of ink causes an error between the sensed temperature and the calculated temperature because of differences of stored heat quantities therebetween, so that it can be effective to correct the error between the sensed temperature and the calculated temperature after the ink slip detection.

(Eleventh Embodiment)

Figure 36:
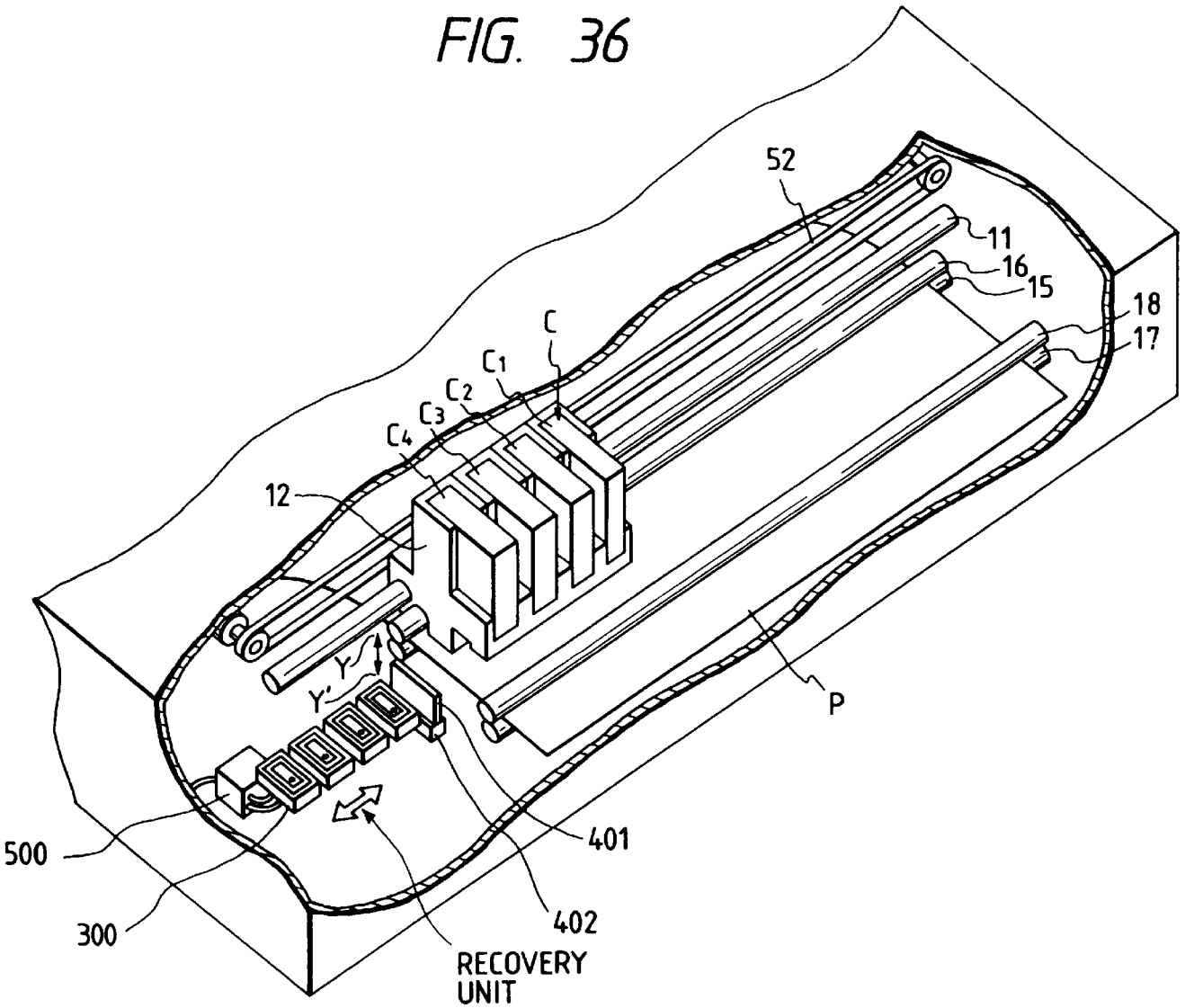
FIG. 36 is a perspective view illustrating the arrangement of the ink-jet recording apparatus applied for the embodiment 11.

FIG. 36 is a schematic diagram of an ink jet recording apparatus applied in the present invention. In FIG. 36, ink jet cartridges C respectively have ink tank portions in the upper side thereof and recording head portions in the lower side thereof, and respectively provide connectors for receiving signals which drive the recording heads. A carriage 12 locates and arranges four cartridges C1, C2, C3 and C4 (each cartridges is filled with different color, such as black, cyan, magenta and yellow). The carriage 12 provides a connector holder for transmitting signals and the like, which drive the recording heads, and is electrically connected with the recording heads. A scan rail 11 is extended in the main scan direction of the carriage 12, and supports the carriage 12 which is slidable therefor. A driving belt 52 transmits driving force to the carriage 12 for reciprocating motion. A pair of carrier rollers 15,16 and 17, 18 hold and carry a recording medium P arranged across the recording position of the recording heads. The recording medium P such as a paper sheet is pressed against a platen (not shown) for controlling the recorded surface of the recording medium to be plane. The recording portions of the ink jet cartridges C arranged on the carriage 12 is jutted downward from the carriage 12, is located between the recording medium carrier rollers 16 and 18. Each surface of the recording head portions, on which an ejection orifice is formed, parallelly faces to the recorded medium P pressed on a guide surface of the platen (not shown).

In the ink jet recording apparatus of this embodiment, a recovery system unit is set to the home position side shown in the right hand side of FIG. 36. In the recovery system unit, cap units 300, respectively correspond to a plurality of ink jet cartridges C having the recording heads, which is slidable in the right and left sides of FIG. 36 in response to movement of the carriage 12, and also movable in the upper and lower sides. When the carriage is set to the home position, the carriage is joined to the recording head portions for capping the recording heads, so that the ink in the orifices of the recording heads can not be evaporated, thus preventing the recording head from poor ejection generated by increased viscosity and adhesion of the ink.

A pump unit 500 communicates with the cap units 300 in the recovery system unit. If the recording heads should be subjected to poor ejection, the pump unit 500 is used for generating the negative pressure in case of the suction recovery operation which is performed by joining the cap units 300 and the recording heads.

Furthermore, in the recovery system unit, a blade 401 is formed of an elastic material such as rubber as a wiping member, and a blade holder 402 holds the blade 401.

In the four ink jet cartridges mounted with the carriage 12, the cartridges C1, C2, C3 and C4 is respectively filled with a black (to be abbreviated to as K hereinafter) ink, a cyan (to be abbreviated to as C hereinafter) ink, a magenta (to be abbreviated to as M hereinafter) ink, and a yellow (to be abbreviated to as Y hereinafter) ink. The inks overlap each other in this order. Intermediate colors can be realized by properly overlapping C, M, and Y color ink dots. More specifically, red can be realized by overlapping M and Y; blue, C and M; and green, C and Y. Black can be realized by overlapping three colors C, M and Y. However, since black realized by overlapping three colors C, M and Y has poor color development and precise overlapping of three colors is difficult, a chromatic edge is formed, and the ink implantation density per unit time becomes too high. For these reasons, only black is implanted separately (using a black ink).

As described above, since scattering generated by differences of each recording head in a thermal time constant, in a heat efficiency during ejection, and the like can not be avoided, temperature rise against input energy is changeable. In this embodiment, in the ink jet recording apparatus providing such a plurality of recording heads, each heat characteristic of the heads is sensed. When the recording heads have exchangeable structures, each heat characteristic of the heads is sensed at the time of exchange.

As mentioned above in the paragraph of a recording head temperature calculation algorithm, the main body of the recording apparatus has an ejection heater and a calculation table (temperature reduction data) for the sub-heater for temperature calculation. This calculation table contains temperature changes of the recording head at a constant interval of time (way of heat transmission as viewed from a Di sensor). In actuality, the way of joining between members of a recording head, an ejection quantity, a dispersion in a main unit power supply for heater drive, etc. cause the contents of the calculation table to vary for each recording head. Therefore, temperature data of the recording heads, which are different in the heat conduction, are sensed, and calculation tables for the ejection heater and sub-heater are prepared in every temperature data.

In this embodiment, temperature changes are divided into three patterns for easy-to-accumulate-heat recording heads through hard-to-accumulate-heat heads, and corresponding three calculation tables mentioned above are provided.

For easy-to-accumulate-heat heads, because of high increased temperatures, values in the table are rather large even when an identical energy (duty) is applied. On the contrary, for hard-to-accumulate-heat heads, because of quick radiation of heat, values in the table are rather small. A center table 2 indicative of central conduction of heat for recording heads is provided between a large-temperature-change table 3 (easy to accumulate heat) and a small-temperature-change table 1 (hard to accumulate heat).

Measurement of sub-heater thermal characteristics is intended to select a table. A duty (energy) decided in advance is input to the ejection heater and sub-heater. The temperature change of the Di sensor obtained on this moment is sensed before and after inputting such energy. Then, the value of the temperature change is compared with a predetermined threshold. When a target recording head is easy to accumulate heat, a measurement value will be greater than a threshold 2; hence, the large-temperature-change table 3 is selected as a calculation table. On the contrary, if a measurement value is smaller than a threshold 1, the small-temperature-change table 1 is selected on the assumption that a head is hard to accumulate heat. Also, if the above mentioned measurement value falls between the threshold 1 and the threshold 2, the center table 2 is selected on the assumption that a head is a standard recording head.

Table 1: measurement value<threshold 1

Table 2: threshold 1≦measurement value≦threshold 2

Table 3: threshold 2<measurement value In this manner, since the temperature reduction table is set in the heat characteristic of each recording head, the calculation is more accurately performed than the case that is set in the heat characteristic of entire recording heads, thus obtaining further effects, e.g., of reducing the calculation load, and the like.

By adopting the heat characteristic correction means, the difference between the sensed temperature and the calculated temperature of the recording head, which is caused by scattering in the heat characteristic during driving the ejection heater and sub-heater, can be reduced from start.

In addition to this, the correction is performed not to accumulate the error at a predetermined timing.

Assuming that the calculated head temperature is En, En is given by:

$$En = E\ BASE + \Delta temp,$$

where

E BASE; adopted base temperature,

Δtemp; calculated temperature rise.

when the sensed temperature by the temperature sensors of the recording head also assumes Sn, Sn−En represents the gap (error) of the calculated temperature and the sensed temperature.

However, as described above, if the electrostatic steps are not given, the temperature sensors can not sense the temperature of the recording head by noise generated by driving the ejection heater, the temperature control heater and the like. Therefore, the temperature of the recording head is sensed in the temperature sensors by using the ejection heater in which noise is relatively small, or when the temperature control heater is not driven, and then the error of the calculated temperature is corrected.

The correction of the error in the calculated temperature, as shown in the following formula, is performed to the update adopted base temperature by adding the error quantity (Sn−En) to the adopted base temperature (E BASE).

$$E\ BASE\ (new) = E\ BASE\ (old) + (Sn - En)$$

The correction can be performed at timings before starting the print recording and after completing the recovery operation.

(Twelfth Embodiment)

This embodiment shows another correction method for detecting a calculated temperature. Although the ninth and the tenth embodiments correct the calculated temperature by adding the error quantity to the adopted base temperature E BASE, this embodiment corrects the calculated temperature by processing temperature rise. (Case of Sensed Temperature>Calculated Temperature)

Figure 37:
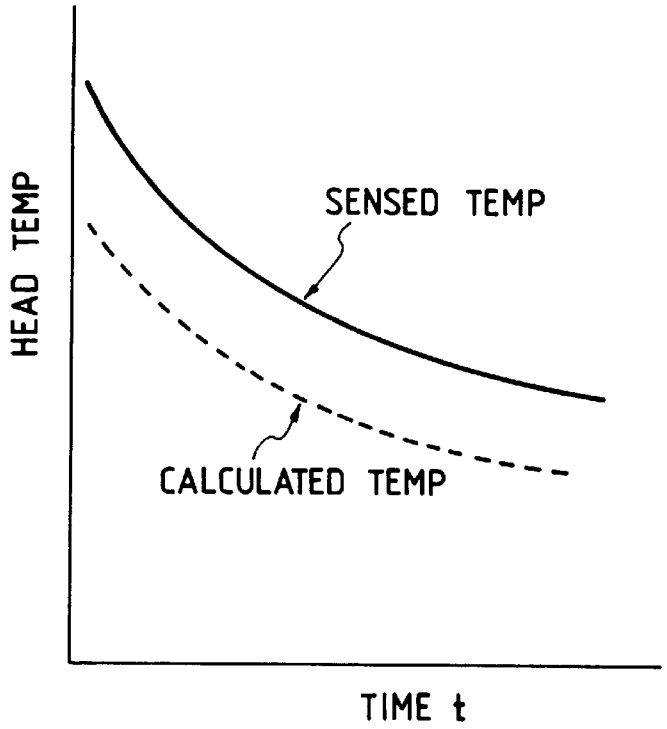
FIGS. 37 to 41 are diagrams for explaining operations in the embodiment 12.
Figure 38:
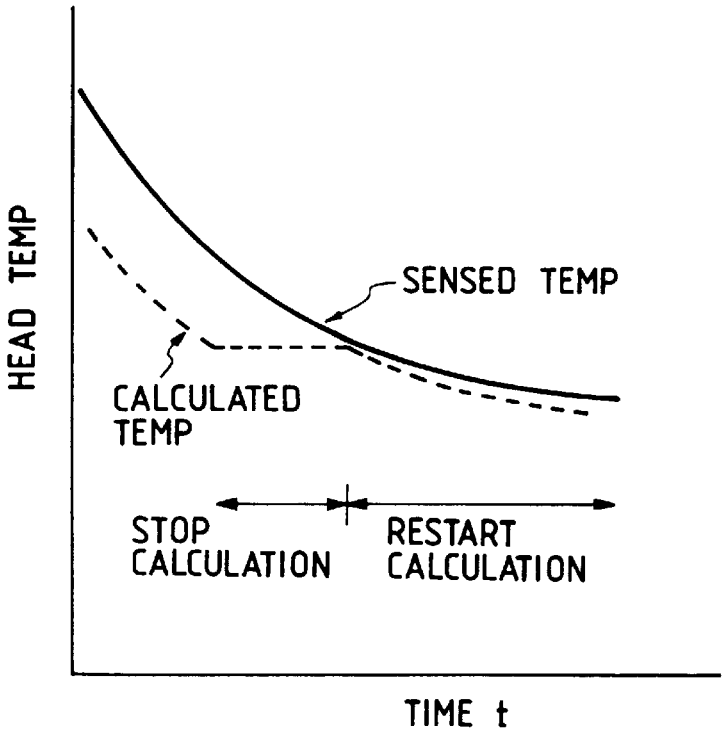

In FIGS. 37 and 38, the calculated temperature is lower than the sensed temperature, FIG. 37 shows a case that the correction processes are not performed, and FIG. 38 shows a case that the correction processes are performed.

As shown in FIG. 37, if a gap (error) is not corrected, the error affects later sequence. Therefore, when the recording is not performed (during not driving both the ejection heater and sub-heater), the calculation of the head temperature is stopped on the way to calculation until the sensed temperature is reduced as shown in FIG. 38. Then, the calculation of the head temperature is restarted after the difference between the sensed temperature and the calculated temperature becomes within a predetermined value (e.g., within ±1 deg).

Figure 39:
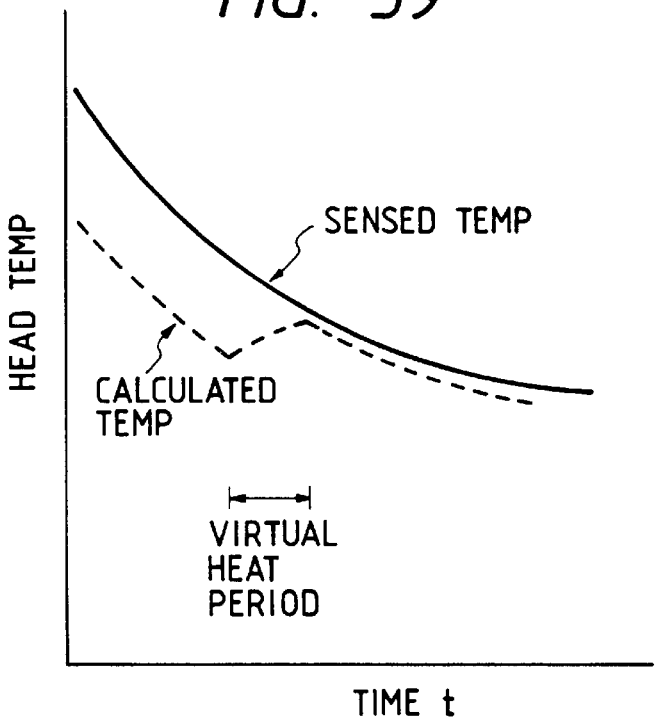

As shown in FIG. 39, though the recording is not performed, a virtual print duty can be added instead of an actual print until the difference between the sensed temperature and the calculated temperature becomes within a predetermined value. On this moment, the virtual print duty may be set to be changeable according to the difference in temperature, and only the long range quantity of the virtual print duty may be added, without adding the short range one.

(Case of Sensed Temperature<Calculated Temperature)

Figure 40:
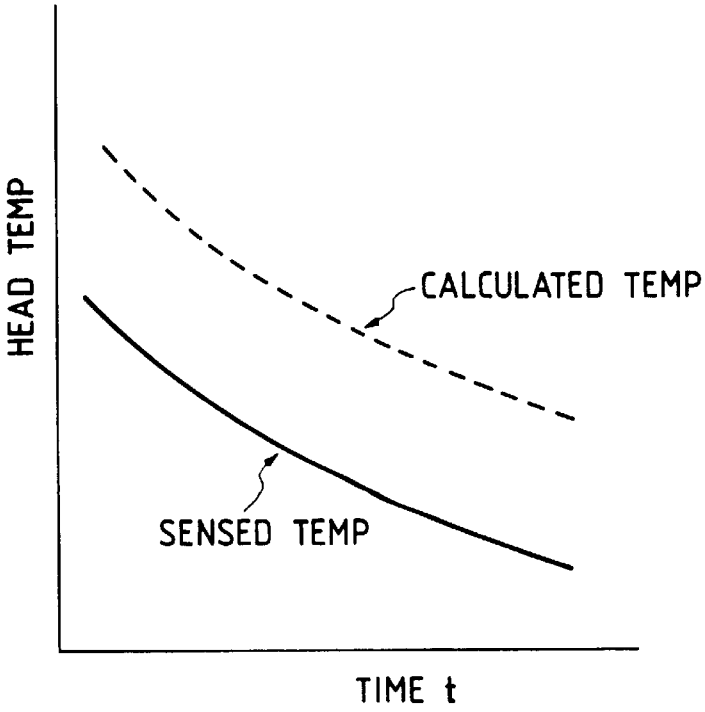
Figure 41:
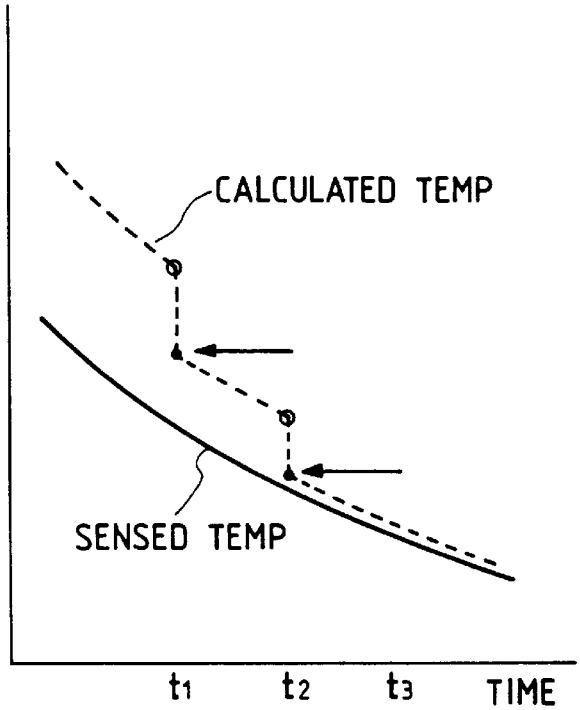

In FIGS. 40 and 41, the calculated temperature is higher than the sensed temperature, FIG. 40 shows a case that the correction processes are not performed, and FIG. 41 shows a case that the correction processes are performed. This case brings the calculated temperature close to the sensed temperature by pre-shift (skip) calculation of the calculated temperature, and the operation is performed until the difference between the sensed temperature and the calculated temperature becomes within a predetermined value. That is, the calculation is skipped, e.g., where the calculated temperature at time t1 is set as the calculated temperature at time t2, and the calculated temperature at time t2 is set as the calculated temperature at time t3.

On this moment, the skip quantity may be changed according to the difference in temperature to accelerate the correction.

As described above, according to the ninth to twelfth embodiments of the present invention, the recording head temperature is presumed by calculating the recording head temperature against the input energy supplied for the calculation. Then, the sensed temperature is referred before print recording start and/or after recovery operation completion, in which the recording head is thermally in a steady state to be detected. The accumulation of errors is, finally, prevented by properly correcting the gap between the calculated temperature and the actually sensed head temperature. In this manner, the ink jet recording apparatus, in which the driving control for steadily performing ejection of the recording head by using the highly accurate calculated temperature, can be realized without complete electrostatic steps given to the temperature sensors provided in the recording head.

(Thirteenth Embodiment)

Figure 42:
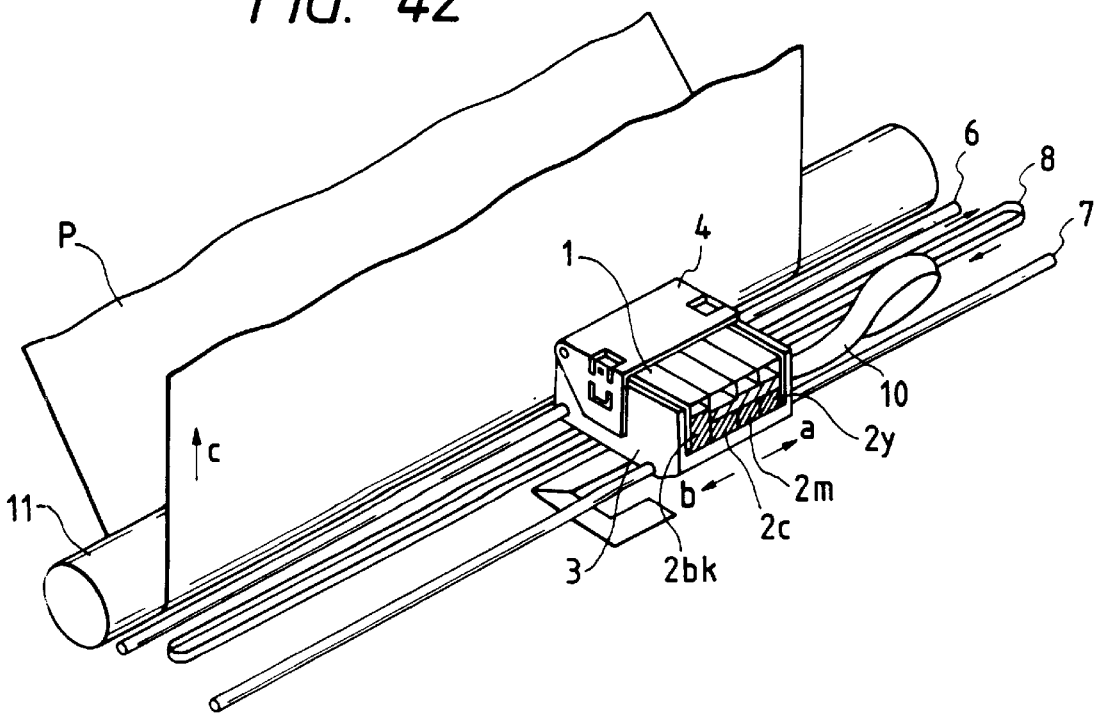
FIG. 42 is a perspective view illustrating the whole recording apparatus.

FIG. 42 illustrates a serial type ink jet color printer using the present example. Recording heads 1 are each a device which is provided with a plurality of nozzle rows and adapted to record an image by ejecting ink droplets through the nozzle rows and causing the ink droplets to land on a recording medium 8 and form ink dots thereon. (In the diagram, the components mentioned are covered by a recording head fixing lever and are not directly indicated.) In the present example, a plurality of printing heads jointly form each of the recording heads 1 so as to permit ejection of ink droplets of a plurality of colors as will be described more specifically hereinbelow. Inks of different colors are ejected from different printing heads and a color image is formed on the recording medium P owing to the mixture of such different colors of the ink droplets.

Print data are transmitted from an electric circuit of the printer proper to the printing heads through the medium of a flexible cable 10. Printing head rows 1K (black), 1C (cyan), 1M (magenta), and 1Y (yellow), in the construction of this diagram, are formed by the collection of recording heads severally assigned to the four colors. The recording heads 1 are freely attachable or detachable to a carriage 3. In the forward scan, the inks of different colors mentioned above are ejected in the order mentioned. In the formation of red (hereinafter referred to as R), for example, magenta (hereinafter referred to as M) is ejected to land on the recording medium P first and then yellow (hereinafter referred to as Y) is ejected to land on the previously formed dots of M, with the result that red dots will consequently appear. Likewise, green (hereinafter referred to as G) is formed by causing C and Y to land on the recording medium P and blue (hereinafter referred to as B) C and M to land thereon respectively in the order mentioned. The printing heads are arrayed at a fixed interval (P1). The formation of a solid G print, therefore, requires Y to land on the recording medium with a time lag of 2*P1 following the landing of C thereon. Thus, a solid Y print is superposed on a solid C print.

The carriage 3 has the motion thereof in the direction of main scan controlled by unshown position sensing means detecting continuously the scanning speed and the printing position of the carriage. The power source for the carriage 3 is a carriage drive motor. The carriage 3, with the power transmitted thereto through the medium of a timing belt 8, is moved on guide shafts 6 and 7 in the direction of arrow a-b. The impression of prints proceeds during the motion of the carriage 3 for main scan. The printing action in the vertical direction selectively effects unidirectional printing and bidirectional printing. Generally the unidirectional printing produces a print only during the motion of the carriage away (the forward direction) from the home position thereof (hereinafter referred to as HP) and not during the motion thereof toward the HP (the backward direction). Thus, it produces a print of high accuracy. In contrast thereto, the bidirectional printing produces a printing action in both the forward and the backward direction. It, therefore, permits high-speed printing.

In the sub-scan direction, the recording medium P is advanced by a platen roller 11 which is driven by a paper feed motor not shown in the diagram. After the paper fed in the direction indicated by the arrow C in the diagram has reached the printing position, the printing head rows start a printing action.

Figure 43:
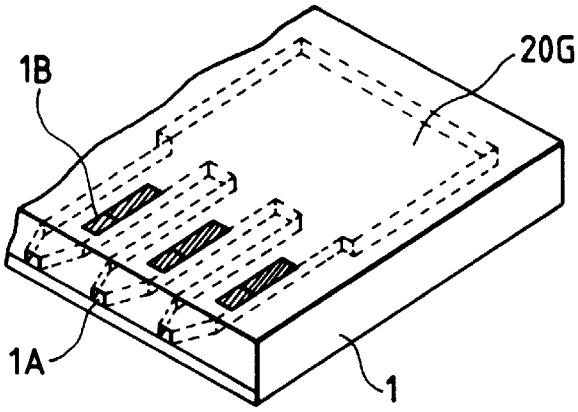
FIG. 43 is a perspective view illustrating the structure of recording head.
Figure 44:
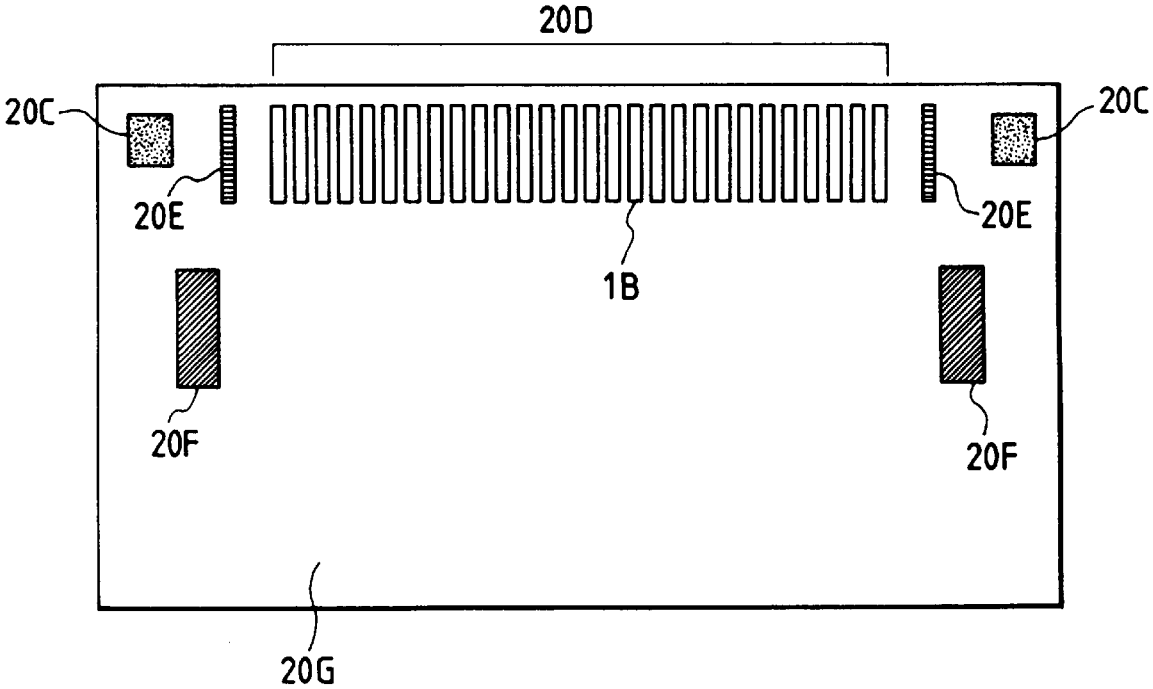
FIG. 44 is a drawing showing the inside of the heater board of recording head.

Now, the recording heads 1 will be detailed below. As illustrated in FIGS. 43 and 44, a plurality of ejection nozzles 1A for ejecting ink droplets are disposed in a row on a heater board 20G of the printing heads and electric thermal transducers (hereinafter referred to as "ejection heaters 1B") for generating thermal energy by use of voltage applied thereto are disposed one each in the ejection nozzles 1A so as to cause ejection of ink droplets through the ejection nozzles 1A. The printing heads, in response to a drive signal exerted thereon, cause the ejection heaters 1B to generate heat and induce the ejection of ink droplets. On the heater board 20G, an ejection heater row 20D having a plurality of ejection heaters 1B arrayed thereon is disposed. Dummy resistors 20E incapable of ejecting ink droplets are disposed one each near the opposite ends of the ejection heater row 20D. Since the dummy resistors 20E are fabricated under the same conditions as the ejection heater 1B, the energy (Watt/hr) formed severally by the ejection heaters 1B in response to the application thereto of a fixed voltage can be detected by measuring the magnitude of resistance produced in the dummy resistors 20E. Since the formed energy of the ejection heaters 1B can be computed as $V^2/R$, wherein V stands for the applied voltage (Volt) and R for the resistance (Ω) of the ejection heaters, the characteristics of the ejection heaters 1B are dispersed similarly to those of the resistors 20E. These resistors 1B and 20E possibly have their characteristics dispersed within a range of ±15%, for example, by reflecting the inconstancy of craftsmanship encountered by them in the process of manufacture. The recording heads are enabled to enjoy an elongated service life and produce images of exalted quality by detecting the dispersion of the characteristics of the ejection heaters 1B and optimizing the drive conditions of the recording heads based on the outcomes of the detection.

Since the ink jet printer of the present type accomplishes the ejection of ink droplets by exerting thermal energy on the ink, the recording heads require temperature control. For the sake of this temperature control, therefore, diode sensors 20C are disposed on the heater board 20G and operated to measure the temperature of the neighborhood of the ejection heaters 1B. The results of this measurement are utilized for controlling the magnitude of the energy which is required for the ink ejection or the temperature control. In the present example, the average of the degrees of temperature detected by the diode sensors 20C forms the detected temperature.

The inks by nature gain in viscosity at low temperatures possibly to the extent of obstructing the ejection. For the purpose of precluding this adverse phenomenon, electric thermal transducers (hereinafter referred to as "sub-heaters 20F") are provided separately of the ink ejection nozzles on the heater board 20G. The energy supplied to the sub-heaters 20F is likewise controlled by the diode sensors 20C. Since the sub-heaters 20F are manufactured under the same conditions as the ejection heaters 1B, the dispersion of the magnitudes of resistance manifested by the sub-heaters 20F can be detected by measuring the magnitudes of resistance of the dummy resistors 20E mentioned above.

Figure 45:
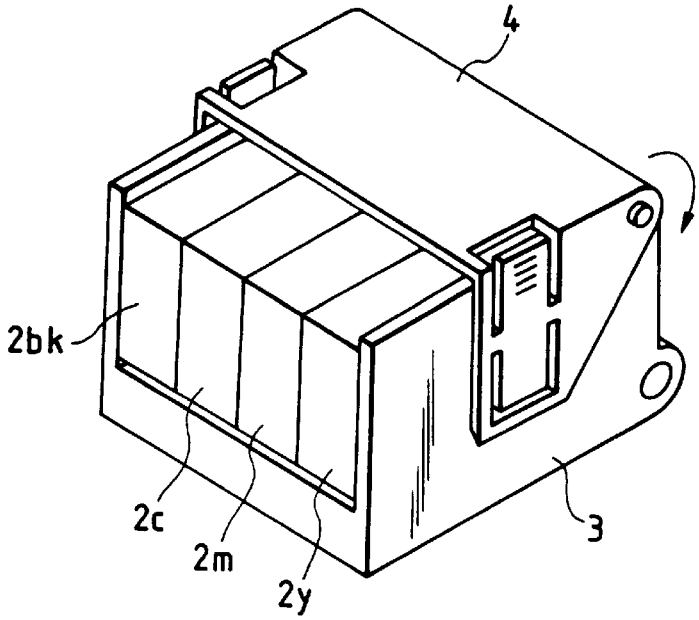
FIG. 45 is a perspective view of carriage.
Figure 46:
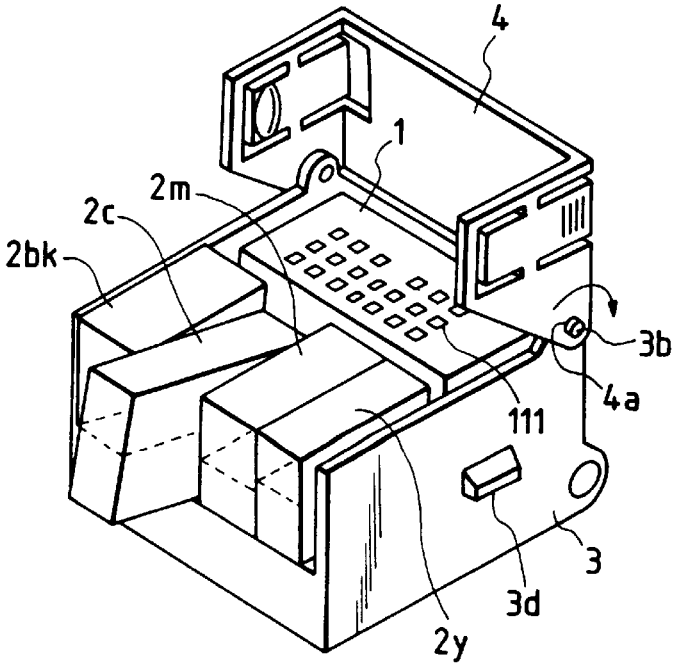
FIG. 46 is a drawing showing recording head mounted on the carriage.

Now, the recording heads mounted on the carriage will be described below. As illustrated in FIG. 45 and FIG. 46, the four printing heads (FIG. 43) serving the purpose of ejecting inks of the four colors R, C, M, and Y and ink tanks 2*bk*, 2*c*, 2*b*, and 2*y* for storing and supplying the respective inks are mounted in the carriage 3. These four ink tanks are so constructed as to be attached to and detached from the carriage 3. When they are emptied of their ink supplies, they can be replaced with newly supplied ink tanks.

A recording head fixing lever 4 is intended to position and fix the recording heads 1 on the carriage 3. Bosses 3*b* of the carriage 3 are rotatably inserted into holes 4*a* of the recording head fixing lever 4. The lever 4 which is normally kept in a closed state is opened to allow the operator access to the recording heads 1 and permit their replacement. Further, the engagement of the recording head fixing lever 4 with stoppers 3*d* of the carriage 3 ensures infallible fixation of the recording heads 1 on the carriage 3. Besides, a group of contacts 111 on the recording heads 1 join a group of matched contacts on the unshown recording head fixing lever. Owing to the union of these groups of contacts, the drive signals for driving the ejection heaters and sub-heaters of the printing heads assigned to the four colors and the data of head characteristics and the numerical values as the results of detection of the diode sensors can be transmitted from the recording apparatus proper or rendered detectable.

Figure 47:
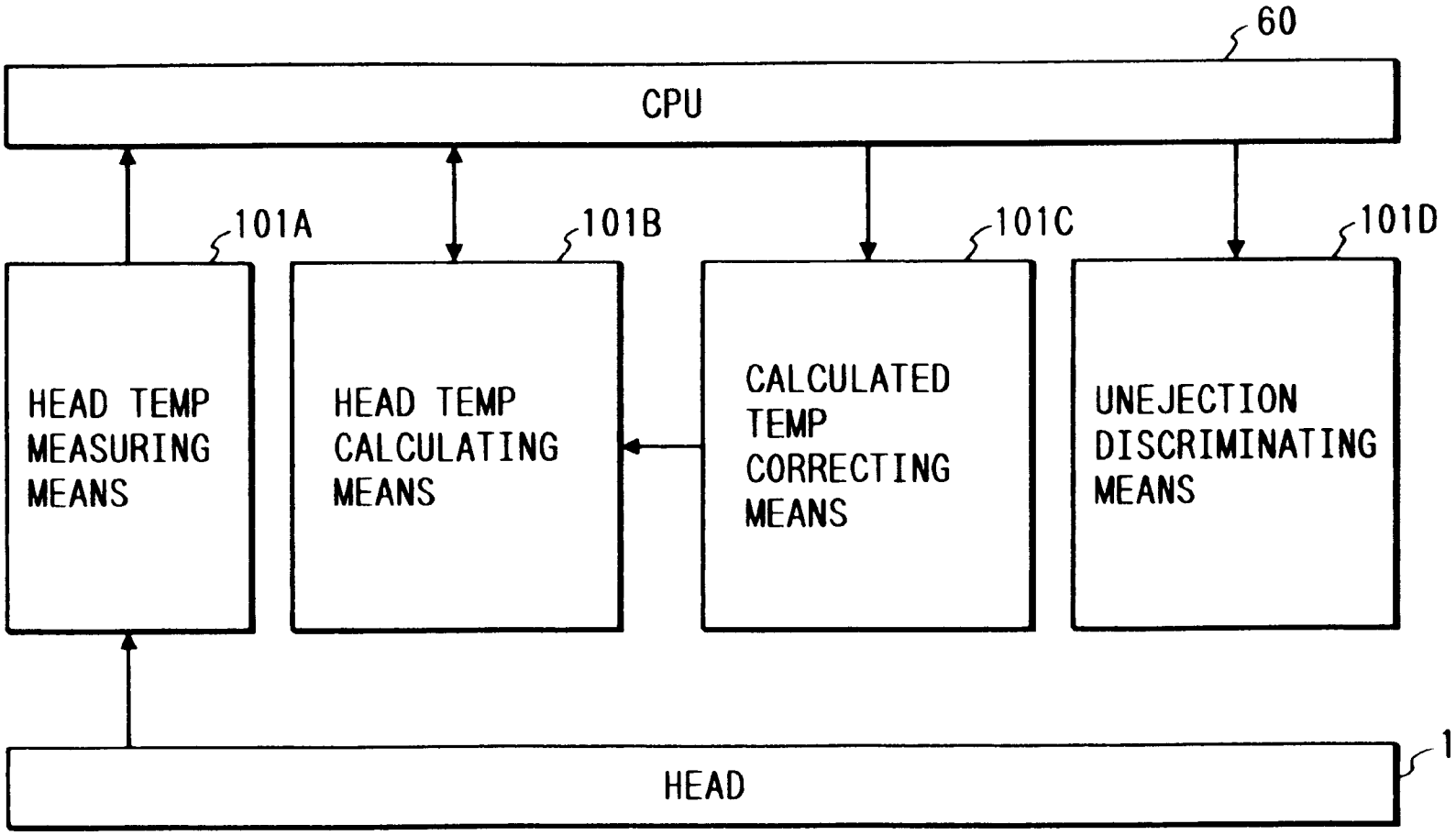
FIG. 47 is a block diagram showing the arrangement of the recording apparatus.

As shown in FIG. 47, the head temperature calculation algorithm of this embodiment, includes a head temperature measuring means 101A, a head temperature presuming calculation means 101B, and a correction means 101C for correcting a difference between such both measured value and calculated value at a suitable timing, as well as the ninth embodiment. The algorithm also includes a deciding means 101D for deciding as to whether the recording head is in an unejection state by using data of both the measured value and the calculated value, thus obtaining highly accurate decision of whether the recording head is in an unejection state. Especially, the algorithm performs a highly accurate calculation by measuring the heat characteristics, thus further improving the detection accuracy.

Measurement of Head Characteristics

Figure 48:
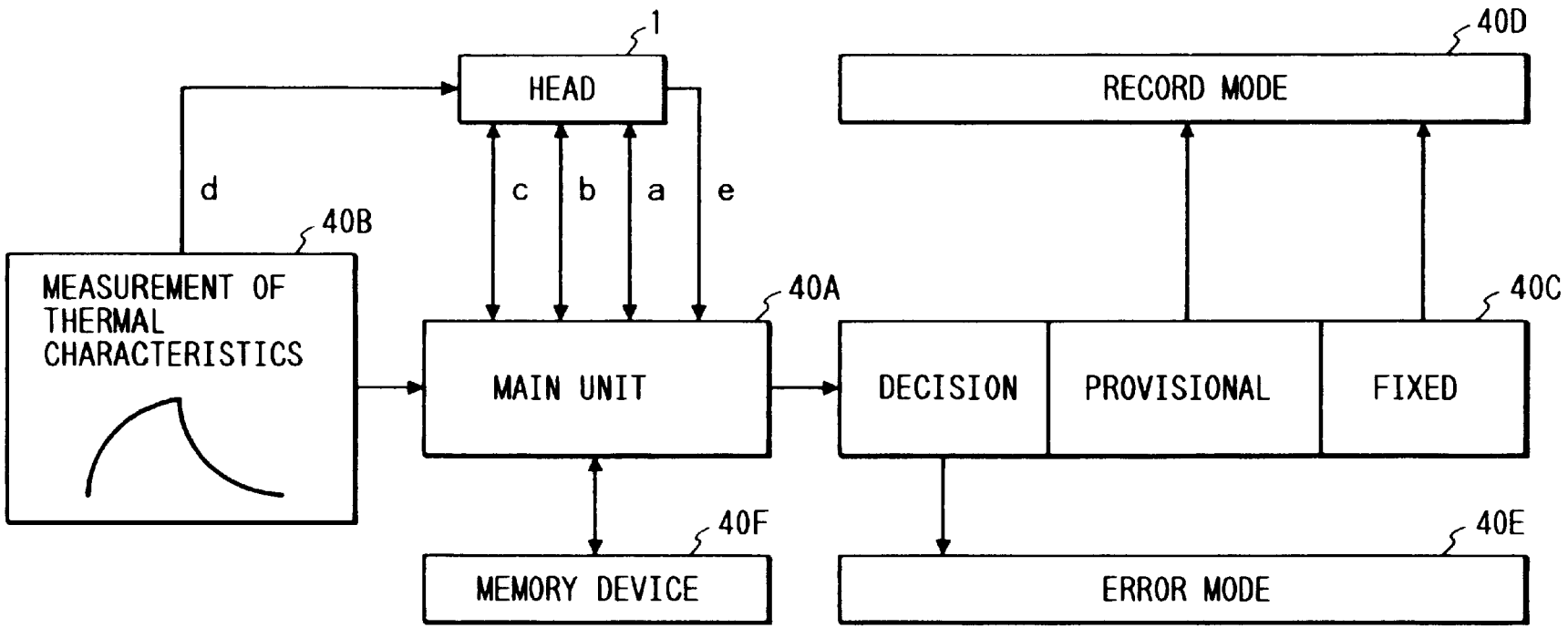
FIG. 48 is a block diagram for explaining the measurement of recording characteristics.

For optimum head drive as stated before, the main unit of a recording device should identify various characteristics of a recording head. Moreover, in this embodiment, since a recording head 1 is in a replaceable fashion, the above mentioned head characteristics are measured without fail at head replacement. Items of measurement are the following four:

1) Ejection heater characteristics (dummy heater resistance value)
2) Diode sensor characteristics (diode sensor output)
3) Sub-heater thermal characteristics
4) Ejection heater thermal characteristics FIG. 48 shows a schematic block diagram showing an entire structure of measurement of head characteristics. This embodiment shows that head characteristics measured by a main unit are the above mentioned four items. In FIG. 14, a represents the measurement of ejection heater characteristics, b represents the measurement of Di sensor characteristics, c represents ejection heater characteristics, and d represents sub-heater thermal characteristics. There exist inputs and outputs, such as energy application, the measurement of temperature, etc., between a main unit 40A and a head 1, and a decision 40C on individual head characteristics is made on the basis of the results of the measurement. Then, a definition as provisional or fixed may be made. On completion of deciding head characteristics, a record mode 40D is entered for becoming ready for recording. If the results of measurement of head characteristics are abnormal, an error mode 40E is entered, and the main unit 40A indicates an error. Individual head characteristic values are stored in a memory device 40F. The stored values are used to determine whether a head has been replaced or the same head as that used previously is used.

Head characteristics and corresponding drive pulse waveforms, etc. are explained in detail below.

First, for ejection heater characteristics, a dummy resistance 20E (FIG. 44) is measured. When constant-voltage driving is used for driving a print head, how much energy is to be applied is known from the resistance value of an ejection heater. In this embodiment, a drive voltage waveform is variable in correspondence with a dispersion in the resistance value of the ejection heater for optimum drive. In other words, a basic pulse waveform and a PWM table as shown in FIGS. 49A, 49B and 50, respectively, are provided for each ejection heater characteristic (head rank). FIG. 49A shows the pulse width of a preheat pulse $P_1$, and FIG. 49B shows weight for temperature calculation.

Described here is the basic waveform of drive pulses corresponding to head ranks. (The basic waveform of drive pulses corresponding to head ranks is hereinafter referred to simply as "basic waveform".) The basic waveform of drive pulses is important and used as a basis for driving various recording heads.

As a first objective, printing is driven on the basis of the above mentioned basic waveform. A driving waveform is set according to a head rank, for achieving the stable ejection state of a recording head and the long life of an ejection heater. Hence, under ordinary environmental conditions, the basic waveform may be used for printing unless the recording head has increased temperature thereof by printing at a high duty. In this embodiment, a double-pulse waveform is used as a basic waveform. When a recording head temperature is lower than a predetermined temperature, the above mentioned sub-heater executes temperature control to compensate an ejection quantity. On the contrary, when a recording head temperature is higher than a predetermined temperature, the width of a leading pulse (pre-heat pulse) is relatively modulated in a reducing direction (PWM control) for adjusting an ejection quantity.

As a second objective, a preliminary ejection is driven on the basis of the above mentioned basic waveform. The preliminary ejection is intended to refresh the inside of ejection nozzles of a recording head and does not require the adjustment of an ejection quantity thereof even when the ejection quantity has increased due to an increase in temperature of the recording head. A pre-heat pulse with a maximum pulse width (i.e. basic pulse waveform itself) is used for improving recoverability.

The aforementioned PWM control requires the width of a pre-heat pulse of a basic waveform to be sufficiently long. In other words, in PWM control, as the temperature of a recording head increases, a pre-heat pulse is made shorter; hence, if the width of a pre-heat pulse of the basic waveform is short, a controllable temperature range in PWM control becomes narrow. Thus, setting the width of a pre-heat pulse of the above mentioned basic waveform too short is undesirable.

However, as the resistance value of an ejection heater (i.e. head rank) becomes smaller, the width of a pre-heat pulse needs to become narrower. Otherwise, the pre-heat pulse causes ink to bubble (hereinafter referred to as pre-bubble), causing a failure in stable ejection.

Hence, the set width of a pre-heat pulse of the basic waveform needs to fall in such a range that does not cause the above mentioned problem; the pre-pulse width is not set in proportion to the resistance value of an ejection heater.

Also, a relatively latter pulse of the basic waveform (hereinafter referred to as main heat pulse) needs to be modified according to a head rank for achieving the stable state of ejection; hence, as illustrated in FIG. 50, the setting of a pulse width thereof is such that the pulse becomes longer as a head rank becomes larger.

For the reason mentioned above, the basic waveform is configured as illustrated in FIG. 50.

At printing, control over driving pulses is executed to modulate a pre-pulse as illustrated in FIGS. 49A and 49B. At this time, only $P_1$ needs to be modulated, and hence, only a $P_1$ table corresponding to a rank needs to be held.

When ejection heater thermal characteristics are to be measured, pulses are applied to such an extent as not to cause bubbles, but in this embodiment, only pre-pulses are used for driving. Hence, it is not necessary to have another driving pulse table used in measuring thermal characteristics.

Figure 51:
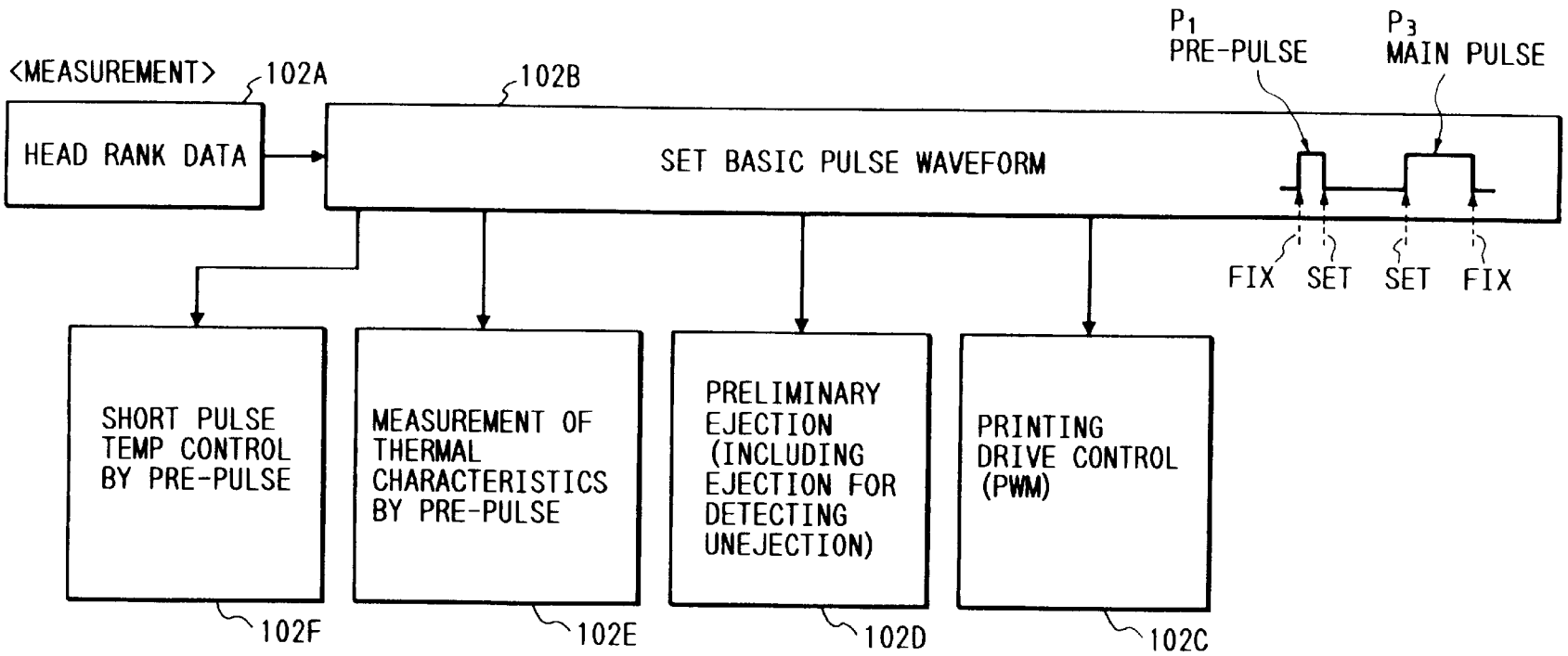
FIG. 51 is a block diagram for explaining the recording head driving in the embodiment.

FIG. 51 is a block diagram schematizing what has been described above. As shown in the same figure, first, a dummy resistance on a head is measured for determining a head rank (102A), and a basic pulse waveform is set on the basis of the head rank (102B). Conducted are printing drive control (PWM) (102C) for modulating a pre-pulse on the basis of the basic pulse waveform, preliminary ejection (102D), measurement of thermal characteristics by pre-pulse (102E), and short pulse temperature control by pre-pulse (102F). A drive pulse for detection of unejection is also set as for preliminary ejection.

Secondly, diode sensor characteristics are measured. An ambient temperature is measured by a thermistor built in the main unit of a recording device. Known previously are a diode sensor reference output voltage and temperature-output voltage characteristics (gradient value) at a reference temperature (for example, 25° C.). Hence, a diode sensor output voltage at the above mentioned ambient temperature is converted to that at the reference temperature (25° C.) by using the above mentioned gradient value. Since the diode sensor output varies depending on a head temperature, if a recording head temperature is different from a main unit temperature or if there exists a sharp change in temperature, measurement of diode sensor characteristics is disabled, and it is necessary to wait until thermal stabilization is established.

However, when a head is identified as a new head, a conceivable case is that a previously used recording head has been left at an ambient temperature different from that for a main unit; hence, for measuring a diode rank, it is necessary to wait for a considerable time after the recording head is mounted in the main unit.

Since the new head as a whole has acclimated itself to a previous ambient temperature at which the new head has been left, a thermal time constant thereof is large until the new head acclimates itself to an ambient temperature for the main unit, particularly this tendency is remarkable with a recording head having a large thermal capacity as a whole. For example, for an ink tank and a recording head combined into one unit, it takes time for a head temperature to stabilize because of the large thermal capacity of ink and ink tanks. Also, for an integral head comprising a plurality of recording heads as in this embodiment, since the in-frame air around a plurality of recording heads acts as a large thermal capacity, a head temperature is further hard to stabilize, and in some case, it may take near one hour until the head temperature stabilizes.

Hence, if a diode rank is measured without putting a sufficient time interval, the measured rank value includes a large measurement error, and consequently, the temperature of a recording head may not be obtained at a good precision in some case. As a result, the stable ejection of ink from a recording head and a stable ejection quantity may not be achieved in some case. Accordingly, the temperature of a recording head is presumed by using a change in the value of a diode sensor of a recording head with time and an associated thermistor temperature in a main unit, thereby presuming a diode rank.

Thirdly, thermal characteristics of a sub-heater are measured. The sub-heater functions to maintain a head temperature at a constant level (for example, 25° C.) for preventing ink ejection characteristics from deteriorating at low temperatures. As mentioned above in the paragraph of a head temperature calculation algorithm, the main body of the recording device has a calculation table for the sub-heater for temperature calculation. This calculation table contains temperature changes of the print head at a constant interval of time (way of heat transmission as viewed from a Di sensor). In actuality, the way of joining between members of a print head, an ejection quantity, a dispersion in a main unit power supply for heater drive, etc. cause the contents of the calculation table to vary for each print head.

In this embodiment, temperature changes are divided into three patterns for easy-to-accumulate-heat print heads through hard-to-accumulate-heat heads, and corresponding three calculation tables mentioned above are provided.

For easy-to-accumulate-heat heads, because of high increased temperatures, values in the table are rather large even when an identical energy (duty) is applied. On the contrary, for hard-to-accumulate-heat heads, because of quick radiation of heat, values in the table are rather small. A center table 2 indicative of central conduction of heat for print heads is provided between a large-temperature-change table 3 (easy to accumulate heat) and a small-temperature-change table 1 (hard to accumulate heat).

Figure 52:
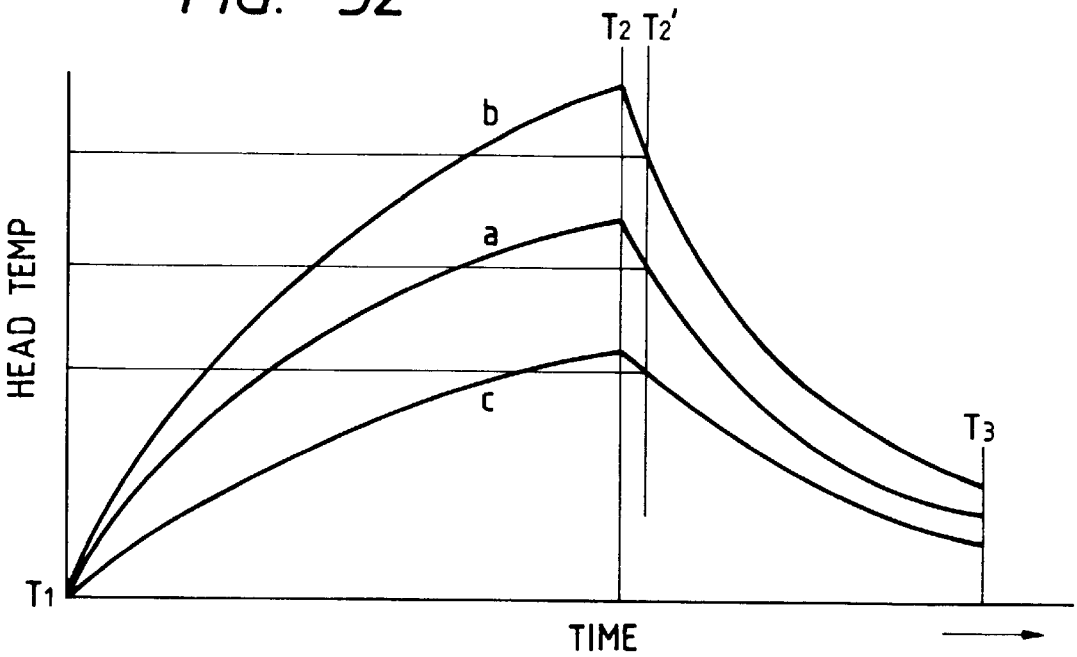
FIG. 52 is a diagram for explaining the measurement of sub-heater thermal characteristics.

Measurement of sub-heater thermal characteristics is intended to select a table. FIG. 52 shows an increase/decrease of temperature for each thermal characteristic at application of an identical energy. A diagram a represents a central increase/decrease of temperature, a diagram b represents an increase/decrease of temperature for the case of high increased temperatures due to large accumulation of heat, and a diagram c represents the one for the case of low increased temperatures due to small accumulation of heat. First, temperature is measured at a timing T1 before applying energy. Next, temperature is measured at a timing T2 before/after completion of applying energy. Finally, temperature is measured at a timing T3 after reduction of temperature. At this time, a measurement value for selecting a table is calculated as follows:

Measurement value=2×(temperature at T2)−(temperature at T1)−(temperature at T1)

When a target print head is easy to accumulate heat, a measurement value will be greater than a threshold 2;

hence, the large-temperature-change table 3 is selected as a calculation table. On the contrary, if a measurement value is smaller than a threshold 1, the small-temperature-change table 1 is selected on the assumption that a head is hard to accumulate heat.

Also, if the above mentioned measurement value falls between the threshold 1 and the threshold 2, the center table 2 is selected on the assumption that a head is a standard print head.

Table 1: measurement value<threshold 1

Table 2: threshold 1≧measurement value≦threshold 2

Table 3: threshold 2<measurement value

In this embodiment,

T2−T1=T3−T2 is taken, but this is not necessarily the one to stick to, depending on a threshold employed.

As explained above, setting a calculation table for each print head thermal characteristic allows calculation at a higher precision as compared with a method using uniform thermal characteristics, and provides beneficial effects including a low calculation load.

Fourthly, thermal characteristics of an ejection heater are measured. The operation of measurement is identical to that for the above mentioned method for measuring sub-heater thermal characteristics, but what is driven is the ejection heater.

Measurement on the Thermal Characteristics of the Ejection Heater

The thermal characteristics and heat storage characteristics of the recording head greatly affect temperature change such as temperature rise on the recording head due to the idle ejection which is used to detect the unejection of the recording head and temperature fall after completion of the idle ejection. In this embodiment, the ejection heater is driven with the pre-pulse of the above mentioned fundamental waveform for each head rank, and the thermal characteristics of the ejection heater are measured according to a temperature difference in the temperature rise on the recording head thereby as well as to a temperature difference in the temperature fall up to a prejudged time from completion of the pulse generation.

The heat storage characteristics of the recording head differs for each recording head, or between the recording head and the recording apparatus depending on connection between members, the large or small ejection amount, and distribution of the power for the body for use in driving the heater. With the same amount of energy applied to the ejection heater, a recording head which tends to store heat is heated at a high temperature recording while a recording head capable of storing less thermal energy is less heated because it discharges the thermal energy generated.

In this embodiment, the pulses each having the above mentioned fundamental waveform and the pre-pulse width depending on the head rank are applied to the ejection heater at 15 kHz over 1 second. The thermal characteristics of the recording head are decided according to the temperature change before and after application of the pulses.

Figure 53:
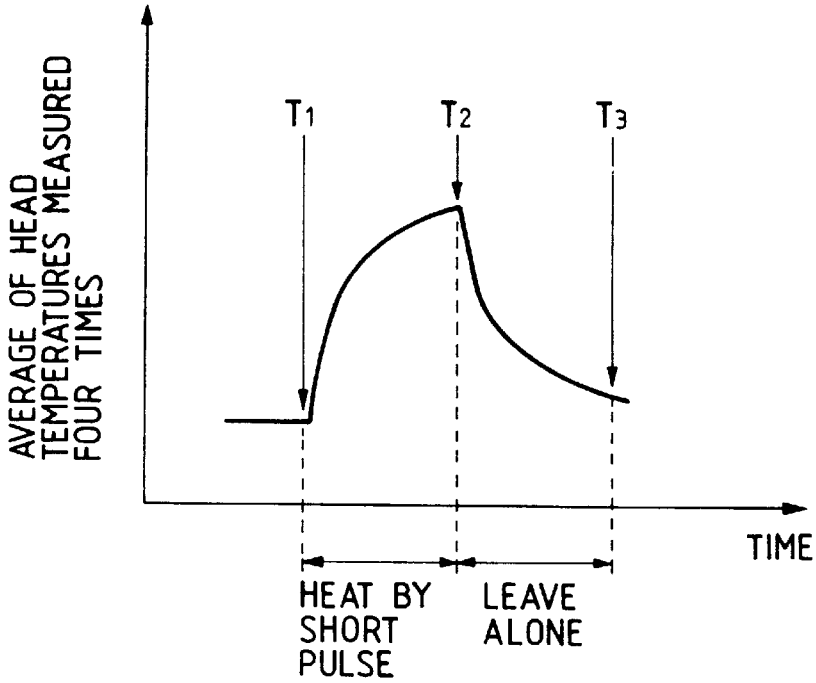
FIG. 53 is a diagram for explaining the measurement of recording head thermal characteristics.

A method of determining the thermal characteristics is described specifically with reference to FIG. 53. First, a temperature ($T_1$ in the figure) of the recording head before application of the pulse is measured. As mentioned above, the pulses each having the above mentioned fundamental waveform and the pre-pulse width are applied at 15 kHz over 1 second. A temperature ($T_2$ in the figure) of the recording head just before completion of pulse application is measured. Values of the head temperature are collected for every 20 millisecond, and four moving averages are obtained to eliminate any noises.

According to the measurement results so obtained, a value ΔTs representing the thermal characteristic of the recording head is given as follows:

$$\Delta Ts=(T_2-T_1)+(T_2-T_3).$$

The reason the temperature difference in the temperature rise is added to that in the temperature fall is to reduce as hard as possible effects in a case where the temperature of the recording head varies such as after high-duty printing.

The pre-pulse width of the pulse having the above mentioned fundamental waveform is significantly short, and the ink is not discharged as a result of application of the pulse for the thermal characteristic measurement. There is an advantage that only a small number of tables should be prepared by using a table for the fundamental waveform for measuring the thermal characteristic of the recording head.

In this embodiment, for measurement items of head characteristics, 1) priority is set,
2) a once measured characteristic value is digitized (divided into ranks) and stored, and
3) a stored characteristic value is compared with a newly measured characteristic value. As a result, an identification (ID) of a recording head itself can be set, thereby reducing the time of measurement of head characteristics and improving efficiency of measurement.

First, measurement values of an ejection heater and a diode sensor are divided into ranks for management. This method allows the easy handling of measurement values for comparison with previous measurement values and for storing/saving in the main unit of a recording apparatus.

Ejection Heater Characteristics

Ejection heater characteristics, as mentioned before, are represented with a dummy resistance 20E.

In this embodiment, explained is the case where a dispersion of the dummy resistance 20E is 272.1 Ω± about 15%. As shown in FIG. 54, a dispersion of resistance values is divided into 13 ranks. A center value is taken as rank 7, and the width of a resistance value within one rank is about 8 Ω, about 2.3% of an overall dispersion. Division into finer ranks allows head rank setting at a higher precision, but requires a read circuit of a higher precision on the main unit side of the recording apparatus. After the recording apparatus has read head ranks, when the read head ranks are written to memory members (EEPROM, NVRAM, etc.), the above mentioned numbers 1 to 13 are stored for each of four heads.

Diode Sensor Characteristics

As in the case of the aforementioned head ranks, characteristics of a diode sensor (hereinafter referred to as Di sensor) are also divided into ranks for similar reason. Among Di sensors, there exists not so much a dispersion in a coefficient of proportion (hereinafter referred to as gradient) for temperature-output voltage (when used for head temperature management in this embodiment), however, offsets (dispersion of output values at the same temperature) disperse considerably among sensors. Hence, even when an identical output voltage is obtained, an absolute value of a head temperature is unknown unless Di sensor characteristics (ranks) are known.

Figure 55:
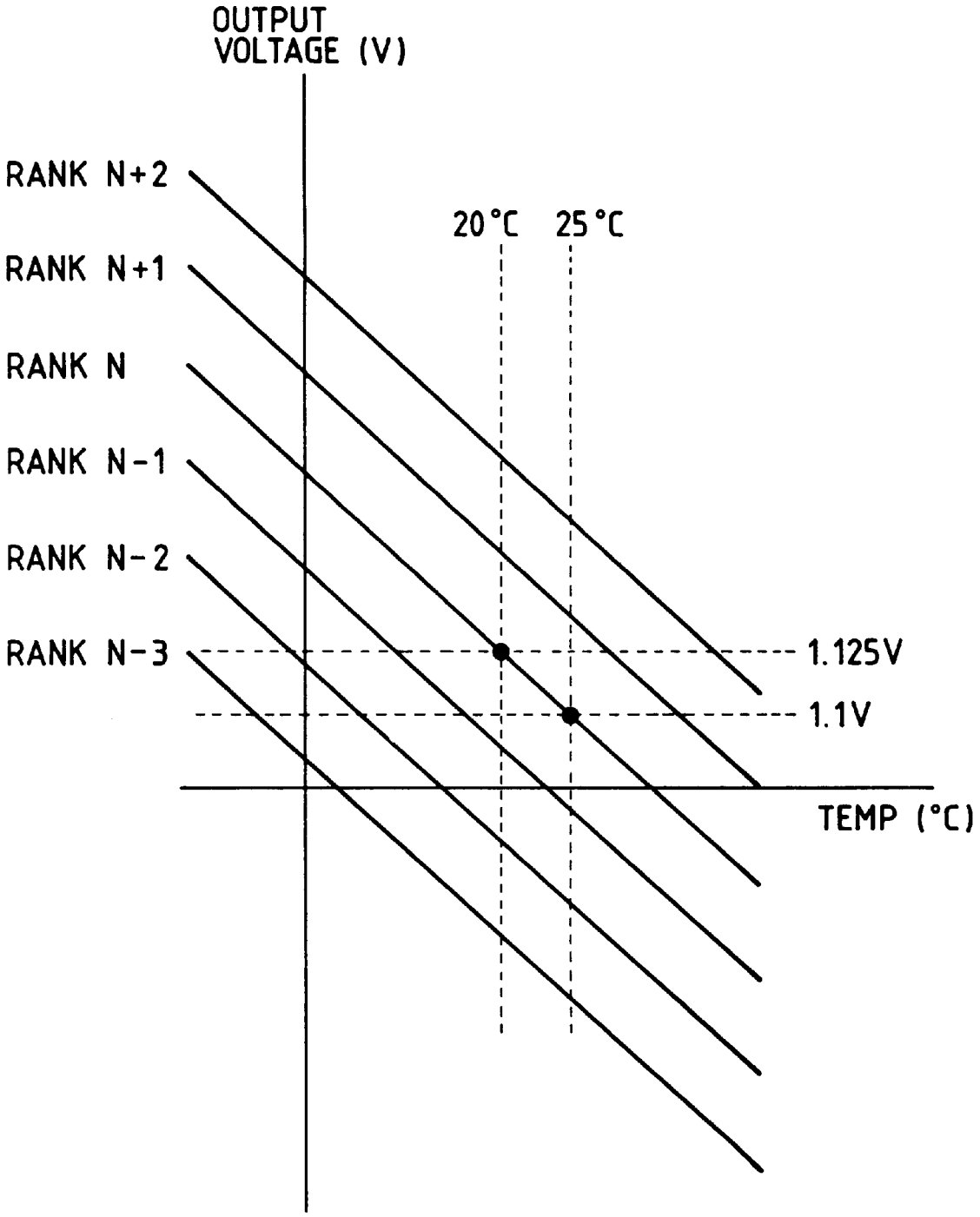
FIG. 55 is a diagram for explaining the measurement of diode-sensor rank.

FIG. 55 illustrates Di sensor ranks. Taking temperature along the axis of abscissa and the output voltage of a Di sensor along the axis of ordinate, FIG. 4 diagrams center values of each rank. In actuality, a voltage value having a width is in contact with that of an adjacent rank for each rank. Assum that an output is 1.125 V when the Di sensor of a certain head is at 20° C. (when a thermistor temperature is considered identical to a head temperature, a correction is made so that the thermistor temperature agrees with a Di sensor temperature). As mentioned before, a gradient is substantially constant, and in this embodiment, the gradient is as follows:

$$-5.0[\mathrm{mV/^{\circ}C.}]$$

Hence, an output voltage converted to that at 25° C. is 1.1 V. Thus, the output voltage value of a Di sensor is converted to that at an ambient temperature of 25° C. by using a gradient value, and the converted value is compared with a previously prepared conversion table for determining a rank. Di sensors in this embodiment has the following dispersion of output voltage at 25° C.

$$1.1\pm0.05\ [\mathrm{V}]$$

Hence, from the aforementioned gradient value of −5.0 mV/°C., a dispersion of ±10° C. occurs at the same output voltage. Therefore, with a total number of ranks being set to 10, a temperature dispersion in one rank is 2° C., and with 20 ranks set, the same is 1° C. The above mentioned number of ranks is determined at a precision required for head temperature management. However, as the number of division ranks increases, the detection width for a divided voltage becomes accordingly narrower; hence, the precision of a detection circuit needs to be accordingly higher. Thus, ranks for ranked Di sensors are stored for each color head.

Presuming Diode Sensor Rank

Figure 56:
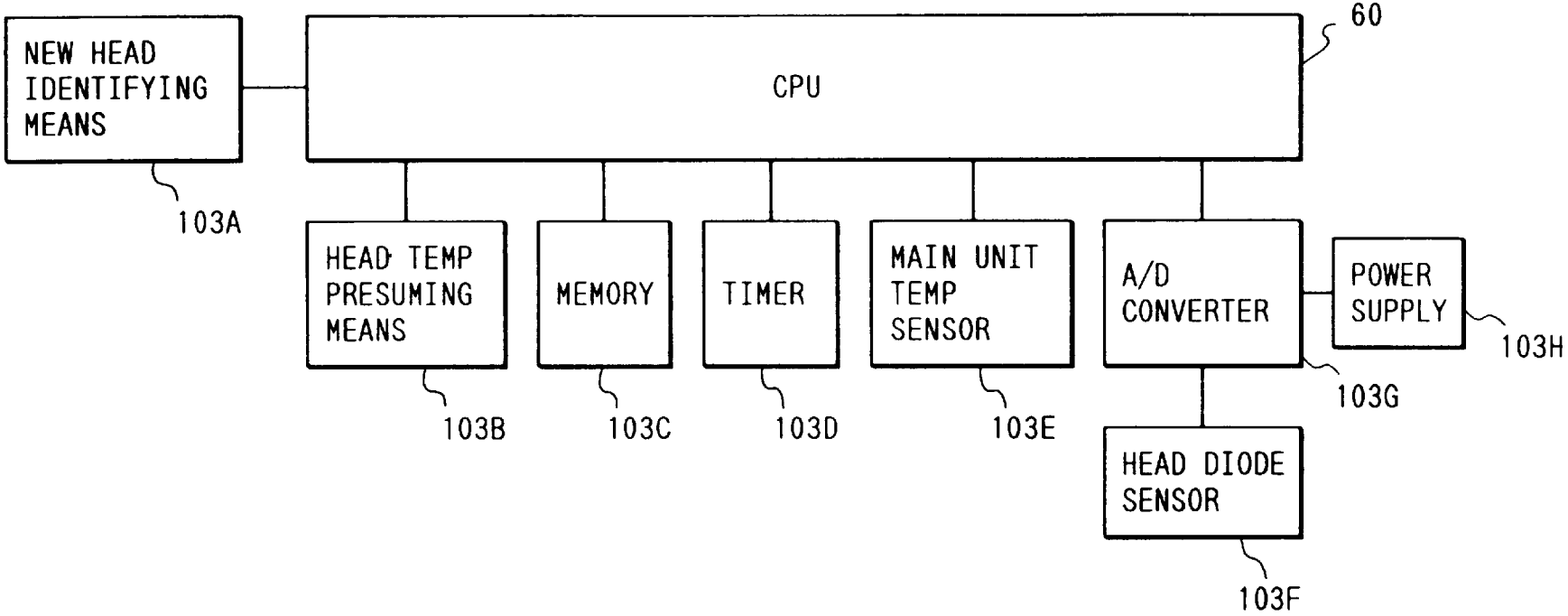
FIG. 56 is a block diagram for explaining the whole measurement apparatus of diode-sensor rank.

Referring now to FIG. 56, there is shown an entire configuration for presuming diode sensor ranks. If it is considered that a new recording head is fitted (103A), characteristics of a diode sensor are not measured directly, but they are presumed. More specifically, a temperature Ts of the recording head is measured and stored first, on the assumption that the diode sensor rank is considered as a standard value (103C, 103F, 103G, and 103H). Second, a temperature T of the recording head is measured again after an elapse of a fixed time t (103D). At the same time, a room temperature T0 in the main unit is measured by a thermistor (103E).

Figure 57:
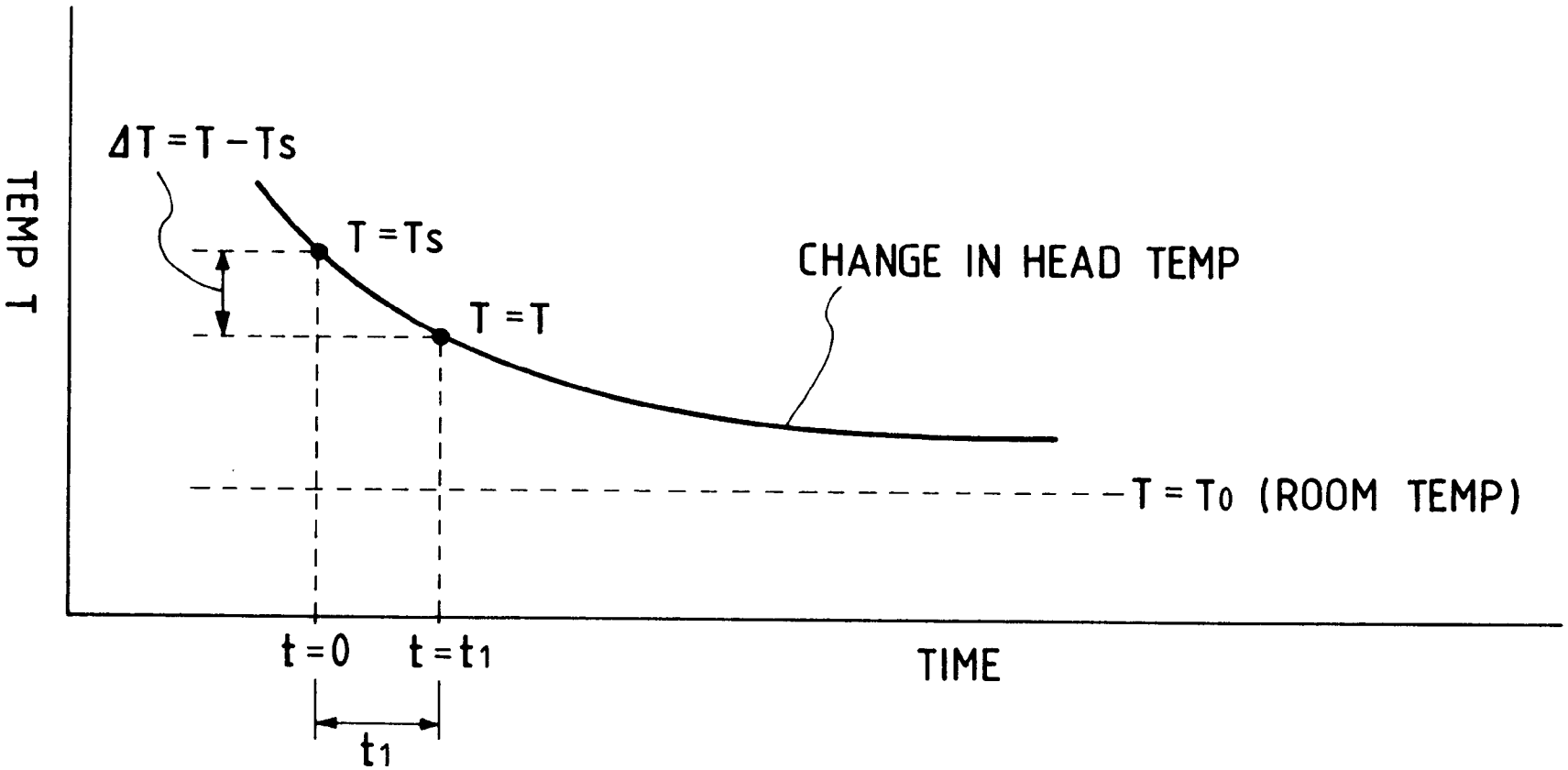
FIG. 57 is a diagram for explaining the measurement of diode-sensor rank.

Referring now to FIG. 57 for description of the above, temperature values of the recording head converge to an ambient temperature (~ room temperature) at a certain time constant like exponential functions (expression 1). The temperature to which the temperature values are converged can be obtained from Expression 2.

$$T=(Ts-T0)\cdot\exp(-t1/tj)+T0 \qquad \text{(Expression 1)}$$

$$T0=(T-Ts)/(1-A)+Ts=\Delta T/(1-A)+Ts \qquad \text{(Expression 2)}$$

$(\Delta T=T-Ts,\ A=\exp(-t1/tj),\ tj$: Time constant)

The diode rank is determined so that T0 obtained from this expression matches the thermistor temperature. Since time constant tj is great compared to a head immediately after printing, t1 and A are set to 30 sec. and 0.94, respectively, in this embodiment. (Characteristics of Sub-heater and Ejection Heater) For characteristic values of a sub-heater and an ejection heater, the above-described calculation table numbers are stored as rank values of these heaters.

Flow of Head Characteristic Side Sequence

Figure 58:
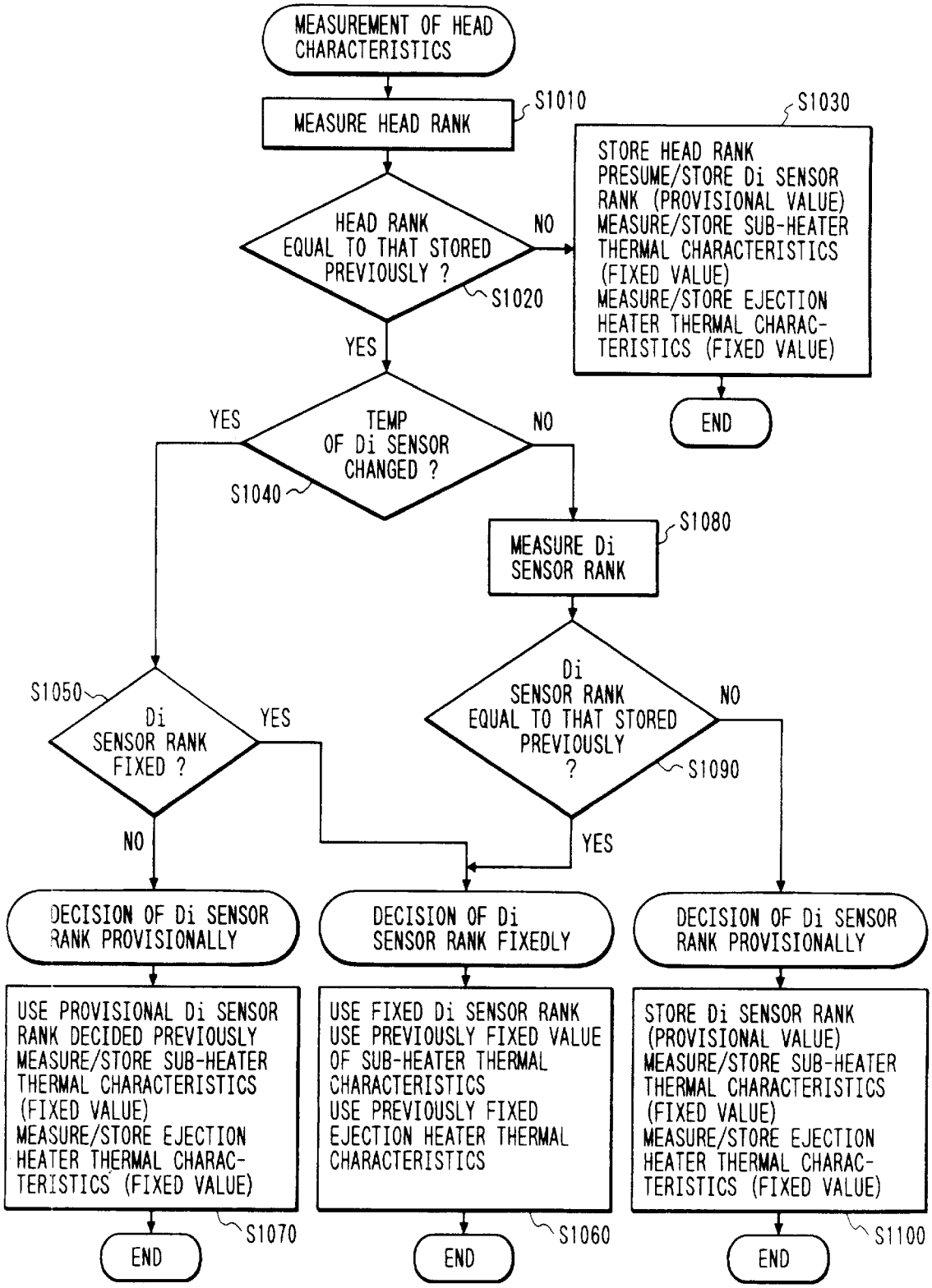
FIG. 58 is a flowchart showing sequence of the measurement of recording head characteristics.

Referring to FIG. 58, there is shown a flow of a head characteristics measurement sequence. Head ranks are measured in step S1010 first, and if they are not identical, it is determined that a different head is installed, in step S1020. The head characteristics are measured for all heads whether or not there are any temperature changes in the vicinity of Di sensors. In step S1030, diode (Di) sensor ranks are presumed and then stored as provisional values.

If head ranks are determined to be identical in step 1020, it is checked that there are any changes in temperatures of the Di sensors, in step S1040. Since the Di sensors can sense temperature changes even if their rank values are not determined, it is determined whether the temperatures in the vicinity of the Di sensors are stable by checking a temperature variance within a fixed time.

In this embodiment, a presence of a change of 0.2° C. or more in 10 sec. is defined as a temperature change. This is because a temperature change can be fully confirmed by a change in 10 sec. since a temperature change is large due to a smaller thermal time constant immediately after printing, contrary to the diode rank determination. If it is determined that a temperature change is present in step S1040, this condition is not suitable for the Di sensor rank measurement, therefore, the measurement (output voltage measurement) is omitted, and a previous Di sensor rank value is used in step S1060. At this time, the rank value is determined whether it is provisional or fixed. If the previous Di sensor rank is a fixed value in step S1050, the installed recording head is determined to be the same as one at the previous characteristics measurement, and the previous characteristics value is used.

If it is a provisional value in step S1050, this provisional value is used in step S1070. Since the Di sensor rank value is provisional, the previous values can be also used for thermal characteristics of sub-heaters and ejection heaters or the previous central table value can be used as a provisional value, though thermal characteristics of sub-heaters and ejection heaters are measured again in this embodiment. In this case, temperature changes in the vicinity of the previous printing heads will not affect the measurement of the thermal characteristics of the sub-heaters and ejection heaters. The characteristics of the heads, however, must be measured again as soon as possible due to a use of the provisional value.

If it is determined that there is no temperature change in step S1040, the Di sensor ranks can be measured in a short time, therefore, they are measured in step S1080. If the measured values are the same as the previously-stored values when they are compared each other in step S1090, the Di sensor ranks are determined to be fixed and the heads are identical with the previous ones, and the previously-stored values are used for the thermal characteristics of the sub-heaters and ejection heaters in step S1060. If the measured values are not the same as the previous values in the comparison in step S1090, the Di sensor rank values are determined to be provisional and the heads are different from the previous ones, and then the thermal characteristics of the sub-heaters and ejection heaters are measured again in step S1100.

As described in the above, if it is determined that a new recording head is installed, its diode rank is presumed. This makes it possible to fit the diode rank relatively in a short time and precisely even if the installed recording head has been placed in an environment whose temperature is extremely different from that of the environment where the main unit is installed. Accordingly, even if this rank value is provisional, the recording head temperature value is reliable and it is different from a usual provisional value. For this reason, stable ink ejection from recording heads and their ejection quantity can be achieved by changing driving conditions according to head temperatures obtained afterward.

As described in the above, a precise rank measurement can be achieved by determining whether the above rank measurement is performed according to a presence of any temperature changes of the Di sensors prior to the Di sensor rank measurement. Furthermore, the combination of the provisional and fixed characteristic values makes it possible to apply precise values to ranks even if the sensors are placed in unsuitable conditions for the Di sensor rank measurement due to a temperature change in the above. If the head ranks are identical with the previous ones and the Di sensor ranks are fixed values, the previous stored values can be used for respective head characteristics independently from temperature changes.

In this embodiment, after completing the aforementioned measurement of head characteristics, the remeasurement of head characteristics is conducted. At ordinary start-up of a recording apparatus (when the aforementioned measurement of head characteristics is to be conducted without fail), central characteristic values like provisional values, etc. are used to shorten the above mentioned start-up time for making the recording apparatus ready to use. Then, the above mentioned remeasurement of head characteristics (hereinafter referred to as correction of head characteristics) is made while the recording apparatus is not used by a user, for deciding more accurate fixed values from head characteristic values used as provisional values, thereby improving the precision of head control.

Figure 59:
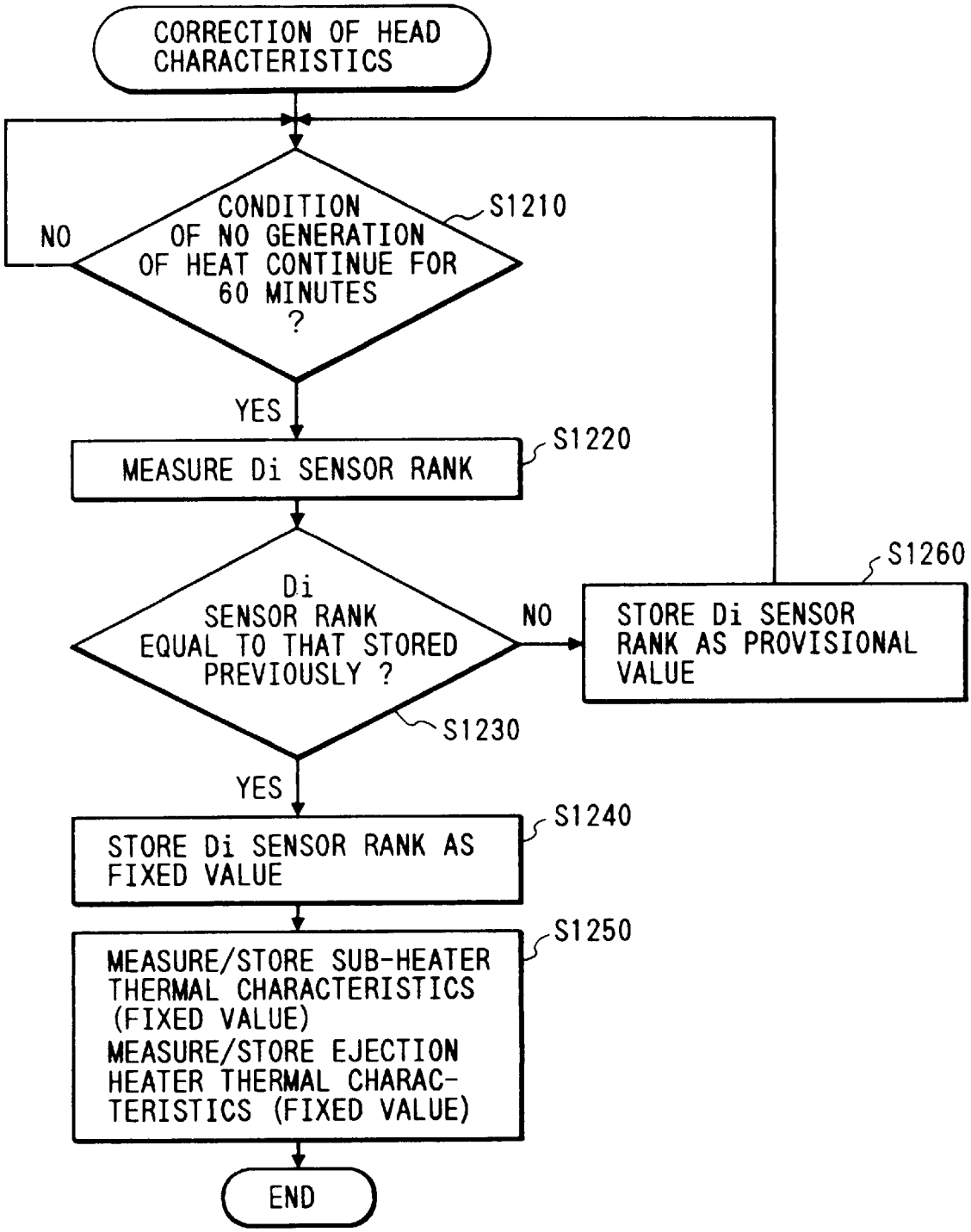
FIG. 59 is a flowchart showing sequence of the measurement of recording head characteristics.

This is flow charted in FIG. 59. In this embodiment, a Di sensor rank is measured after no generation of heat has continued for 60 minutes at a recording head of the recording apparatus. This generation of heat is that when an ejection heater or a sub-heater is driven. Hence, when neither of the ejection heater and the sub-heater have been driven for last 60 minutes at step S1210, this is interpreted as no generation of heat, and the measurement of a Di sensor rank is executed at step S1220 on the assumption that there is no change in temperature near a recording head. The reason why this embodiment employs a time of no generation of heat of 60 minutes is, as shown in FIGS. 45 and 46, that a plurality of (four) recording heads are integrated into one unit and that a carriage 3 wherein the recording heads are positioned and fixed, does not have sufficient space to groove for heat radiation. The length of the above mentioned time depends on the form of the heads and the carriage or a required precision of a Di sensor rank.

Next, at step S1230, a measured Di sensor rank value is compared with a previously stored value, and if they are equal to each other, the measured Di sensor rank is stored as a fixed value at step S1240. At step S1250, sub-heater/ejection heater thermal characteristics are remeasured using the fixed value, for storing the measured thermal characteristics as final recording head characteristic values. If the above mentioned measured Di sensor rank is found unequal to that stored previously, the measured Di sensor rank is stored as a provisional value at step S1260, and then, a sequence of waiting for a 60-minute continuation of no generation of heat is again entered.

In FIG. 59, when a Di sensor rank is fixed once and sub-heater/ejection heater thermal characteristics are measured, the above mentioned correction of head characteristics is completed. A routine may be such that after fixing a Di sensor rank and then completing the measurement of sub-heater/ejection heater thermal characteristics, a return to the initial sequence of waiting for a 60-minute continuation of no generation of heat is made for repeating the operation of correction.

Further in this embodiment, it is determined whether the ranks or heads are identical with the previous ones by setting an allowable range for the ranks which are the previous head characteristic values. For example, when the previous head characteristics are measured, the highest priority is given to reduction of a starting time for the recording apparatus so as to be usable, and the heads and ranks (sub-heaters and ejection heaters of Di sensors) are determined to be identical with the previous ones only if the difference is within ±2 ranks. Accordingly, the heads can be determined to be identical with the previous ones even if there is a variation in measurements by setting a criterion with some allowance, and the past stored values are used, so that the starting time can be reduced. When head characteristics are corrected, the highest priority is given to preciseness, and the allowance for identical ranks is set to a range within ±1 rank. Narrowing the allowance range in this way makes it possible to set more precise rank values of the characteristics when they are determined to be fixed. Allowance ranges for precision used like this are not limited to the above values, if necessary.

Detection of Unejection

In this embodiment, the above mentioned driving pulses each having the fundamental waveform depending on the head rank are applied to the ejection heater to measure the temperature differences thereby in the temperature rise and the temperature fall on the recording head, thereby calculating a value ΔTi indicative of the degree of the temperature change. The ΔTi is compared with a threshold value ΔTth for decision which is decided depending on the above mentioned thermal characteristic ΔTs of the ejection heater, thereby determining the unejection of the recording head.

Figure 60:
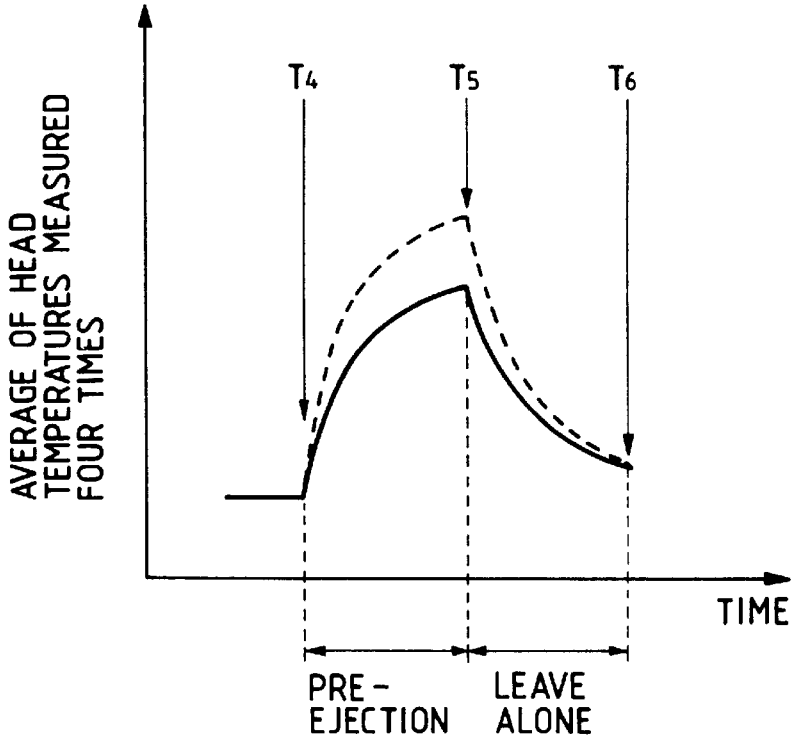
FIG. 60 is a diagram for explaining the method for measuring the amount of temperature changes caused by idle ejection.

Referring to FIG. 60, specifically described is a method of measuring, for detecting the unejection, the value ΔTi indicative of the degree of the temperature change due to the idle ejection. First, the temperature ($T_A$ in the figure) of the recording head before application of the driving pulses is measured.

Next, 5,000 (approximately 0.8 seconds) driving pulses each having the above mentioned fundamental waveform depending on the head rank are applied at 6.125 kHz, and the temperature ($T_5$ in the figure) of the recording head just before completion of the application is measured. Subsequently, the temperature ($T_6$ in the figure) of the recording head is measured after elapsing 0.8 seconds from completion of the driving pulse application. Values of the recording head temperature are collected for every 20 millisecond, and four moving averages are obtained to eliminate any noises.

With the measurement result so obtained, the value ΔTi is calculated which indicates the degree of increase and decrease of the temperature on the recording head due to the idle ejection:

$$\Delta Ti=(T_5-T_4)+(T_5-T_6).$$

Figure 61:
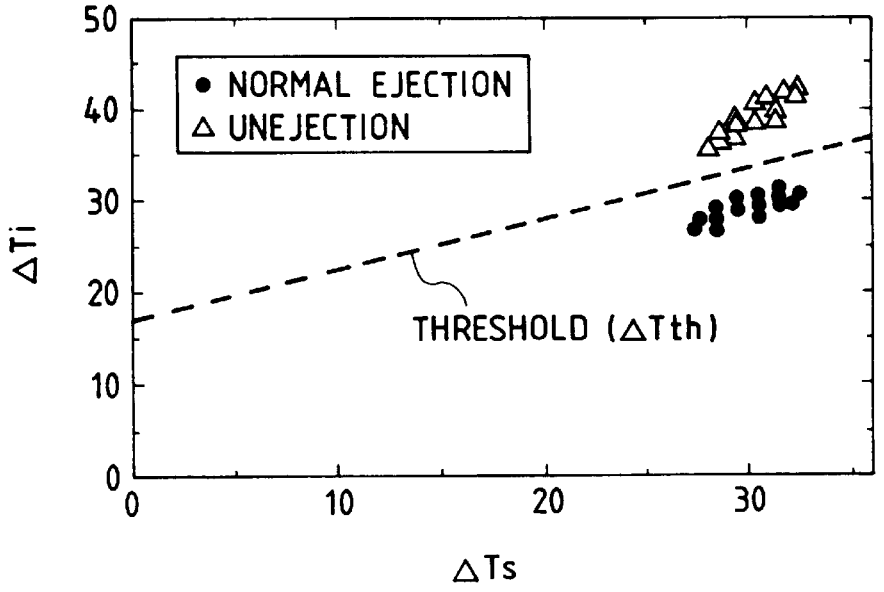
FIG. 61 is a diagram showing the relation between the recording head temperature change $\Delta Ti$ and the ejection heater thermal characteristics $\Delta Ts$ when recording head is in unejection state and when it is in normal state.

FIG. 61 is a graph in which ΔTi is plotted as a function of ΔTs for cases where the recording head is in an unejection state and in a normal ejection state for a plurality of recording heads. When the recording head is in the unejection state, ΔTi is approximately proportional to ΔTs. When the recording head is in the normal ejection state, a change rate of ΔTi relative to ΔTs is small, and they are not in a proportional relation. A probable reason thereof is that the ejection amount is varied depending on ΔTs. More specifically, the larger the ΔTs is, the higher the temperature rises due to the idle ejection for unejection detection, causing the temperature of the heater to increase. As a result, the ejection amount is increased. The thermal energy carried outside the recording head by the ejected ink droplets is thus increased, and ΔTi becomes slightly smaller (than the case where ΔTi is in proportion to ΔTs).

With respect to the above as well as the distribution of ΔTs on the recording heads, the threshold value ΔTth for use in determining the unejection is obtained as follows:

$$\Delta Tth=0.571\cdot\Delta Ts+17.$$

This is shown by a broken line in FIG. 61.

With a relation between the threshold value ΔTth for decision and the ΔTi measured, decision is made as follows:

ΔTi≧ΔTth—unejection

ΔTi<ΔTth—normal ejection.

As apparent from FIG. 61, there is a sufficient margin for determining the unejection.

In this embodiment, improvement on the durability of the recording head as well as protection of the recording head(s) while avoiding excessive temperature rise can be achieved by means of performing the idle ejection for the unejection detection with the driving pulses each having the fundamental waveform depending on the head rank.

When detection of the unejection and correction of the thermal characteristics are carried out by using fixed driving pulses without changing the driving pulses depending on the head rank, the quality of heat generated as a result of the idle ejection for detecting the unejection is small for a recording head having a high sheet resistance, so that a problem may occur that the margin for the unejection detection becomes small. In this embodiment, driving of the idle ejection for the unejection detection and measurement on the thermal characteristics of the recording head(s) are carried out with the driving pulses depending on the rank of the recording head as mentioned above, so that a larger energy is supplied to a recording head having a high sheet resistance. As a result, it becomes possible to ensure a sufficiently large margin for detection.

As mentioned above, in the present embodiment, the thermal energy generated by the idle ejection for the unejection detection and the thermal energy generated by applying the pulses for measuring the thermal characteristics of the recording head are not constant independent of the head rank because of the setting of the fundamental waveform. However, a difference in the thermal energy generated depending on the head rank is remarkably small in driving according to the present invention as compared with a case where the pulse application for measuring the thermal characteristics is made with a fixed drive rather than through the head rank, which is smaller than a distribution due to measurements on ΔTs and ΔTi.

The basic pulse wave form is designed to ensure that, for the thermal energy generated when applying to the recording head of each head rank a drive pulse of the corresponding basic wave form described above, as well as for the thermal energy generated when applying to the recording head of each head rank a pre-pulse of the corresponding basic wave form described above, the thermal energy ratio between head ranks is kept as constant as possible (at 5% or less in this embodiment of the invention). If, between recording heads of different head ranks, there is not the least difference in any other characteristics than error in measurement and head rank, then ΔTs and ΔTi as measured on these recording heads should be a little greater for the recording head of higher head rank than for that of lower head rank.

However, the difference in value of the ΔTs and ΔTi which is caused by difference in generated thermal energy due to difference in head rank has a dispersion in almost the same direction as the difference in value of ΔTs and ΔTi due to thermal characteristics (ΔTs) of recording head as shown in FIG. 61. This is because, for example in the case of normal ejection, the ejection quantity increases as the produced thermal energy increases and, to be more precise, because the difference in generated thermal energy has practically the same effect in phenomenon on the temperature rise of recording head as the difference in thermal characteristics of recording head. It is therefore obvious that the difference in generated thermal energy between head ranks will hardly reduce the unejection decision margin.

In this embodiment of the invention, the thermal characteristics (ΔTs) of recording head were measured by using a preheat pulse of basic wave form and the magnitude of temperature rise or drop (ΔTi) due to idle ejection was measured by driving using a basic wave form, but the invention is not limited to this makeup. A table by head rank of drive pulse wave forms for measurement of ΔTs and ΔTi may be provided. (For measurement of ΔTi, a preheat pulse in such table is used). Such table may be provided for measurement of ΔTs and for measurement of ΔTi, respectively, or a calculation formula may be provided to calculate the drive pulse wave form.

In this embodiment of the invention, the drive pulse wave form was changed according to the head rank, but the invention is not limited to this makeup. Operational voltage of drive pulse or number of drive pulses may be changed as far as the durability of the recording head permits. This embodiment of the invention is intended to perform the highly presice detection of unejection while ensuring the protection of the recording head by controlling, according to the head rank, the amount of heat generated in the recording head by detection of unejection or the recording head input energy.

In this embodiment of the invention, the threshold value (ΔTth) for unejection decision was calculated as a linear function of ΔTs, but the invention is not limited to this makeup. ΔTth may be determined from a curve of higher degree, or an appropriate threshold value may be selected from a table according to the value of ΔTs.

In this embodiment of the invention, the measurement of ΔTs and ΔTi was made by using the temperature difference observed in both the temperature rise by ejection heater driving and the temperature drop after such driving, but the invention is not limited to this makeup. For instance, only if the head temperature is stable, ΔTs and ΔTi can be measured with good precision from either the temperature rise or the temperature drop.

Figure 62:
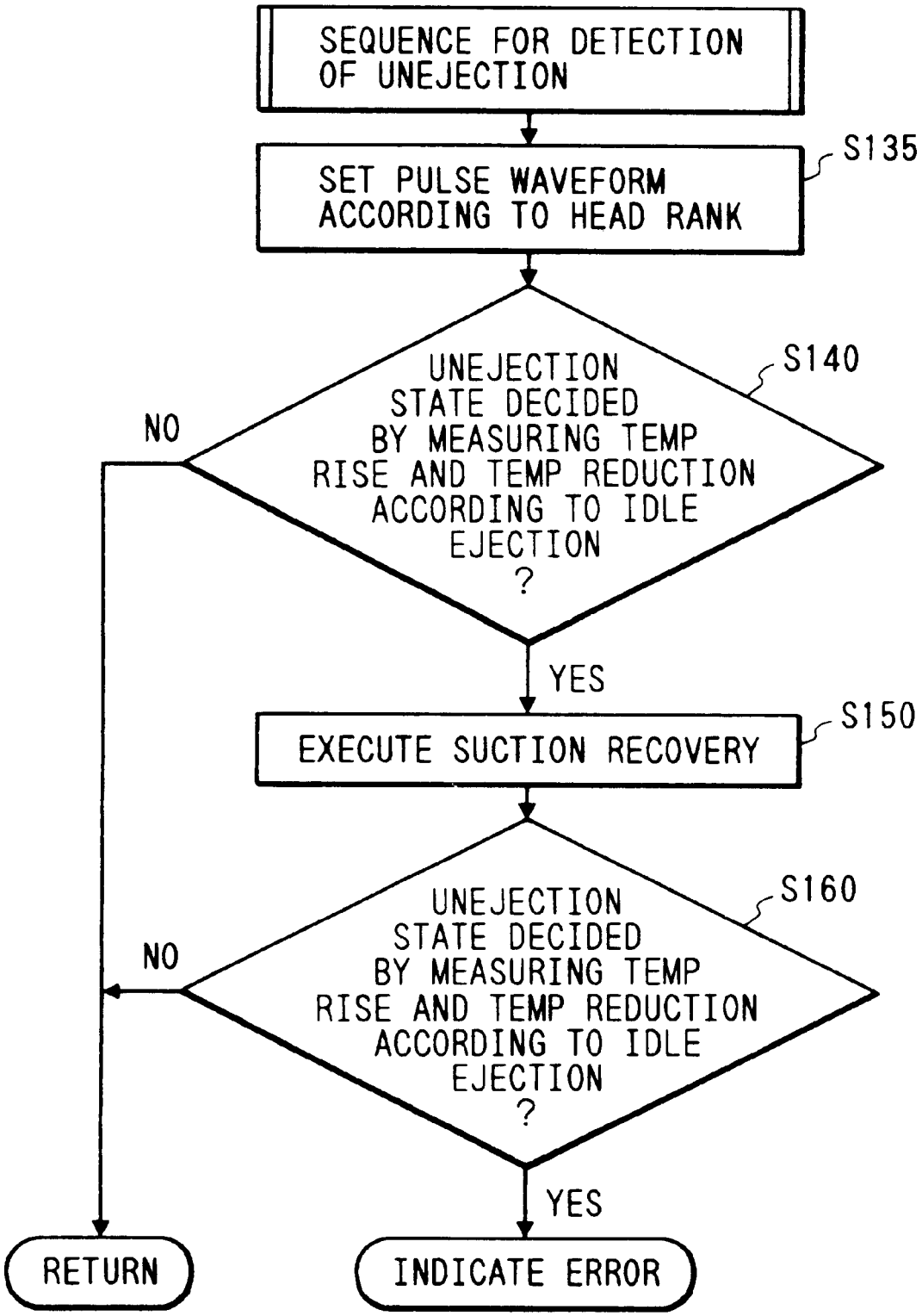
FIG. 62 is a sequence of unejection detection.

FIG. 62 shows a sequence of unejection detection. The sequence adds step 135 at which a pulse waveform is set according to a head rank to the sequence shown in FIG. 12.

Entire Sequence of Body

Figure 63:
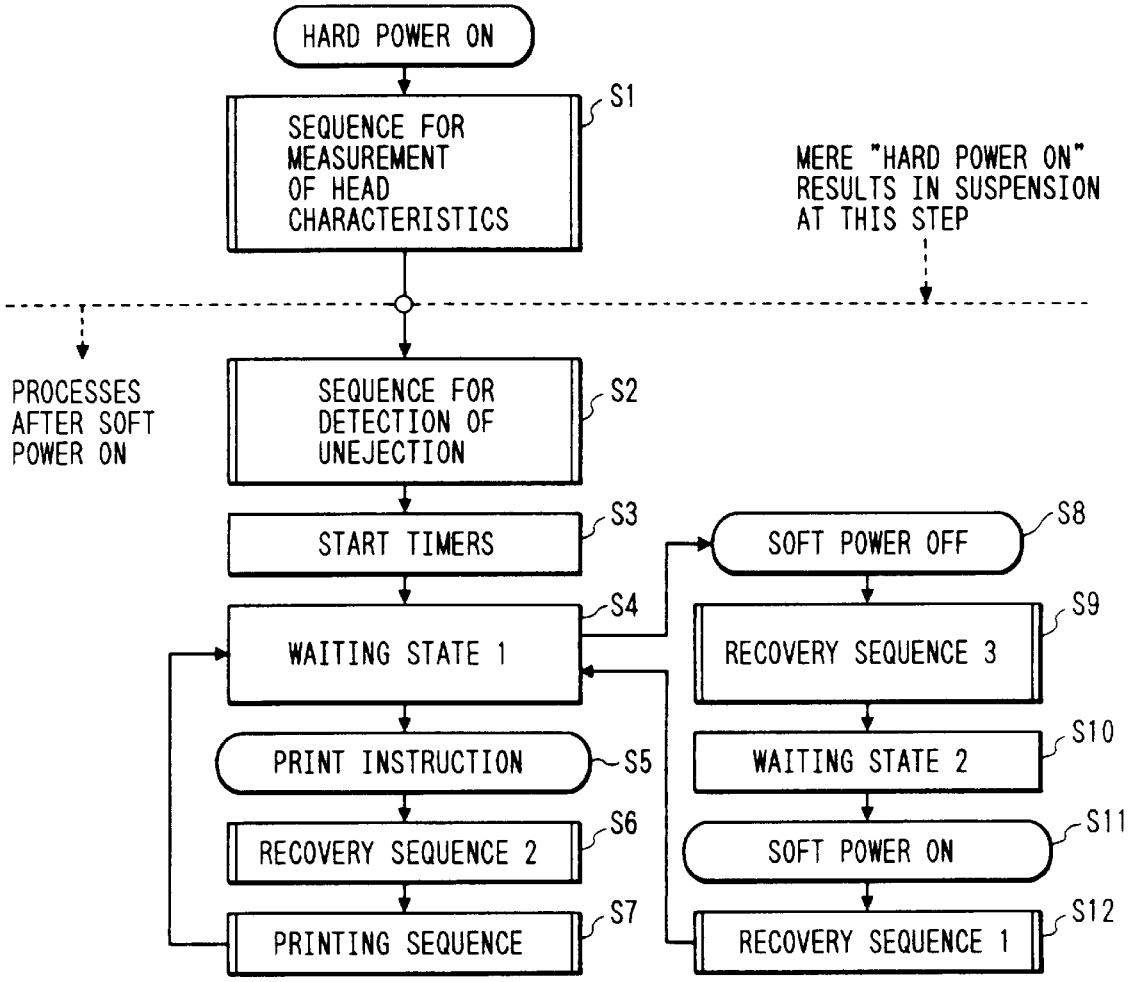
FIG. 63 is a flowchart showing the whole recording apparatus in the embodiment 13.

Referring to FIGS. 63 to 67, the entire sequence of the apparatus body will be described below. Especially, FIG. 63 shows an outline of the entire sequence, the details of the sequence will be described mainly based on FIG. 63.

In the apparatus, there are provided two power ON/OFF, to put a plug indicating "hard power ON", and to push a button indicating "soft power ON". If the hard power is set ON, but when the soft power does not turn ON, indication of, e.g., an LED and a mechanical operation of the apparatus body can not be also performed. However, when the hard power turns ON at first, a sequence for measurement of head characteristics is started at step S1, and after completing step 1, the apparatus is set to a waiting state of soft power ON.

Next, when the soft power turns ON (or, when the soft power turns ON to complete the sequence for measurement of head characteristics before completion thereof after the hard power turns ON), an unejection detecting sequence is performed at step S2. After completing the unejection detecting sequence, timers start at step S3, and the sequence moves to waiting state 1 at step S4.

The timers, such as suction timers and pre-ejection timers, continues their operation unless hard power OFF, and then, becomes parameters for recovery sequence performed when the soft power turns ON again after the soft power has turned OFF, or when print instruction is sent.

When the print instruction is sent after waiting state 1 at step 5, recovery sequence 2 is performed at step 6, and printing is stated at step 7. After completion of printing, the sequence returns to waiting state 1 (step S4). When the soft power turns OFF from waiting state 1 at step S8, recovery sequence 3 is performed at step S9, and the sequence moves to waiting state 2 (step S10). Under this condition, the hard power is set to ON state and timers is in an operation. In next soft power ON (step S11), recovery sequence 1 is performed at step S12 and the sequence moves to the waiting state (step S4).

(1) As described above, if the hard power is set ON, but when the soft power does not turn ON, there is visually no performance. However, the measurement of head characteristics is practically is performed. For this reason, for example, when the hard power automatically turns ON by external timers and the like every day before a user set the soft power ON, the measurement of head characteristics has already been completed, thus making the operation time shorter.

(2) Furthermore, in case of such a usual use as soft power ON/OFF is repeated in a state of hard power ON, an optimum recovery operation is performed with combination of some kinds of timers such as suction timers and pre-ejection timers at the time of soft power ON, thus preventing the ink from waste, and also keeping the reliability of print pictures. Similarly, the measurement of head characteristics is not required on this moment, thus reducing rise time.

(3) On the other hand, when a user sets soft power ON after hard power ON, the measurement of head characteristics is required every time, however, if measured values of various kinds of characteristics are defined as decision, the time spent for measuring will not be required. Furthermore, since an unejection detecting sequence is certainly performed, the ejection reliability can be kept.

(4) Furthermore, if the hard power is set ON, but when the soft power does not turn ON, the unejection detection is not performed. For example, even if hard power ON/OFF is repeatedly performed without using the body, waste of ink can be prevented during the ejection detecting operation, thus reducing running cost and waste ink quantity.

(5) As described above, when the soft power turns ON immediately after hard power ON, the unejection detecting sequence is performed. In other cases of soft power ON, by performing timer recovery sequence (recovery sequence 1), the reliability of ejection can be kept together with preventing waste of ink. On this moment, if the power source is set to OFF state, (i.e., to a state of hard power OFF), timers is not required to work. For this reason, a back-up power source is not also required, thus enabling cost down.

Recovery Sequence 1

Figure 64:
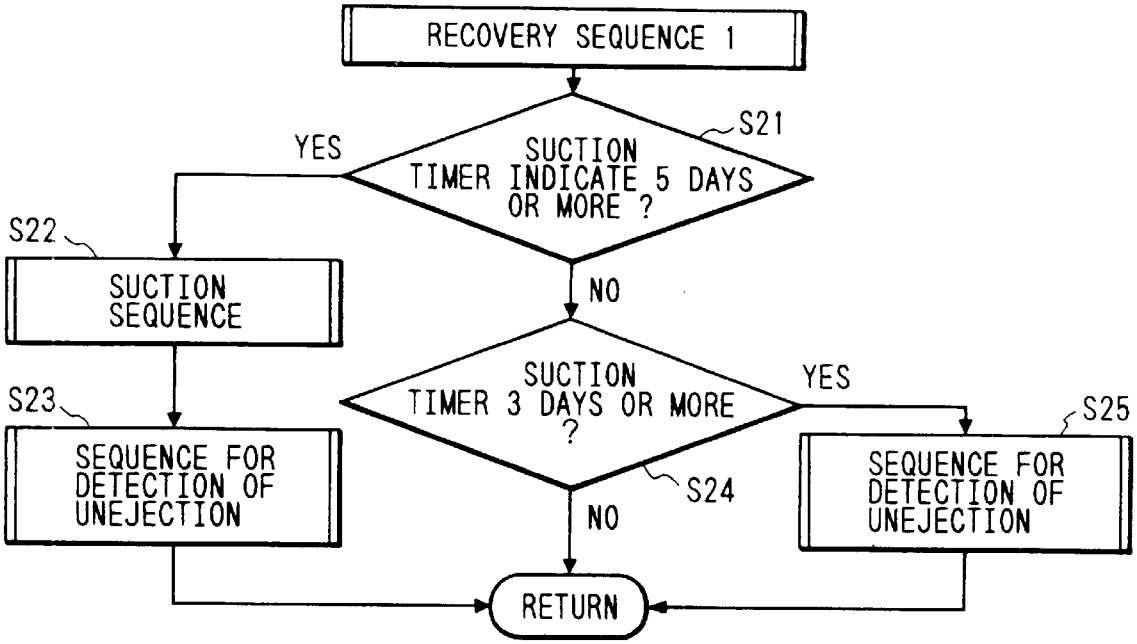
FIG. 64 is a flowchart of the recovery sequence 1 shown in FIG. 63.

Referring to FIG. 64, the recovery sequence 1 will be described. This sequence is a recovery sequence performed after the apparatus body rises once in a state of soft power OFF, and when the soft power turns ON again in the waiting state 2.

At first, whether suction timers indicate five days or more is detected at step S21, if more than five days, a suction recovery operation is forced to perform at step S22. Then, the suction timers and pre-ejection timers are reset, an unejection detecting sequence is performed (step S23) to return. If the suction timers does not indicate five days or more, whether to indicate three days or more is detected at step S24, if more than three days, the unejection detecting sequence is performed (step S25) to return. When the suction timers does not indicate three days or more, the sequence is returned.

With such a sequence, an optimum recovery operation can be performed without waste of ink, thus keeping the reliability of print pictures.

Recovery Sequence 2

Figure 65:
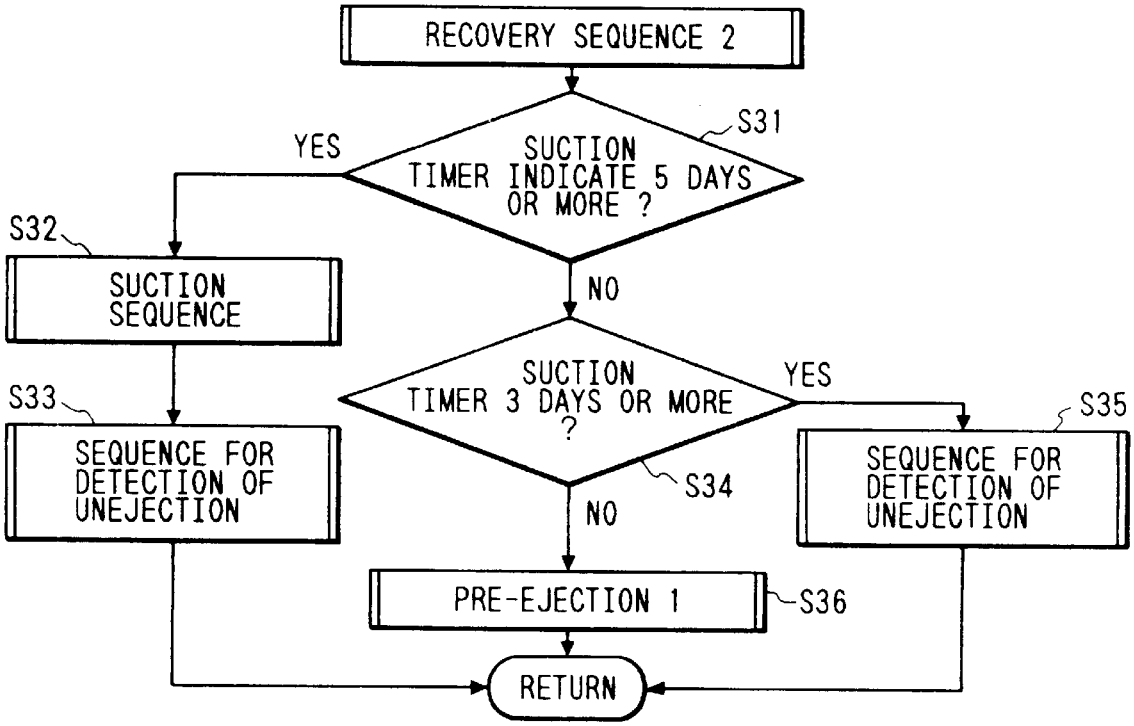
FIG. 65 is a flowchart of the recovery sequence 2 shown in FIG. 63.

Referring to FIG. 65, the recovery sequence 2 will be described. This sequence is a recovery sequence performed when the print instruction is input in the waiting state 1, i.e., performed in the case that the operation has been set in the waiting state 1 for a long time. Therefore, it is different from a pre-ejection operation in a printing sequence.

Figure 66:
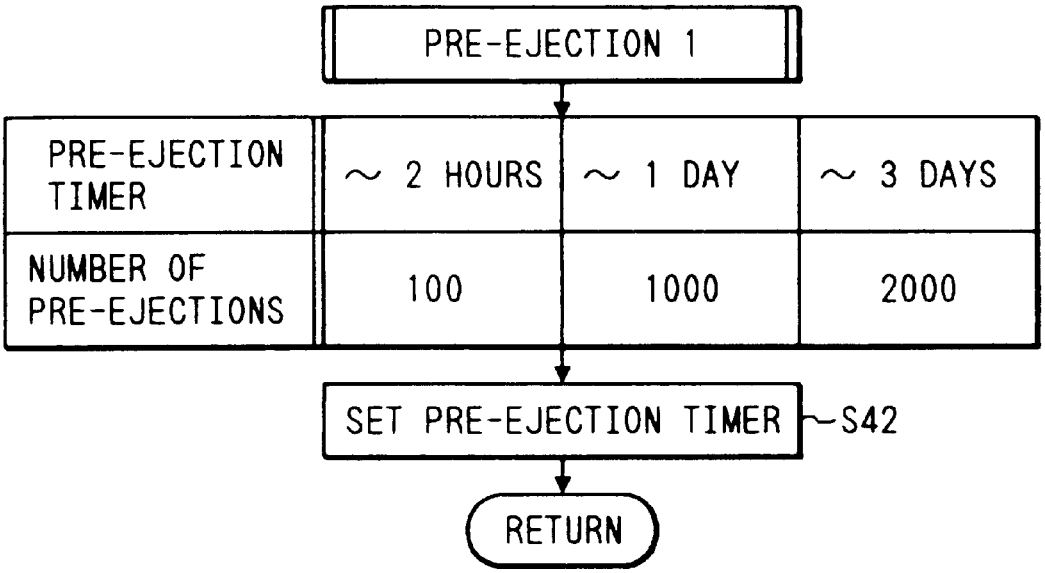
FIG. 66 is a flowchart of the pre-ejection 1 shown in FIG. 65.

At first, whether suction timers indicate five days or more is detected at step S31, if more than five days, a suction recovery operation is forced to perform at step S32. Then, the suction timers and pre-ejection timers are reset, an unejection detecting sequence is performed (step S33) to return. If the suction timers does not indicate five days or more, whether to indicate three days or more is detected at step S34, if more than three days, the unejection detecting sequence is performed (step S35) to return. When the suction timers does not indicate three days or more, the pre-ejection sequence as shown in FIG. 66 (refer to steps S41 and S42) is performed at step S36, finally the operation is returned to move to the printing sequence.

With such a sequence, an optimum recovery operation can be performed without waste of ink, thus keeping the reliability of print pictures.

Recovery Sequence 3

Figure 67:
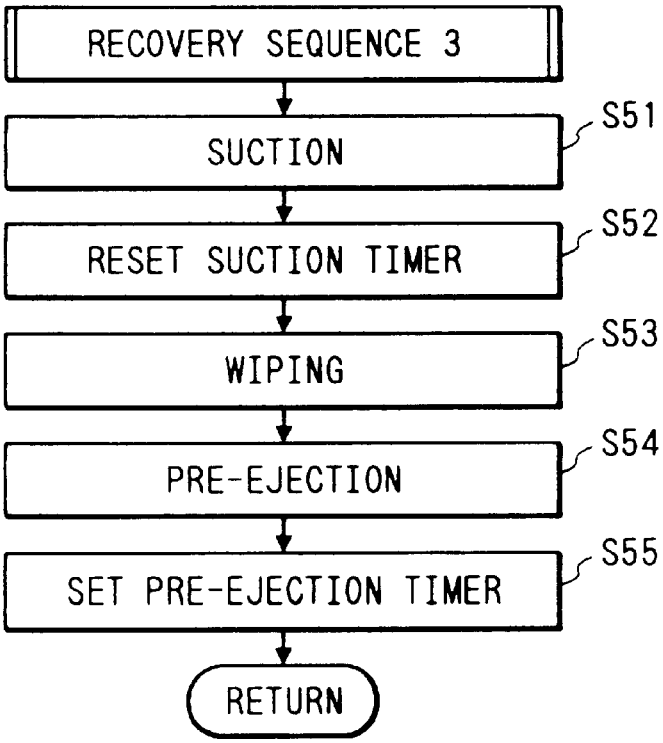
FIG. 67 is a flowchart of the recovery sequence 3 shown in FIG. 63.

The recovery sequence 3 is a recovery sequence performed when the soft power turns OFF from the waiting state 1. As shown in FIG. 67, in steps S51 to S55, the recording head is capped by performing wiping of recording head, and then, by performing the pre-ejection operation. After that, the operation moves to the waiting state 2 indicating an abandoned state.

As described above, according to the 13th embodiment, since there are provided two types of power ON mechanism, hard power ON and soft power ON, various kinds of characteristics are measured during hard power ON, highly accurate control can be performed, thus reducing rise time.

Furthermore, when the soft power turns ON after hard power ON, the unejection detecting operation is performed, so that waste of ink can be prevented, thus keeping the reliability.

Furthermore, the structure of the apparatus body according to this embodiment includes a measuring means for measuring a temperature of each recording head, a presuming calculation means for calculating a temperature of each recording head, a correcting means for bringing the temperature calculated value of each recording head close to the temperature measured value of each recording head, and an unejection deciding means for deciding as to whether each recording head is in an unejection state by the temperature measured value of each recording head and the temperature calculated value of each recording head. Therefore, whether ejection of the recording head is normal can be accurately detected, thus considerably preventing the recording head from drive without ink.

Furthermore, since timers are operated only during hard power ON, the back-up power source is not required.

The present invention is particularly suitably usable in an ink jet recording head and recording apparatus wherein thermal energy by an electrothermal transducer, laser beam or the like is used to cause a change of state of the ink to eject or discharge the ink. This is because the high density of the picture elements and the high resolution of the recording are possible.

The typical structure and the operational principle are preferably the ones disclosed in U.S. Pat. Nos. 4,723,129 and 4,740,796. The principle and structure are applicable to a so-called on-demand type recording system and a continuous type recording system. Particularly, however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from uncleation boiling point, by which the thermal energy is provided by the electrothermal transducer to produce film boiling on the heating portion of the recording head, whereby a bubble can be formed in the liquid (ink) corresponding to each of the driving signals. By the production, development and contraction of the bubble, the liquid (ink) is ejected through an ejection outlet to produce at least one droplet. The driving signal is preferably in the form of a pulse, because the development and contraction of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion, as well as the structure of the combination of the ejection outlet, liquid passage and the electrothermal transducer as disclosed in the above-mentioned patents. In addition, the present invention is applicable to the structure disclosed in Japanese Laid-Open Patent Application No. 59-123670 wherein a common slit is used as the ejection outlet for plural electrothermal transducers, and to the structure disclosed in Japanese Laid-Open Patent Application No. 59-138461 wherein an opening for absorbing pressure wave of the thermal energy is formed corresponding to the ejecting portion. This is because the present invention is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head and plural recording head combined to cover the maximum width.

In addition, the present invention is applicable to a serial type recording head wherein the recording head is fixed on the main assembly, to a replaceable chip type recording head which is connected electrically with the main apparatus and can be supplied with the ink when it is mounted in the main assembly, or to a cartridge type recording head having an integral ink container.

The provisions of the recovery means and/or the auxiliary means for the preliminary operation are preferable, because they can further stabilize the effects of the present invention. As for such means, there are capping means for the recording head, cleaning means therefor, pressing or sucking means, preliminary heating means which may be the electrothermal transducer, an additional heating element or a combination thereof. Also, means for effecting preliminary ejection (not for the recording operation) can stabilize the recording operation.

As regards the variation of the recording head mountable, it may be a single corresponding to a single color ink, or may be plural corresponding to the plurality of ink materials having different recording color or density. The present invention is effectively applicable to an apparatus having at least one of a monochromatic mode mainly with black, a multi-color mode with different color ink materials and/or a full-color mode using the mixture of the colors, which may be an integrally formed recording unit or a combination of plural recording heads.

Furthermore, in the foregoing embodiment, the ink has been liquid. It may be, however, an ink material which is solidified below the room temperature but liquefied at the room temperature. Since the ink is controlled within the temperature not lower than 30° C. and not higher than 70° C. to stabilize the viscosity of the ink to provide the stabilized ejection in usual recording apparatus of this type, the ink may be such that it is liquid within the temperature range when the recording signal is the present invention is applicable to other types of ink. In one of them, the temperature rise due to the thermal energy is positively prevented by consuming it for the state change of the ink from the solid state to the liquid state. Another ink material is solidified when it is left, to prevent the evaporation of the ink. In either of the cases, the application of the recording signal producing thermal energy, the ink is liquefied, and the liquefied ink may be ejected. Another ink material may start to be solidified at the time when it reaches the recording material. The present invention is also applicable to such an ink material as is liquefied by the application of the thermal energy. Such an ink material may be retained as a liquid or solid material in through holes or recesses formed in a porous sheet as disclosed in Japanese Laid-Open Patent Application No. 54-56847 and Japanese Laid-Open Patent Application No. 60-71260. The sheet is faced to the electrothermal transducers. The most effective one for the ink materials described above is the film boiling system.

The ink jet recording apparatus may be used as an output terminal of an information processing apparatus such as computer or the like, as a copying apparatus combined with an image reader or the like, or as a facsimile machine having information sending and receiving functions.

While the invention has been described with reference to the structures disclosed herein, it is not confined to the details set forth and this application is intended to cover such modifications or changes as may come within the purposes of the improvements or the scope of the following claims.

What is claimed is:

1. An ink jet recording apparatus comprising:

a recording head for performing print recording by ejecting an ink from an ejection orifice using thermal energy;

a plurality of temperature sensors provided in said recording head;

a temperature calculation means for calculating a temperature change of said recording head in a unit time as a discrete value based on a supply of energy input to said recording head, and for calculating a temperature change of said recording head by accumulating the discrete value in the unit time;

a temperature predicting means for predicting a head temperature by both a calculated value of the temperature change and a base value of the head temperature:

a detection means for detecting a difference between the head predicted temperature and a detected temperature sensed by said temperature sensors;

an update means for updating the base value of the head temperature by the difference which has been detected; and a control means for controlling ejection of the ink so as to be stabilized in accordance with the head predicted temperature.

2. An ink jet recording apparatus according to claim 1, wherein said detection means detects the difference between the head predicted temperature and the detected temperature sensed by said temperature sensor after passage of 0.8 seconds following a stopping of driving of at least one of an ejection heater and a sub (heating) heater.

3. An ink jet recording apparatus according to claim 1, wherein the adopted base value of the head temperature is updated by said update means before a start of print recording.

4. An ink jet recording apparatus according to claim 1, wherein the adopted base value of the head temperature is updated by said update means after a suction recovery operation.

5. An ink jet recording apparatus according to claim 1, wherein the base value of the head temperature is updated by said update means after at least one of an unejection detection and an idle election which is not used for printing.

6. An ink jet recording apparatus according to claim 1, wherein said control means controls an ejection recovery of said recording head.

7. An ink jet recording apparatus according to claim 1, wherein said control means controls an ejection quantity of said recording head.

8. An ink jet recording apparatus according to claim 1, further comprising:

a storage means for storing at least one of a temperature reduction table containing a data used by said calculating means, a measuring means for measuring a heat characteristic of said recording head in advance, and a selecting means for selecting the temperature reduction table in accordance with the measured heat characteristic of said recording head.

9. An ink jet recording apparatus according to claim 8, wherein the difference is set within a predetermined value by stopping the operation of said temperature calculation means, or by adding a virtual print duty, in a case that the predicted temperature is lower over a predetermined value than the detected temperature, and the difference is set within a predetermined value by skipping a calculation of said temperature calculation means at a certain interval time in a case that the predicted temperature is higher over a predetermined value than the detected temperature.

10. An ink jet recording apparatus according to claim 1, wherein said control means controls an amount of ejection of the ink so as to stabilize the ejection of the ink.

11. An ink jet recording apparatus according to claim 1, wherein said temperature predicting means predicts the head temperature by adding the head temperature change into the base value of the head temperature.

12. An ink jet recording apparatus according to claim 1, further comprising a plurality of said temperature sensors.

13. An ink jet recording apparatus comprising:

a recording head for performing print recording by ejecting an ink from an ejection orifice using thermal energy;

a temperature sensor provided in said recording head;

a temperature calculation means for calculating a temperature change of said recording head in a unit time as a discrete value based on a supply of energy input to said recording head, and for calculating a temperature change of said recording head by accumulating the discrete value in the unit time;

a temperature presuming means for presuming a head temperature by both a calculated value of the temperature change and an initial value of the head temperature;

a detection means for detecting a difference between the head predicted temperature and a detected temperature sensed by said temperature sensor;

an operation means for operating said temperature calculation means by the difference which has been detected; and a control means for controlling ejection of the ink so as to be stabilized in accordance with the head predicted temperature.

14. An ink jet recording apparatus according to claim 13, wherein said control means controls an ejection recovery of said recording head.

15. An ink jet recording apparatus according to claim 13, wherein said control means controls an ejection quantity of said recording head.

16. An ink jet recording apparatus according to claim 13, wherein said control means controls an amount of ejection of the ink so as to stabilize the ejection of the ink.

17. An ink jet recording apparatus as in claim 13, further comprising a plurality of said temperature sensors.

18. An ink jet recording apparatus which performs a print recording by ejecting an ink from a recording head having a plurality of recording elements onto a recording medium, the apparatus comprising:

a head temperature monitoring means for monitoring a head temperature of the recording head and outputting a first temperature data;

a head temperature predicting means for predicting the head temperature based upon energy input to the head and outputting a second temperature data; and a nonejection deciding means for deciding whether the recording head is in a nonejecting state based upon information obtained based on both the first temperature data obtained from said monitoring means and the second temperature data obtained from said predicting means.

19. An ink jet recording apparatus according to claim 18, wherein said nonejection deciding means decides whether the recording head is in the nonejecting state by comparing a difference between a monitoring value and a predicted value of the head temperature with a threshold value which has been determined in advance.

20. An ink jet recording apparatus according to claim 19, wherein said nonejection deciding means changes a threshold value for deciding if the recording head is in a nonejection state in accordance with a state of said ink jet recording apparatus.

21. An ink jet recording apparatus according to claim 19, wherein said nonejection deciding means changes a threshold value for deciding if the recording head is in a nonejecting state in accordance with a state of a printing mode of said ink jet recording apparatus.

22. An ink jet recording apparatus according to claim 19, wherein said nonejection deciding means changes the threshold value for unejection decision in accordance with the print duty detected by printing data.

23. An ink jet recording apparatus according to claim 18, wherein said nonejecting deciding means decides whether the recording head is in a nonejecting state based upon at least one of a temperature rise accompanying ink ejection by the recording head, and a temperature reduction after ink ejection.

24. An ink jet recording apparatus according to claim 18, further comprising a deciding means for deciding whether the recording head has recovered from the nonejecting state after a recovery operation has been performed with respect to the recording head decided by the nonejection deciding means to be in the nonejecting state.

25. An ink jet recording apparatus according to claim 18, further comprising:

a plurality of recording heads; and a control means for controlling operation of said ink let recording apparatus, wherein the recording heads decided to be in the nonejecting state by said nonejection deciding means are not driven and printing is performed by using those of the recording heads which are not in a nonejecting state.

26. An ink jet recording apparatus according to claim 18, further comprising:

a plurality of said recording heads; and a control means for controlling operation of said ink jet recording apparatus, wherein temperature control is performed for the recording heads save for those of the recording heads decided to be in the nonejecting state by said nonejection deciding means.

27. An ink jet recording apparatus according to claim 18, further comprising:

a plurality of recording heads; and a control means, wherein printing is performed by using a print data with respect to the recording heads except for those of the recording heads decided to be in a nonejecting state by said nonejection deciding means.

28. An ink jet recording apparatus according to claim 18, wherein said nonejection deciding means makes a decision as to nonejection during printing.

29. An ink jet recording apparatus according to claim 18, further comprising a second nonejection deciding means for making the recording head perform an idle ejection which is not used for printing, for detecting a first temperature before performing the idle ejection of the recording head, for detecting a second temperature when completing the idle ejection and detecting a third temperature after a predetermined time has passed after completion of the idle ejection, and for deciding if the recording head is in the nonejecting state based on a temperature rise value and a temperature reduction value, represented respectively as the first temperature and the second temperature obtained through the idle ejection and as the second temperature and the third temperature obtained after completing the idle ejection.

30. An ink let recording apparatus which performs a print recording by electing an ink from a recording head onto a recording medium, the apparatus comprising:

a head temperature monitoring means for monitoring a head temperature of the recording head;

a head temperature predicting means for predicting the head temperature based upon energy input to the head; and a nonejection deciding means for deciding whether the recording head is in a nonejecting state based upon a temperature data obtained from said monitoring means and said predicting means, wherein said nonejection deciding means makes the recording head perform an idle ejection which is not used for printing, detects a first temperature before performing the idle ejection of the recording head, detects a second temperature when completing the idle ejection and detects a third temperature after a predetermined time has passed after completion of the idle ejection, and decides if the recording head is in the nonejecting state based on a temperature rise value and a temperature reduction value, represented respectively as the first temperature and the second temperature obtained through the idle ejection and as the second temperature and the third temperature obtained after completing the idle ejection.

31. An ink let recording apparatus which performs a print recording by ejecting an ink from a recording head onto a recording medium, the apparatus comprising:

a head temperature monitoring means for monitoring a head temperature of the recording head;

a head temperature predicting means for predicting the head temperature based upon energy input to the head; and a nonejection deciding means for deciding whether the recording head is in a nonejecting state based upon a temperature data obtained from said monitoring means and said predicting means, wherein said nonejection deciding means decides whether the recording head is in the nonejecting state by comparing a difference between a monitoring value and a predicted value of the head temperature with a threshold value which has been determined in advance, and wherein said nonejection deciding means performs a calculation based upon a monitoring temperature of the head, a predicted value of a head temperature, or at least these two values at an interval satisfying a predetermined condition, accumulates the calculated values to obtain an accumulated value, and decides if the recording head is in a nonejecting state by comparing the accumulated value with a threshold value which has been determined in advance.

32. An ink jet recording apparatus according to claim 31, wherein said nonejection deciding means performs a calculation based upon a monitoring temperature of the head, a predicted value of a head temperature, or at least these two values in a predetermined time, accumulates the calculated values to obtain the accumulated value, and decides if the recording head is in a nonejecting state by comparing the accumulated value with a threshold value which has been determined in advance.

33. An ink jet recording apparatus according to claim 31, wherein said nonejection deciding means performs a calculation based upon a monitoring temperature of the head, a predicted value of a head temperature, or at least these two values during scanning, accumulates the calculated values to obtain an accumulated value, corrects the accumulated value to obtain a corrected value by detecting a print duty as a result of printing data before an actual printing, and decides if the recording head is in a nonejecting state by comparing the corrected value with a threshold value having been determined in advance thereof.

34. An ink jet recording apparatus according to claim 31, wherein said nonejection deciding means detects a print duty by printing a data and accumulates the detected print duties, and performs a calculation based upon a monitoring temperature of the head, a predicted value of a head temperature, or at least these two values, accumulates the calculated temperature values until the accumulated print duties reach a predetermined quantity, and decides whether the recording head is in a nonejecting state by comparing the accumulated value with a threshold value which has been determined in advance.

35. A method of recording print using an ink jet recording apparatus, by performing a print recording by ejecting an ink from a plurality of recording heads, each having a plurality of recording elements, onto a recording medium, the method comprising the steps of:

deciding whether each said recording head is in a nonejecting state;

preventing the recording head decided to be in the nonejecting state from being driven;

eliminating a print data corresponding to that said recording head decided to be in the nonejecting state in said deciding step, and performing the printing using only a print data corresponding to those of the recording heads which are not in the nonejecting state.

36. An ink jet recording apparatus according to claim 35, wherein said nonejection deciding means accumulates a difference between the monitoring value and the predicted value of the head temperature for a predetermined time to obtain an accumulated value, and decides whether the recording head is in a nonejecting state by comparing the accumulated value with a threshold value which has been determined in advance.

37. An ink jet recording apparatus according to claim 35, wherein said nonejection deciding means accumulates a difference between the monitoring value and the predicted value of the head temperature during scanning to obtain an accumulated value, corrects the accumulated value by detecting a print duty as a result of printing a data before an actual printing, and decides if the recording head is in a nonejecting state by comparing the corrected value with a threshold value which has been determined in advance.

38. An ink jet recording apparatus according to claim 35, wherein said nonejection deciding means detects a print duty by printing a data and accumulates the detected print duties, and accumulates a difference between the monitoring value and the predicted value of the head temperature to obtain an accumulated value until the accumulated print duties reach a predetermined quantity, and decides whether the recording head is in a nonejecting state by comparing the accumulated value with a threshold value which has been determined in advance.

39. An ink let recording apparatus which performs a print recording by electing an ink from a recording head onto a recording medium, the apparatus comprising:

a head temperature monitoring means for monitoring a head temperature of the recording head;

a head temperature predicting means for predicting the head temperature based upon energy input to the head; and a nonejection deciding means for deciding whether the recording head is in a nonejecting state based upon a temperature data obtained from said monitoring means and said predicting means, wherein said nonejection deciding means decides whether the recording head is in the nonejecting state by comparing a given value, which is calculated by subtracting a first value, which subtracts a predicted value of the head temperature from a monitoring temperature which was obtained immediately before starting a scan of a line next to a currently printed line, from a second value which subtracts a predicted value of the head temperature from a monitoring temperature which was obtained immediately after completing the scan of the currently printed line, with a threshold value which has been determined in advance.

40. An ink let recording apparatus which performs a print recording by electing an ink from a recording head onto a recording medium, the apparatus comprising:

a head temperature monitoring means for monitoring a head temperature of the recording head;

a head temperature predicting means for predicting the head temperature based upon energy input to the head; and a nonejection deciding means for deciding whether the recording head is in a nonejecting state based upon a temperature data obtained from said monitoring means and said predicting means, further comprising a deciding means for deciding whether the recording head has recovered from the nonejecting state after a recovery operation has been performed with respect to the recording head decided by the nonejection deciding means to be in the nonejecting state, and further comprising an idle driving means for making the recording head perform the idle ejection which is not used for printing after a recovery operation has been performed with respect to the recording head decided to be in a nonejecting state, which detects the first temperature before performing the idle ejection of the recording head, the second temperature when completing the idle ejection and the third temperature after a predetermined time has passed after completion of the idle ejection, and decides if the recording head has recovered from the nonejecting state based on the temperature rise value and the temperature reduction value, represented respectively as the first temperature and the second temperature obtained by idle ejection and as the second temperature and the third temperature obtained after completing the idle ejection.

41. A method of recording print using an ink jet recording apparatus, by performing a print recording by ejecting an ink from a plurality of recording heads onto a recorded medium, the method comprising the steps of:

deciding whether each said recording head is in a non-ejecting state;

preventing the recording heads decided to be in the nonejecting state from being energized for temperature control; and performing temperature control for only the recording heads which are not in the nonejecting state.

42. A method of recording using an ink jet recording apparatus, by performing a recording by ejecting an ink from a recording head having a plurality of recording elements onto a recording medium, the method comprising the steps of:

performing a first detection in a first manner regarding nonejection by the recording head; and performing a second detection in a second manner regarding nonejection by the recording head, wherein the second detection performed in the second manner is performed after completion of the first detection performed in said first manner, said first manner being different from said second manner, said second detection being performed by executing an idle ink ejection not serving to record an image on the recording medium.

43. An ink jet recording apparatus, having an apparatus body, which performs recording using a recording head mounted thereon, said recording head having a plurality of recording elements, comprising:

an actuating means for permitting energy to be supplied to the apparatus body, said actuating means having an ON setting;

a setting means for setting the apparatus body to an operational state in which electric power is supplied to the apparatus body, said setting means having an ON setting; and a measuring means for measuring an inherent characteristic of the recording head itself when said actuating means is set to the ON setting, wherein the apparatus body is set to a standby state for the ON setting of the setting means after measurement of the inherent characteristic of the recording head while said actuating means is set to the ON setting, while the measurement of the inherent characteristic of the recording head is not conducted when the setting means is set to the ON setting thereafter.

44. An ink jet recording apparatus according to claim 43, further comprising a detecting means for detecting as to whether the recording heads eject the ink in a normal manner when said setting means is set to the ON setting after said actuating means has been set to the ON setting.

45. An ink jet recording apparatus, having an apparatus body, which performs print recording using a plurality of recording heads mounted thereon, comprising:

an actuating means for permitting energy to be supplied to the apparatus body, said actuating means having an ON setting;

a setting means for setting the apparatus body to an operational state in which electric power is supplied to the apparatus body, said setting means having an ON setting; and a measuring means for measuring a plurality of characteristics of the recording heads when said actuating means is set to the ON setting, further comprising a measuring means for measuring a measured temperature of each said recording head, a predicting calculation means for calculating a calculated temperature of each said recording head, a correcting means for bringing the calculated temperature for each said recording head close to the measured temperature for each said recording head, and a non-ejection deciding means for deciding whether each said recording head is in a nonejecting state based upon the measured temperature of each said recording head and the calculated temperature of each said recording head.

46. An ink jet recording apparatus according to claim 45, further comprising a detecting means for detecting whether the recording heads normally eject the ink when said setting means is set to the ON setting after said actuating means has been set to the ON setting.

47. An ink let recording apparatus, having an apparatus body, which performs print recording using a plurality of recording heads mounted thereon, comprising:

an actuating means for permitting energy to be supplied to the apparatus body, said actuating means having an ON setting;

a setting means for setting the apparatus body to an operational state in which electric power is supplied to the apparatus body, said setting means having an ON setting; and a measuring means for measuring a plurality of characteristics of the recording heads when said actuating means is set to the ON setting, further comprising a storing means for a plurality of characteristic data for the recording heads and for comparing the characteristic data with a last measured value of said characteristic data.

48. An ink jet recording apparatus, having an apparatus body, which performs print recording using a plurality of recording heads mounted thereon, comprising:

an actuating means for permitting energy to be supplied to the apparatus body, said actuating means having an ON setting;

a setting means for setting the apparatus body to an operational state in which electric power is supplied to the apparatus body, said setting means having an ON setting; and a measuring means for measuring a plurality of inherent characteristics of the recording heads themselves when said actuating means is set to the ON setting, further comprising a recording head recognition means for changing the plurality of inherent characteristics of the recording heads into a plurality of numerical values corresponding thereto and using the numerical values as distinguishing data for the recording heads themselves.

49. An ink jet recording apparatus according to claim 48, further comprising a recording head recognition means for setting an order of priority for the plurality of characteristics of the recording heads and deciding from a particular position in the order of priority whether each said head characteristic is in a same said head.

50. An ink jet recording apparatus according to claim 49, further comprising a recording head recognition means for omitting a measurement of the characteristics which are set lower than a given level in the order of priority, and for deciding whether only measured items are in the same said head.

51. An ink jet recording apparatus according to claim 48, further comprising a means for defining a plurality of characteristics of the recording heads used in making a decision and measuring the head characteristics up to a decided value.

52. An ink jet recording apparatus, having an apparatus body, which performs print recording using a plurality of recording heads mounted thereon, comprising:

an actuating means for permitting energy to be supplied to the apparatus body, said actuating means having an ON setting;

a setting means for setting the apparatus body to an operational state in which electric power is supplied to the apparatus body, said setting means having an ON setting; and a measuring means for measuring a plurality of inherent characteristics of the recording heads themselves when said actuating means is set to the ON setting, wherein the recording heads eject the ink using thermal energy.

53. An apparatus according to claim 52, wherein said measuring means measures at least one of a thermal characteristic and a heater characteristic of the recording head as a characteristic of a recording head itself.

54. An ink jet recording apparatus, having an apparatus body, which performs a print recording using a plurality of recording heads mounted thereon, comprising:

an actuating means for permitting energy to be supplied to the apparatus body, said setting means having an ON setting;

a setting means for setting the apparatus body to an operational state in which electric power is supplied to the apparatus body, said setting means having an ON setting; and a detection means for detecting which of the recording heads normally eject the ink when said setting means is set to the ON setting after said actuating means has been set to the ON setting.

55. An ink jet recording apparatus according to claim 54, further comprising a measuring means for measuring a measured temperature of each said recording head, a predicting calculation means for calculating a calculated temperature of each said recording head, a correcting means for bringing the calculated temperature for each said recording head close to the measured temperature for each said recording head, and a nonejection deciding means for deciding whether each said recording head is in a nonejecting state based upon the measured temperature of each said recording head and the calculated temperature of each said recording head.

56. An ink jet recording apparatus according to claim 54, further comprising a time measuring means for timing a state of the recording head when said actuating means is set to the ON setting, and a recovery means for performing an optimum recovery in accordance with a time obtained by said time measuring means when said setting means is set to the ON setting other than the time when said setting means is set to the ON setting after said actuating means has been set to the ON setting.

57. An ink jet recording apparatus according to claim 54, wherein the recording heads eject the ink by using thermal energy.

58. An ink jet recording apparatus which performs a print recording using a plurality of recording heads mounted thereon, each said recording head having a plurality recording elements, comprising:

a measuring means for measuring a measured temperature of each said recording head;

a predicting calculation means for calculating a calculated temperature of each said recording head;

a correcting means for bringing the calculated temperature of each said recording head close to the measured temperature of each said recording head; and a nonejection deciding means for deciding as to whether each said recording head is in a non ejection state based upon information obtained based on the measured temperature for each said recording head obtained from said measuring means and the calculated temperature for each said recording head obtained from said predicting calculation means.

59. An ink jet recording apparatus according to claim 58, wherein the recording heads eject the ink by using thermal energy.

* * * * *

UNITED STATES PATENT AND TRADEMARK OFFICE

CERTIFICATE OF CORRECTION

PATENT NO. : 6,086,180
DATED : July 11, 2000
INVENTOR(S) : Hitoshi Sugimoto et al.

It is certified that error appears in the above-identified patent and that said Letters Patent is hereby corrected as shown below:

Column 53,
Line 18, "plurality of temperature sensors" should read -- temperature sensor --;
Line 28, "temperature:" should read -- temperature; --;
Line 31, "sensors;" should read -- sensor; --
Line 55, "election" should read -- ejection --; and
Line 67, "means," should read -- means; --.

Column 54,
Line 2, "advance," should read -- advance; --; and
Line 61, "print" should be deleted.

Column 55,
Line 2, "energy" should read -- energy formation regarding --; and
Line 44, "let" should read -- jet --.

Column 56,
Line 18, "let" should read -- jet --;
Line 19, "electing" should read -- ejecting --;
Line 44, "let" should read -- jet --.

Column 57, claim 35,
Lines 33-48, should be deleted, and the following inserted in its place:

-- 35. An ink jet recording apparatus which performs a print recording by ejecting an ink from a recording head onto a recording medium, the apparatus comprising:

a head temperature monitoring means for monitoring a head temperature of the recording head;

a head temperature predicting means for predicting the head temperature based upon energy input to the head; and a nonejection deciding means for deciding whether the recording head is in a nonejecting state based upon a temperature data obtained from said monitoring means and said predicting means, wherein said nonejection deciding means decides whether the recording head is in the nonejecting state by comparing a difference between a monitoring value and a predicted value of the head temperature with a threshold value which has been determined in advance, and

UNITED STATES PATENT AND TRADEMARK OFFICE

CERTIFICATE OF CORRECTION

PATENT NO. : 6,086,180
DATED : July 11, 2000
INVENTOR(S) : Hitoshi Sugimoto et al.

It is certified that error appears in the above-identified patent and that said Letters Patent is hereby corrected as shown below:

wherein said nonjection deciding means accumulates a difference between the monitoring value and the predicted value of the head temperature at an interval satisfying a predetermined condition to obtain an accumulated value, and decides whether the recording head is in a nonejecting state by comparing the accumulated value with a threshold value which has been determined in advance. --.

Column 58,
Line 9, "let" should read -- jet --;
Line 10, "electing" should read -- ejecting --;
Line 33, "let" should read -- jet --; and
Line 34, "electing" should read -- ejecting --.

Column 60,
Line 17, "let" should read -- jet --.

Column 62,
Line 21, "plurality of" should be deleted and "heads" should read -- head --;
Line 22, "each" should be deleted and "plurality" should read -- plurality of --;
Lines 25, 27, 29, 30, 32, 34, and 36, "each" should be deleted.

Signed and Sealed this

Fifteenth Day of January, 2002

*Attest:*

*Attesting Officer*

JAMES E. ROGAN
*Director of the United States Patent and Trademark Office*